US011555235B2

(12) United States Patent
Tokuda et al.

(10) Patent No.: US 11,555,235 B2
(45) Date of Patent: Jan. 17, 2023

(54) METALLIC COATED STEEL PRODUCT

(71) Applicant: NIPPON STEEL CORPORATION, Tokyo (JP)

(72) Inventors: Kohei Tokuda, Tokyo (JP); Yoshinari Ishida, Tokyo (JP); Takuya Mitsunobu, Tokyo (JP); Nobuyuki Shimoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 368 days.

(21) Appl. No.: 16/480,976

(22) PCT Filed: Jan. 26, 2018

(86) PCT No.: PCT/JP2018/002596
§ 371 (c)(1),
(2) Date: Jul. 25, 2019

(87) PCT Pub. No.: WO2018/139620
PCT Pub. Date: Aug. 2, 2018

(65) Prior Publication Data

US 2020/0002798 A1 Jan. 2, 2020

(30) Foreign Application Priority Data

Jan. 27, 2017 (JP) ..... JP2017-013259

(51) Int. Cl.
*C23C 2/06* (2006.01)
*C22C 18/04* (2006.01)
(Continued)

(52) U.S. Cl.
CPC ..... *C23C 2/06* (2013.01); *C22C 18/04* (2013.01); *C23C 2/12* (2013.01); *C23C 2/40* (2013.01)

(58) Field of Classification Search
CPC .... C23C 2/06; C23C 2/12; C23C 2/40; C22C 18/04
See application file for complete search history.

(56) References Cited

U.S. PATENT DOCUMENTS 6,235,410 B1 5/2001 Komatsu et al.
2003/0072963 A1* 4/2003 Komatsu ..... C23C 2/40 428/659
(Continued)

FOREIGN PATENT DOCUMENTS

CN 1342211 A 3/2002
EP 1 199 376 A1 4/2002
(Continued)

OTHER PUBLICATIONS

Horikawa et al., "Weldability of Hot-dip Zn-6% Al-3% Mg Alloy Coated Steel Sheet", Nisshin Steel technical report, 2011, No. 92, pp. 39-47.
(Continued)

*Primary Examiner* — Anthony M Liang
(74) *Attorney, Agent, or Firm* — Solaris Intellectual Property Group, PLLC

(57) ABSTRACT

Provided is a metallic coated steel product which is less likely to experience LME and blowhole formation and is likely to exhibit an improved corrosion resistance at welding heat affected zones. The metallic coated steel product is a hot-dip metallic coated steel product including a steel product and a plating layer that is provided on a surface of the steel product and includes a Zn—Al—Mg alloy layer. In a cross-section of the Zn—Al—Mg alloy layer an area fraction of $MgZn_2$ phase is from 45 to 75%, a total area fraction of $MgZn_2$ and Al phases is not less than 70%, and an area
(Continued)

fraction of Zn—Al—$MgZn_2$ ternary eutectic structure is from 0 to 5%; and the plating layer has a predetermined chemical composition.

18 Claims, 4 Drawing Sheets

(51) Int. Cl.
*C23C 2/40* (2006.01)
*C23C 2/12* (2006.01)

(56) References Cited

U.S. PATENT DOCUMENTS

2004/0258949 A1* 12/2004 Honda ..... C23C 2/26 428/659
2006/0073355 A1* 4/2006 Honda ..... C22C 18/00 428/659
2009/0053555 A1* 2/2009 Nose ..... B32B 15/013 428/653
2011/0274945 A1 11/2011 Shimoda et al.
2014/0127531 A1 5/2014 Yasui et al.
2015/0072166 A1* 3/2015 Nakano ..... C23C 28/345 428/623
2015/0259776 A1* 9/2015 Shimizu ..... C23C 22/36 427/398.3
2018/0051366 A1 2/2018 Ooi et al.
2018/0087850 A1* 3/2018 Ueno ..... C23C 2/40

FOREIGN PATENT DOCUMENTS

EP 1 466 994 A1 10/2004
JP 10-306357 A 11/1998
JP 2000-64061 A 2/2000
JP 2002-332555 A 11/2002
JP 2004-68075 A 3/2004
JP 2005-230912 A 9/2005
JP 2006-35293 A 2/2006
JP 2006-193791 A 7/2006
JP 2007-313535 A 12/2007
JP 2009-215585 A 9/2009
JP 2009215585 A * 9/2009
JP 2015-214747 A 12/2015
WO WO 2007/108496 A1 9/2007
WO WO 2010/082678 A1 7/2010
WO WO 2013/002358 A1 1/2013
WO WO 2014/059474 A1 4/2014
WO WO 2016/140370 A1 9/2016

OTHER PUBLICATIONS

International Search Report for PCT/JP2018/002596 dated Apr. 3, 2018.
Kodama et al., "Touch-up Less Welding Wire for High Corrosion Resistance Galvanized Steel Plates", Shinnittetsu Sumikin giho, 2014, No. 398, pp. 79-82.
Written Opinion of the International Searching Authority for PCT/JP2018/002596 (PCT/ISA/237) dated Apr. 3, 2018.

* cited by examiner

[Fig. 1]
PRIOR ART
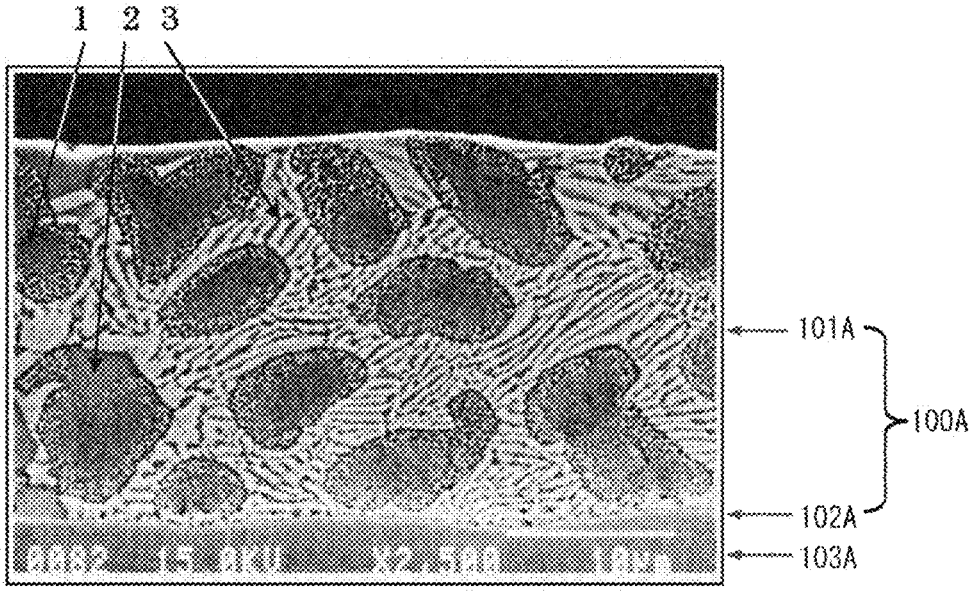
[Fig. 2]
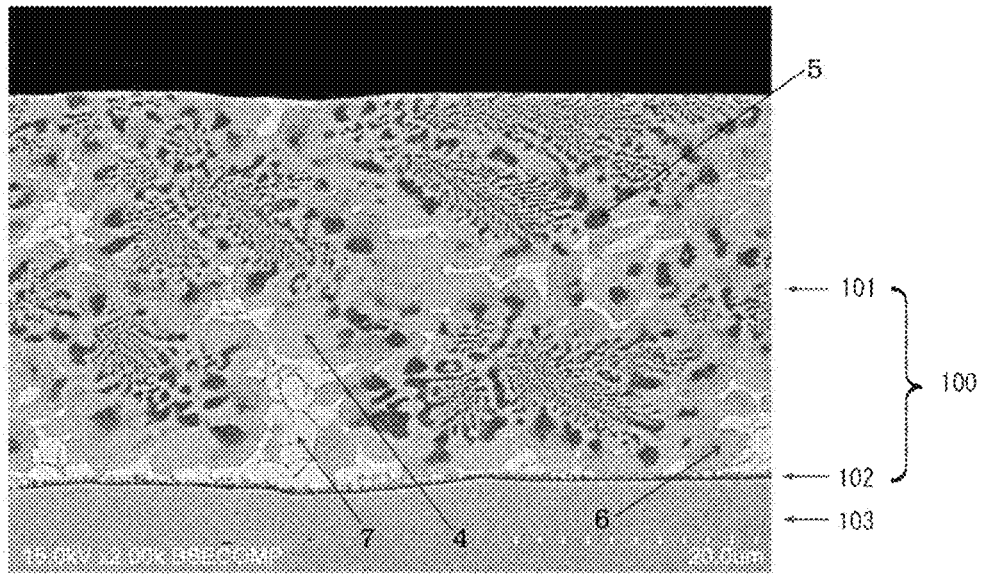

[Fig. 3]
PRIOR ART
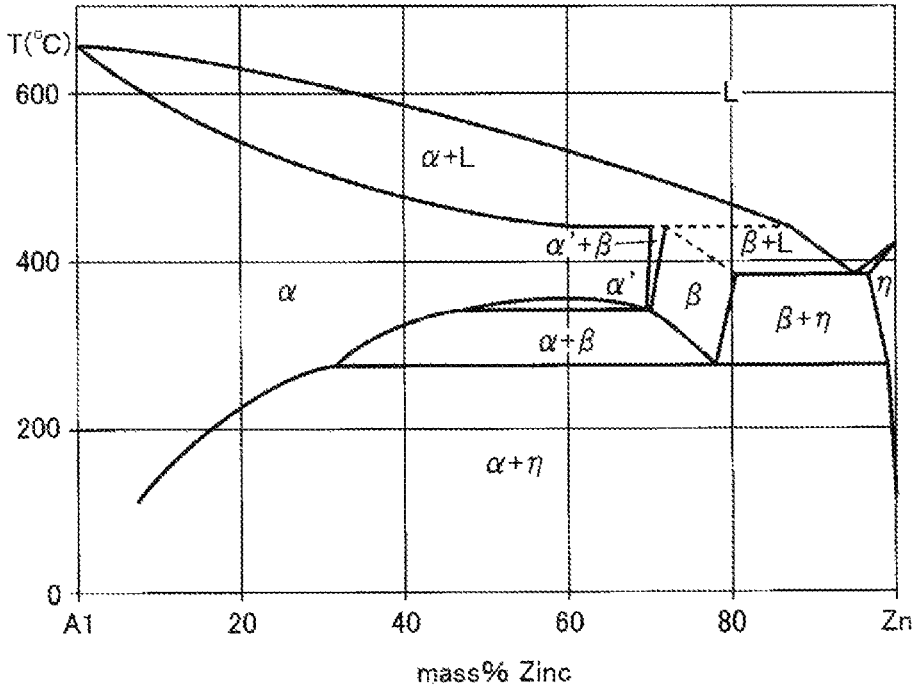
[Fig. 4]
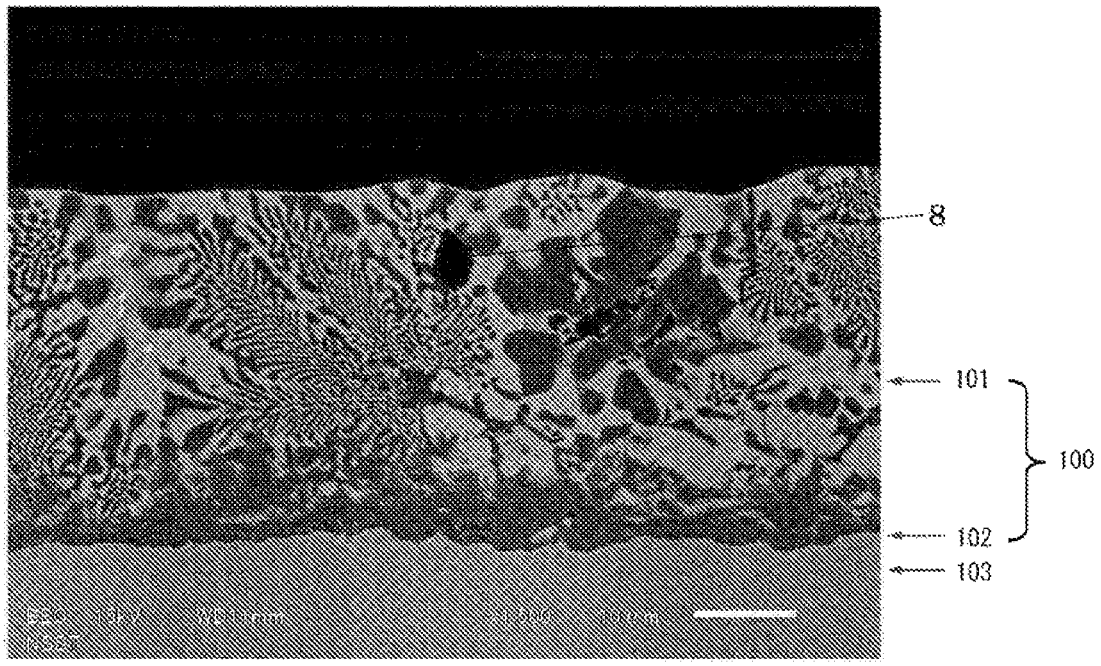

[Fig. 5]
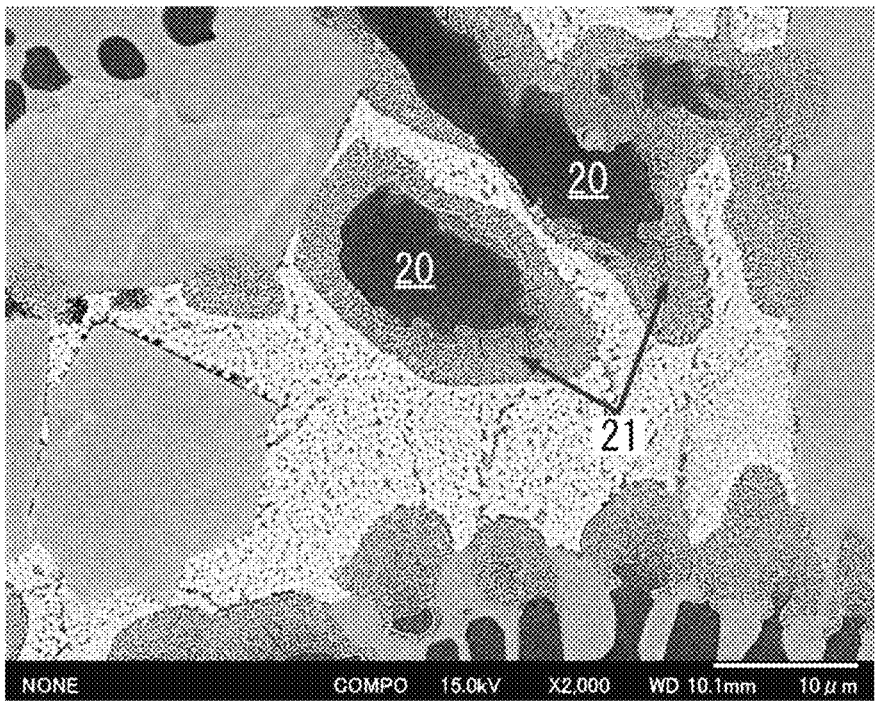
[Fig. 6]
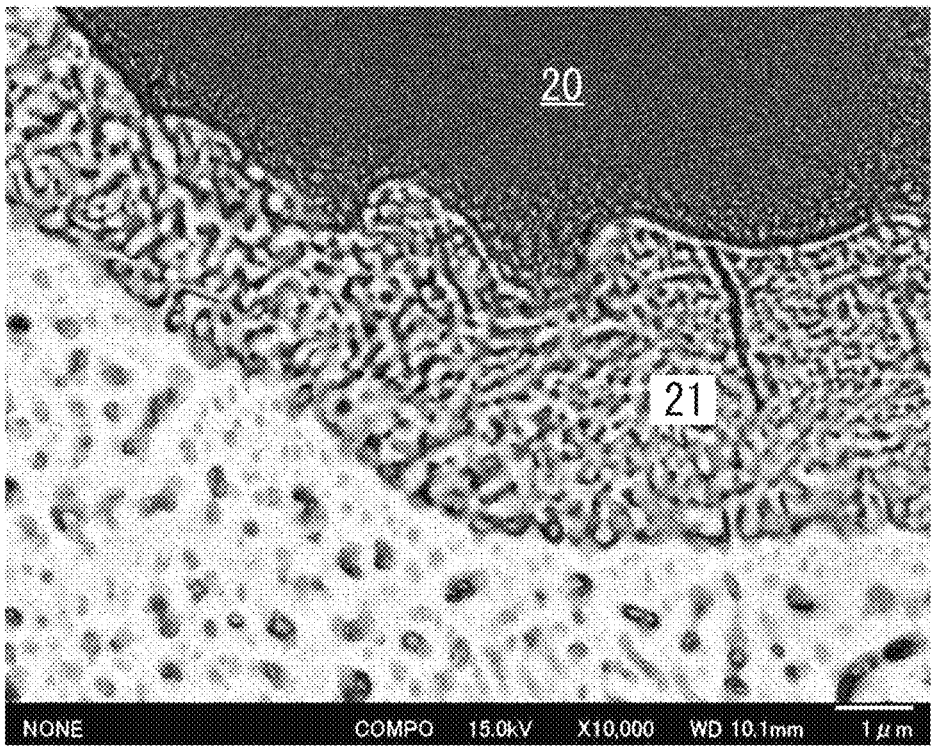

[Fig. 7]
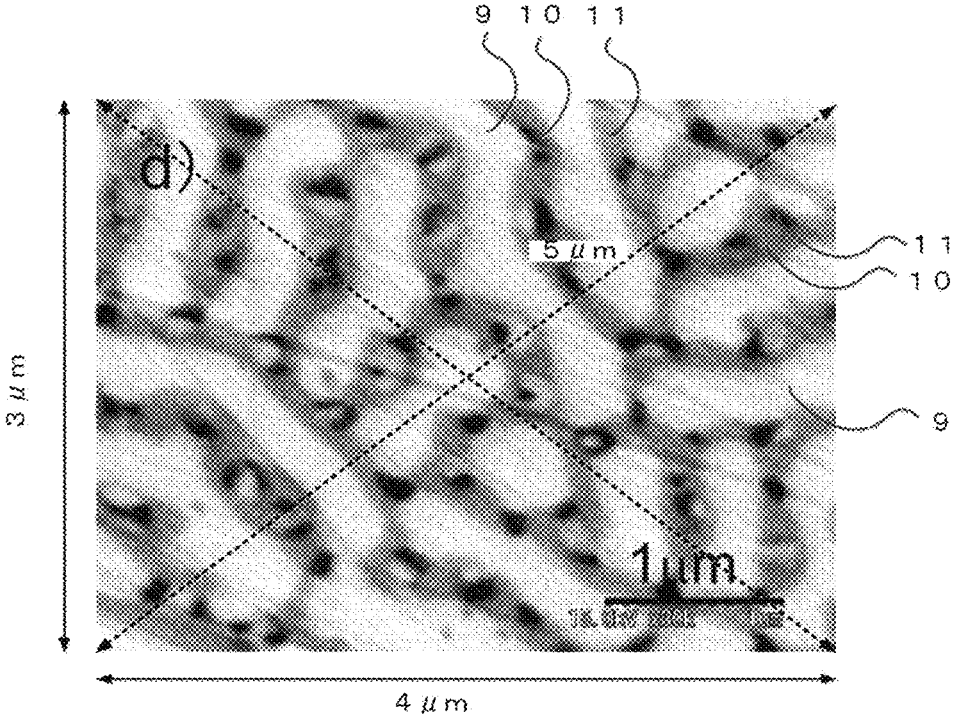

METALLIC COATED STEEL PRODUCT

TECHNICAL FIELD

The present disclosure relates to a metallic coated steel product.

BACKGROUND ART

Zinc-coated steel products are widely used in the fields of building construction, automobile production, and the like to improve the corrosion resistance of structural members. A method conventionally used to improve the corrosion resistance of civil engineering structures includes the steps of welding metallic uncoated steel products together and then dipping the resulting structure in a zinc bath to plate the steel products and the surface of area around a welded zone and to ensure corrosion resistance.

In this method, however, a welding process is followed by a plating process, which leads to poor productivity and requirements of equipment, such as plating bath, and has in turn caused an increase in production cost.

To avoid these problems, a method of welding zinc-coated steel products (for example, zinc-coated steel sheets), which have been prepared in advance by metaric coating steel products, has been increasingly applied to the production of structures.

Additionally, welded structural objects have recently been increasingly prepared by welding zinc alloy-coated steel products (for example, zinc alloy-coated steel sheets), the surfaces of which are coated with zinc alloy (such as Zn—Al—Mg—Si alloy or Al—Zn—Si alloy) with an even higher level of corrosion resistance than that of commonly used conventional zinc-coated steel products, to improve further the corrosion resistance of structural members (see, for example, Patent Documents 1 to 7).

Problems specifically associated with the preparation of welded structural objects by welding zinc-coated steel products or zinc alloy-coated steel products include liquid metal embrittlement (hereinafter also referred to as "LME") in the weld metal and in the heat affected zone of the base material that occurs due to hot-dip plating of the base material, decrease in bond strength due to blowhole formation by thermal evaporation of Zn, and deterioration of corrosion resistance at areas around and behind welded zones (the areas around and behind a welded zone are hereinafter also referred to as "welding heat affected zones") due to thermal evaporation of Zn.

For example, LME is considered to be mainly caused by a zinc plating component remaining in a molten form on the surface of the heat affected zone of the base material near a welded zone and infiltrated into grain boundaries in the welded zone. In addition, it is understood that LME is more pronounced in a plating layer containing metals such as Al and Mg.

To address these problems, for example, a method including applying or placing a solid flux on a prospective weld part and then performing a welding operation on the weld part for welding coated steel products with a plating of Zn—Al—Mg alloy (Patent Document 8) has been proposed.

Additionally, a method including using a flux-cored wire and converting elements such as Al and Mg into slag to make those elements harmless to the welding process (Patent Document 9) has been proposed.

Additionally, a method including using a stainless welding wire (Patent Document 10) has been proposed.

Additionally, metallic coated steel sheets with optimum weldability (Non-Patent Documents 1 and 2) have also been proposed as products to address those problems.

Patent Document 1: Japanese Patent Application Laid-Open No. 2000-064061
Patent Document 2: WO 2013/002358
Patent Document 3: Japanese Patent Application Laid-Open No. 2006-193791
Patent Document 4: Japanese Patent Application Laid-Open No. 2002-332555
Patent Document 5: WO 2010/082678
Patent Document 6: Japanese Patent Application Laid-Open No. 2015-214747
Patent Document 7: WO 2014/059474
Patent Document 8: Japanese Patent Application Laid-Open No. 2007-313535
Patent Document 9: Japanese Patent Application Laid-Open No. 2005-230912
Patent Document 10: Japanese Patent Application Laid-Open No. 2006-35293
Non-Patent Document 1: Nisshin Steel technical report, No. 92 (2011) pp. 39-47.
Non-Patent Document 2: Shinnittetsu Sumikin giho, No. 398 (2014) pp. 79-82.

SUMMARY OF INVENTION

Technical Problem

However, it is difficult to reduce all of LME, blowhole formation due to thermal evaporation of Zn, and deterioration of corrosion resistance in welding heat affected zones due to thermal evaporation of Zn, even if the above-described means are taken.

Thus, a problem solved by one aspect of the present disclosure is to provide a metallic coated steel product which is less likely to experience LME and blowhole formation and is likely to exhibit an improved corrosion resistance at welding heat affected zones.

Solution to Problem

Measures to solve the above-described problems include the following aspects.

<1>

A metallic coated steel product including a steel product and a plating layer that is provided on a surface of the steel product and comprises a Zn—Al—Mg alloy layer, wherein, in a cross-section of the Zn—Al—Mg alloy layer, an area fraction of $MgZn_2$ phase is from 45 to 75%, a total area fraction of $MgZn_2$ and Al phases is not less than 70%, and an area fraction of Zn—Al—$MgZn_2$ ternary eutectic structure is from 0 to 5%, and wherein the plating layer has a chemical composition consisting of, by mass:

Zn: from more than 44.90% to less than 79.90%;
Al: from more than 15% to less than 35%;
Mg: from more than 5% to less than 20%;
Ca: from 0.1% to less than 3.0%;
Si: from 0% to 1.0%;
B: from 0% to 0.5%;
Y: from 0% to 0.5%;
La: from 0% to 0.5%;
Ce: from 0% to 0.5%;
Cr: from 0% to 0.25%;
Ti: from 0% to 0.25%;
Ni: from 0% to 0.25%;

Co: from 0% to 0.25%;
V: from 0% to 0.25%;
Nb: from 0% to 0.25%;
Cu: from 0% to 0.25%;
Mn: from 0% to 0.25%;
Sr: from 0% to 0.5%;
Sb: from 0% to 0.5%;
Pb: from 0% to 0.5%;
Sn: from 0% to 20.00%;
Bi: from 0% to 2.0%;
In: from 0% to 2.0%;
Fe: from 0% to 5.0%; and
impurities, wherein, provided that an element group A consists of Y, La, and Ce, an element group B consists of Cr, Ti, Ni, Co, V, Nb, Cu, and Mn, an element group C consists of Sr, Sb, and Pb, and an element group D consists of Sn, Bi, and In:

a total content of elements selected from the element group A ranges from 0% to 0.5%;

a total content of Ca and elements selected from the element group A ranges from 0.1% to less than 3.0%;

a total content of elements selected from the element group B ranges from 0% to 0.25%;

a total content of elements selected from the element group C ranges from 0% to 0.5%; and a total content of elements selected from the element group D ranges from 0% to 20.00%.

<2>

The metallic coated steel product according to <1>, wherein the Zn—Al—Mg alloy layer contains at least one intermetallic compound phase selected from the group consisting of $Mg_2Si$ phase, $Ca_2Si$ phase, CaSi phase, Ca—Zn—Al intermetallic compound phase, and Ca—Zn—Al—Si intermetallic compound phase.

<3>

The metallic coated steel product according to <1> or <2>, wherein the contents of Al, Mg, Ca, and Si respectively range from more than 22% to less than 35%, from more than 10% to less than 20%, from 0.3% to less than 3.0%, and from 0.1% to 1.0%.

<4>

The metallic coated steel product according to <1> or <2>, wherein the content of the Al ranges from more than 15% to 22%.

<5>

The metallic coated steel product according to any one of <1> to <3>, wherein the content of B ranges from 0.05% to 0.5% by mass in a case in which the plating layer contains B;

the total content of elements selected from the element group A ranges from 0.05% to 0.5% by mass in a case in which the plating layer contains elements selected from the element group A;

the total content of elements selected from the element group B ranges from 0.05% to 0.25% by mass in a case in which the plating layer contains elements selected from the element group B; and the total content of elements selected from the element group C ranges from 0.05% to 0.5% by mass in a case in which the plating layer contains elements selected from the element group C.

<6>

The metallic coated steel product according to any one of <1> to <5>, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

<7>

The metallic coated steel product according to any one of <1> to <6>, wherein the total content of elements selected from the element group D ranges from 0.05% to 20% by mass in a case in which the plating layer contains elements selected from the element group D; and the Zn—Al—Mg alloy layer contains at least one intermetallic compound phase selected from the group consisting of $Mg_2Sn$ phase, $Mg_3Bi_2$ phase, and $Mg_3In$ phase.

<8>

The metallic coated steel product according to any one of <1> to <7>, wherein the plating layer contains an Al—Fe alloy layer between the steel product and the Zn—Al—Mg alloy layer.

Advantageous Effects of Invention

By the present disclosure, a metallic coated steel product which is less likely to experience LME and blowhole formation and is likely to exhibit an improved corrosion resistance at welding heat affected zones can be provided.

BRIEF DESCRIPTION OF DRAWINGS

FIG. 1 shows an SEM backscattered electron image illustrating a conventional Zn—Al—Mg plating layer (Zn: 11%; Al: 3%; Mg: 0.2%; Si).

FIG. 2 shows an SEM backscattered electron image illustrating one example of the plating layer of the present disclosure (the plating layer No. 18A in Example A).

FIG. 3 shows a Zn—Al phase diagram (expressed in % by mass).

FIG. 4 shows an SEM backscattered electron image illustrating another example of the plating layer of the present disclosure (the plating layer No. 8A in Example A).

FIG. 5 shows an SEM backscattered electron image of a cross-section of a plating layer used to explain a method of identifying Al phases (α and β-phases).

FIG. 6 shows an enlarged image of the SEM backscattered electron image of FIG. 5.

FIG. 7 shows an SEM backscattered electron image of a cross-section of a plating layer to explain methods of determining the Zn—Al—$MgZn_2$ ternary eutectic structure and measuring each area fraction.

DESCRIPTION OF EMBODIMENTS

Now, one example of the present disclosure will be described below.

In the present disclosure, the "%" representation of each element in a chemical composition to indicate the content refers to the content of the element in "% by mass."

Additionally, a numerical range defined by low and high values connected each other using the term "to" refers to a range of numbers including the numerical values before and after the "to" as the lower and upper limits, respectively.

Additionally, where the term "more than" or "less than" respectively precedes a lower or higher value of the numerical values connected each other using the term "to" to define a numerical range, the numerical range refers to any range of numbers within that range but excluding either or both of the numerical values as the lower or upper limit.

Additionally, the content of each element in a composition may be represented by the amount of the element (for example, the amount of Zn, Mg, or the like) or the concentration of the element (for example, the concentration of Zn, Mg, or the like).

Additionally, the term "step" is used not only to refer to independent steps but also to refer inclusively to any step which is not clearly distinguishable from other steps as long as the expected purpose of the step is achieved.

Additionally, the term "planar portion" refers to the entire portion of the surface of a steel sheet except for a welding heat affected zone of the steel product, and the term "area around a welded zone" refers to a heat affected zone of a steel product during a welding process, excluding the welded zone itself (welded metal portion), and the term "area behind a welded zone" refers to a portion of the back surface of a steel product opposite to a welded zone provided on the front surface of the steel product.

The metallic coated steel product of the present disclosure is a hot-dip metallic coated steel sheet including a steel product and a plating layer that is provided on a surface of the steel product and includes a Zn—Al—Mg alloy layer, wherein in a cross-section of the Zn—Al—Mg alloy layer the area fraction of $MgZn_2$ phase is from 45 to 75%, the total area fraction of $MgZn_2$ and Al phases is not less than 70%, and the area fraction of Zn—Al—$MgZn_2$ ternary eutectic structure is from 0 to 5%; and the plating layer has a predetermined chemical composition.

The metallic coated steel product of the present disclosure is a hot-dip metallic coated steel product which is less likely to experience LME and blowhole formation and is likely to exhibit an improved corrosion resistance at welding heat affected zones (areas around and behind welded zones) due to the above-described composition. The metallic coated steel product of the present disclosure has been invented by the following findings.

First of all, to increase the weldability and corrosion resistance of a metallic coated steel product, various welding measures and also improvement of the weld metal itself have mainly been examined in the past.

On the other hand, the inventors devoted great efforts to develop a plating layer having a structure which allows for optimum weldability under conditions of using a generic apparatus or a generic stainless wire as a welding measure or a weld metal, by defining the composition of the very plating layer in a metallic coated steel product. Until now, there has been little knowledge on the structure of a novel plating layer with optimum weldability, and weldability has been studied only in metallic coated steel products for use in commercial products.

Then, the inventors found the following points: for a hot-dip zinc alloy-coated steel product, careful selection of Al and Mg components in a plating layer and further texture control of a resulting alloy can increase the fractions of $MgZn_2$ and Al phases as well as reduce the fractions of Zn—Al—$MgZn_2$ ternary eutectic structure and Zn phase in the plating layer as much as possible, which in turn allows for reduction of LME even in such a plating layer containing metals such as Al and Mg, and additionally allows for reduction of the amount of evaporated Zn, leading to improved corrosion resistance at welding heat affected zones under reduction of blowhole formation.

Accordingly, the metallic coated steel product of the present disclosure has been found to be a hot-dip metallic coated steel product which is less likely to experience LME and blowhole formation and is likely to exhibit an improved corrosion resistance at welding heat affected zones.

Now, the metallic coated steel product of the present disclosure will be described in detail.

A steel product to be coated will be described.

The steel product is not limited to a particular shape, and examples of the steel product include molded steel products such as steel tubes, steel construction materials (steel culvert pipes, corrugate pipes, steel drainage covers, steel sand control screens, bolts, wire-mesh fences, steel traffic barriers, cut-off walls, etc.), home appliance parts and accessories (casings for the outdoor units of air conditioners, etc.), and automobile parts and accessories (parts and accessories for suspension systems, etc.), in addition to steel sheets. Various plastic deformation techniques such as, for example, pressing, roll forming, and bending techniques can be used for the molding.

The steel product is not limited to a particular material. Various steel products such as, for example, general steel products, nickel-precoated steel products, aluminium killed steel products, extra low carbon steel products, high carbon steel products, various types of high-tensile steel products, and parts of high alloy steel products (such as steel products enriched with alloying elements such as Ni and Cr) can be used for the steel product.

The steel product is produced without any particular limits in terms of steel production methods and conditions for steel sheet production methods (such as hot rolling method, acid pickling method, or cold rolling method) and the like.

The steel product may be a metallic precoated steel product which has been plated in advance.

Next, the plating layer will be described.

The plating layer includes a Zn—Al—Mg alloy layer. The plating layer may include an Al—Fe alloy layer in addition to the Zn—Al—Mg alloy layer. The Al—Fe alloy layer exists between the steel product and the Zn—Al—Mg alloy layer.

That is, the plating layer may have a single layer structure consisting of a Zn—Al—Mg alloy layer or may have a laminate structure consisting of a Zn—Al—Mg alloy layer and an Al—Fe alloy layer. In the case of having the laminate structure, the Zn—Al—Mg alloy layer should be a layer which constitutes the surface of the plating layer.

However, a film of oxides of elements as components of the plating layer is formed with a thickness of around 50 nm on the surface of the plating layer, but the thickness of the film is very thin relative to the entire thickness of the plating layer and the film is consequently not considered as the main constituent of the plating layer.

In this respect, the Zn—Al—Mg alloy layer should be, for example, from 2 μm to 95 μm (preferably from 5 μm to 75 μm) in thickness.

On the one hand, the entire thickness of the plating layer is, for example, not more than around 100 μm. The upper and lower limits of the entire thickness of the plating layer are not limited to particular values because the entire thickness of the plating layer varies depending on the plating conditions used. For example, the entire thickness of the plating layer is affected by the viscosity and specific gravity of the plating bath in conventional hot-dip plating methods. Furthermore, the plating thickness is adjusted by changing the withdrawal rate of a steel sheet (original metallic uncoated sheet) and the strength of wiping force. Thus, the lower limit of the entire thickness of the plating layer may be considered as around 2 μm.

On the other hand, the thickness of a coating layer that is potentially formed by a hot-dip coating method is approximately 95 μm, depending on specific gravity and homogeneity of a coating metal.

Since the thickness of a plating layer can be freely adjusted by changing the withdrawal rate from a plating bath and the wiping conditions, it is not particularly difficult to form a plating layer with a thickness of 2 to 95

Next, the Al—Fe alloy layer will be described.

The Al—Fe alloy layer is formed on a surface of the steel product (in particular, between the steel product and the Zn—Al—Mg alloy layer) and is a layer having a structure that contains an $Al_5Fe$ phase as a main phase. The Al—Fe alloy layer is formed by atomic diffusion between the ground steel (a steel product) and an aluminium material in a plating bath. In cases where a hot-dip plating method is used as a preparation method, a plating layer containing Al element is prone to conversion into an Al—Fe alloy layer. Because the concentration of Al contained in the plating bath is at or above a certain concentration, a phase of $Al_5Fe$ is most generated. However, the atomic diffusion requires much time and also causes the Fe concentration to increase at some areas near the ground steal. Thus, the Al—Fe alloy layer may partially contain small amounts of, for example, AlFe, $Al_3Fe$, and $Al_5Fe_2$ phases. Additionally, the Al—Fe alloy layer contains a small amount of Zn because the plating bath contains a certain concentration of Zn.

The level of corrosion resistance is not significantly different among the $Al_5Fe$, $Al_3Fe$, AlFe, and $Al_5Fe_2$ phases. The corrosion resistance as described herein refers to the corrosion resistance of the plating layer at areas not affected by welding. The Al—Fe alloy layer has a smaller than that of the plating layer and also has a lower corrosion resistance than that of the Zn—Al—Mg alloy layer, and the corrosion resistance of the whole plating layer is consequently not significantly varied even if the fractions of those phases are changed.

In cases where the plating layer contains Si, the Si may easily be incorporated particularly into the Al—Fe alloy layer to form phases of Al—Fe—Si compounds. AlFeSi phase is one of the identified compounds and isomers of the compound include, for example, α-, β-, q1-, and q2-AlFeSi phases. Thus, AlFeSi phases, such as those described above, may be detected in the Al—Fe alloy layer. An Al—Fe alloy layer containing, for example, those AlFeSi phases may also be called Al—Fe—Si alloy layer.

The Al—Fe—Si alloy layer likewise has a smaller thickness than that of the Zn—Al—Mg alloy layer and consequently has a smaller effect on the corrosion resistance of the whole plating layer.

Additionally, in cases where a various metallic precoated steel product is used as a base material for the metallic coated steel product, the structure of the Al—Fe alloy layer may vary depending on the thickness of the preplating layer. Specific examples of the varied structure include a structure where a layer of a pure metal(s) used for the preplating is left around the Al—Fe alloy layer, a structure where an alloy layer of intermetallic compound phases (such as, for example, $Al_3Ni$ phase) is formed by combination of components of the Zn—Al—Mg alloy layer and the preplating layer, a structure where an Al—Fe alloy layer with substitution of some of the Al and Fe atoms is formed, and a structure where an Al—Fe—Si alloy layer with substitution of some of the Al, Fe, and Si atoms is formed. In any structure, these alloy layers likewise have a smaller thickness than that of the Zn—Al—Mg alloy layer and consequently have a smaller effect on the corrosion resistance of the whole plating layer.

That is, the Al—Fe alloy layer includes alloy layers according to the above-described various aspects, in addition to the alloy layer containing an $Al_5Fe$ phase as a main phase.

The Al—Fe alloy layer is, for example, from 0 μm to 5 μm (typically, from 100 nm to 5 μm) in thickness.

That is, the Al—Fe alloy layer may not be formed. However, when a plating layer is formed with a preplating composition defined in the present disclosure by a hot-dip preplating method, an Al—Fe alloy layer having a thickness of not less than 100 nm is typically formed between the steel product and the Zn—Al—Mg alloy layer. The lower limit of the thickness of the Al—Fe alloy layer is not limited to a particular value, and it has been found that formation of a hot-dip plating layer containing Al is necessarily accompanied by formation of an Al—Fe alloy layer, and it has been empirically determined that the thickness of around 100 nm is considered as the thickness of an Al—Fe alloy layer formed under the most repressive conditions and as a thickness that ensures sufficient adhesion of the plating layer to the ground steel (a steel product). Unless special measures are adopted, it is difficult to prepare an Al—Fe alloy layer having a thickness of less than 100 nm by a hot-dip preplating method due to the high Al concentration. However, it is assumed that the properties of the plating layer are not significantly affected even if the Al—Fe alloy layer has a thickness of less than 100 nm or even no Al—Fe alloy layer is formed.

On the other hand, in cases where the thickness of the Al—Fe alloy layer is 5 μm or more, a Zn—Al—Mg alloy layer formed on the Al—Fe alloy layer tends to suffer from shortage of the Al component and, furthermore, extreme deterioration of the adhesiveness and processability of the resulting plating layer. Thus, the Al—Fe alloy layer is limited to not more than 5 μm in thickness.

Generally, welded structural objects are suitable forms of structures produced using the metallic coated steel product of the present disclosure and do not necessarily need to ensure the processability of the plating layer. Thus, the metallic coated steel product of the present disclosure can be a metallic coated steel product with better weldability than that of existing Zn—Al—Mg alloy-coated steel products and hot-dip Zn-coated steel products in limited applications.

However, once excellent processability is achieved in the plating layer, the metallic coated steel product can be formed into various shapes, such as circular or curved shapes, and the resulting metallic coated steel products can be used as welding materials. Thus, excellent processability is preferably achieved in the metallic coated steel sheet. The processability of the plating layer could be evaluated by pressing a metallic coated steel sheet with excellent preplating properties into a V-shape during the V-bending test under cold working conditions and quantifying the amount of formed powders on the bottom of the V trough.

Because the Al—Fe alloy layer often contains an $Al_5Fe$ phase as a main phase, a composition including Fe: 25 to 35%, Al: 65 to 75%, Zn: 5% or less, and impurities: balance can be indicated as the chemical composition of the Al—Fe alloy layer.

Typically, the thickness of the Zn—Al—Mg alloy layer is always larger than that of the Al—Fe alloy layer, and the Al—Fe alloy layer consequently contributes less to the corrosion resistance at the planar portion of a metallic coated steel sheet than the Zn—Al—Mg alloy layer. However, the Al—Fe alloy layer contains certain or higher concentrations of corrosion resistant elements, Al and Zn, as deduced from the component analysis result. Thus, the Al—Fe alloy layer has certain degrees of sacrificial corrosion protecting effect and corrosion barrier effect on the ground steel (a steel product).

In this respect, it is difficult to identify the sole contribution of the Al—Fe alloy layer with a thin thickness to the corrosion resistance by quantitative measurement. However, in cases, for example, where the Al—Fe alloy layer has a sufficient thickness, the Zn—Al—Mg alloy layer on the Al—Fe alloy layer can be ground and removed from the surface of the plating layer by, for example, end-milling process, and then subjected to a corrosion test to evaluate the corrosion resistance attributed to the Al—Fe alloy layer alone. Because the Al—Fe alloy layer contains the Al component and a small amount of the Zn component, the presence of an Al—Fe alloy layer causes formation of red rust specks, which is different from formation of a totally red rusted surface as seen in an metallic uncoated ground steel (a steel product) without an Al—Fe alloy layer.

Additionally, when a cross-section of the plating layer just before red rust formation on the ground steel (a steel product) in the corrosion test, it can be observed that the Al—Fe alloy layer remains intact and prevents the ground steel (a steel product) from corrosion even if dissolution and rusting of the upper Zn—Al—Mg alloy layer occurs. This is because the Al—Fe alloy layer is electrochemically nobler than the Zn—Al—Mg layer and less noble than the ground steel (a steel product). These can indicate that the Al—Fe alloy layer also has a certain level of corrosion resistance.

A thicker Al—Fe alloy layer is more favorable in terms of corrosion and has an effect to delay red rust formation. However, a large thickness of the Al—Fe alloy layer causes significant deterioration of preplating processability and, thus, the Al—Fe alloy layer is preferably at or below a certain thickness.

The metallic coated steel sheet of the present disclosure may be formed into various shapes before being formed into welded structural objects (i.e., before welding). Thus, the thickness of the Al—Fe alloy layer is still preferred to in at or below a certain thickness for the purpose of ensuring the processability. The optimum thickness is identified in terms of processability and the Al—Fe alloy layer is preferably not more than 5 μm in thickness, which reduces the amount of cracks or powders formed from the Al—Fe alloy layer in, for example, a V-bending test, and further preferably not more than 2 μm in thickness.

In comparison with the Zn—Al—Mg alloy layer, the Al—Fe alloy layer has a smaller thickness and a higher melting point, which allows Al contained as a main constituent substance to be protected from evaporation in arc welding and to be maintained, and thus is irrelevant to the amount of generated blowholes or LME. Additionally, the thickness of the Al—Fe alloy layer may be increased by incorporation of the Al component from the Zn—Al—Mg alloy layer at welding heat affected zones before and after welding. In particular, only the Al—Fe alloy layer may be found in areas where heat input from welding frequently occurs (such as the areas behind welded zones). In this case, the Al—Fe alloy layer may contain small amounts of constituent elements of the plating layer, such as Zn and Si, as well as contains Al, while maintaining the crystal structure of the Al—Fe intermetallic compound phase. In cases where the Zn—Al—Mg alloy layer remains there, spheroidization of the Al—Fe intermetallic compound phase may be observed in the Zn—Al—Mg alloy layer, with increase in the thickness of the Al—Fe alloy layer.

The Al—Fe alloy layer has a certain level of corrosion resistance, as described above, and the selection of a Zn—Al—Mg layer capable of leaving the Al—Fe alloy layer intact is therefore important to ensure the corrosion resistance at areas around welded zones. However, the Al—Fe alloy layer may be grown by heat input from welding and is not needed to have a large thickness in advance.

Next, the chemical composition of the plating layer will be described.

The composition of the Zn—Al—Mg alloy layer contained in the plating layer maintains nearly the same component proportions of the preplating bath. Because the reaction to form an Al—Fe alloy layer by a hot-dip preplating method occurs in a preplating bath, it is typical that reduction of the Al and Zn components in the Zn—Al—Mg alloy layer due to formation of an Al—Fe alloy layer hardly occurs.

The plating layer has the following chemical composition (in cases where the plating layer has a single layer structure consisting of a Zn—Al—Mg alloy layer, the chemical composition of the Zn—Al—Mg alloy layer; in cases where the plating layer has a laminate structure consisting of an Al—Fe alloy layer and a Zn—Al—Mg alloy layer, the total chemical composition of the Al—Fe alloy layer and the Zn—Al—Mg alloy layer) to prevent LME and blowhole formation and to improve the corrosion resistance at welding heat affected zones.

That is, plating layer should have a chemical composition consisting of, by mass, Zn: from more than 44.90% to less than 79.90%;
Al: from more than 15% to less than 35%;
Mg: from more than 5% to less than 20%;
Ca: from 0.1% to less than 3.0%;
Si: from 0% to 1.0%;
B: from 0% to 0.5%;
Y: from 0% to 0.5%;
La: from 0% to 0.5%;
Ce: from 0% to 0.5%;
Cr: from 0% to 0.25%;
Ti: from 0% to 0.25%;
Ni: from 0% to 0.25%;
Co: from 0% to 0.25%;
V: from 0% to 0.25%;
Nb: from 0% to 0.25%;
Cu: from 0% to 0.25%;
Mn: from 0% to 0.25%;
Sr: from 0% to 0.5%;
Sb: from 0% to 0.5%;
Pb: from 0% to 0.5%;
Sn: from 0% to 20.00%;
Bi: from 0% to 2.0%;
In: from 0% to 2.0%;
Fe: from 0% to 5.0%; and
impurities.

However, in the above chemical composition, an element group A consists of Y, La, and Ce, and an element group B consists of Cr, Ti, Ni, Co, V, Nb, Cu, and Mn, and an element group C consists of Sr, Sb, and Pb, and an element group D consists of Sn, Bi, and In, and the total content of elements selected from the element group A ranges from 0% to 0.5%;

the total content of Ca and elements selected from the element group A ranges from 0.1% to less than 3.0%;

the total content of elements selected from the element group B ranges from 0% to 0.25%;

the total content of elements selected from the element group C ranges from 0% to 0.5%; and the total content of elements selected from the element group D ranges from 0% to 20%.

In the chemical composition of the plating layer, Si, B, Y, La, Ce, Cr, Ti, Ni, Co, V, Nb, Cu, Mn, Sr, Sb, Pb, Sn, Bi, In, and Fe are optional components. That is, these elements may not be contained in the plating layer. In cases where these optional elements are contained, the content of each optional element preferably falls within the below-described range.

Each element in the plating layer will be described below.

<Zn: From More than 44.90% to Less than 79.90%>

Zn is an element required to form a main phase of the Zn—Al—Mg alloy layer and is required to be contained at or above a certain concentration for the purpose of ensuring the corrosion resistance at the planar portion and the corrosion resistance at welding heat affected zones (corrosion resistance after welding) of a metallic coated steel product. On the one hand, the concentration of Zn, that is the Zn phase in the Zn—Al—Mg alloy layer, is closely related to the incidence of LME and the amount of generated blowholes.

In cases where the Zn concentration is not more than 44.9%, it is difficult for the metallic coated steel sheet to maintain the corrosion resistance at areas around welded zones. plating-free regions are formed at welding heat affected zones (areas around and behind welded zones) as a result of evaporation of the plating layer by heat input from welding. Formation of such regions is preferably reduced as much as possible by preventing the evaporation of the plating layer. Examples of a method of preventing the evaporation of the plating layer include a method in which elements having a high sacrificial corrosion protecting ability and capable of converting the Zn phase into another less evaporative intermetallic compound phase are incorporated in advance into the plating layer (for example, a method of preventing corrosion at evaporated regions of the plating layer with elements with a high sacrificial corrosion protecting ability, such as Mg and Ca), a corrosion protection method in which corrosion resistant elements are incorporated into oxides formed during evaporation, a method in which an intermetallic compound phase with high corrosion resistance (for example, a phase generated by combination of the element Fe and any component of the plating layer) is generated by using heat input from welding, and the like. In cases where the Zn concentration is not more than 44.90%, sacrificial corrosion protection is hindered, which makes it difficult to prevent rust formation at areas around welded zones. Thus, the minimum Zn concentration should be above 44.90%. More preferably, the minimum Zn concentration is above 65.00%.

On the other hand, in cases where the Zn concentration is not less than 74.90%, the Zn phase is easily increased, which causes LME and blowhole formation to occur frequently and tends to deteriorate the weldability. However, even in cases where the Zn concentration is within the range from 74.90% to 79.90%, LME and blowhole formation can be reduced by achieving a state where Ca—Zn—Al and Ca—Zn—Al—Si intermetallic compound phases exist in the plating layer, as described below. Accordingly, the maximum Zn concentration should be blow 79.90%.

<Al: From More than 15% to Less than 35%>

Al is likewise an element required to form a main phase of the Zn—Al—Mg alloy layer and is required to be contained at or above a certain concentration for the purpose of ensuring the corrosion resistance at the planar portion and the corrosion resistance at welding heat affected zones (corrosion resistance after welding) of a metallic coated steel sheet. The presence of Al increases the Al phase and decreases the Zn phase in the Zn—Al—Mg alloy layer. Thus, an increase of the Al concentration tends to provide better weldability. The effects of Al is to prevent evaporation of the plating layer by heat input from welding and to improve the corrosion resistance at areas around welded zones by generation of an Al—Fe intermetallic compound phase (such as $Al_5Fe$, AlFe, $Al_2Fe$, or $Al_3Fe$ phase) with a component of the ground steel (a steel product). Particularly, in cases where the thickness of a steel product is small, Al should be contained in a plating layer to secure the corrosion resistance at areas behind welded zones where the plating layer is completely evaporated. Thus, the Al concentration should be above 20%. In cases where the Al concentration is not more than 20%, a large amount of the Al component is dissolved in the Fe phase of the ground steel by the aid of heat input from welding and the alloy layer of an Al—Fe intermetallic compound consequently becomes thinner at areas behind welded zones, so that the effect to improve the corrosion resistance at areas around welded zones may not be expected.

However, even in cases where the Al concentration is within the range of more than 15 to 20%, the effect to improve the corrosion resistance at areas behind welded zones can be secured even if the Al—Fe alloy layer becomes thinner, by achieving a state where Ca—Zn—Al intermetallic compound and Ca—Zn—Al—Si compound phases exist in the Zn—Al—Mg alloy layer, as described below.

Thus, the minimum Al concentration should be above 15%. Additionally, the below-described effect of containing Ca is also preferably used in combination to ensure better corrosion resistance than that of existing Zn—Al—Mg alloy-coated steel products at areas behind welded zones.

On the other hand, an increase of the Al concentration causes extreme deterioration of the corrosion resistance at areas around welded zones. Thus, the maximum Al concentration should be below 35%. In cases of placing importance on the corrosion resistance at areas around welded zones, the maximum Al concentration is further preferably below 30%.

<Mg: from more than 5% to less than 20%>

Mg is likewise an element required to form a main phase of the Zn—Al—Mg alloy layer and is required to be contained at or above a certain concentration for the purpose of ensuring the corrosion resistance at the planar portion and the corrosion resistance at welding heat affected zones (corrosion resistance after welding) of a metallic coated steel sheet. When Mg is contained in the plating layer, a similar effect to that caused by Zn is exhibited. Improvement of sacrificial corrosion protection due to the presence of Mg can be expected.

On the other hand, it is conventionally considered that LME is more pronounced by incorporation of Mg into the plating layer because magnesium is a metal with a low vapor pressure, similarly to Zn. Additionally, incorporation of Mg results in reduction of weldability, and various flux wires have been developed to address the reduction of weldability, as described above.

However, careful selection of the Mg concentration prevents LME from being intensified. Typically, LME is definitely intensified by the presence of Mg at a concentration within the range of 0 to 5%, but LME and also blowhole formation are more reduced by the presence of Mg at a concentration of more than 5% than that seen in normal Zn-coated steel products, leading to formation of a preferred form of plating layer. An Mg concentration within the range of 0 to 3% causes the melting point of the plating layer to decrease and a resulting liquid phase to become more stable, while an Mg concentration within the range of 3 to 5% causes the melting point of the plating layer to start increasing and, furthermore, an Mg concentration of more than 5% increases the rate of increase in the melting point, which hinders the generation of a liquid phase from the plating layer and, furthermore, evaporation of the plating layer. Accordingly, the fraction of $MgZn_2$ phase, which has better weldability than that of Zn phase, is increased by the presence of Mg at a concentration within the range of more than 5 to less than 20% and the weldability is consequently improved. That is, LME and blowhole formation are reduced.

In particular, an Mg concentration of more than 10% is preferred because the tendency of easily forming an oxide by the aid of heat input from welding is utilized to form a large amount of MgO at areas behind welded zones and to improve the corrosion resistance. However, an Mg concentration of not less than 20% causes an increase in the viscosity of the plating bath and hinders the formation of the plating layer, and also leads to compromised plating properties and easy separation of the plating layer. Accordingly, the maximum Mg concentration should be below 20%.

<Ca: From 0.1% to Less than 3.0%>

Ca contained in the plating layer leads to an increased dross generation with increase in the concentration of Mg during a plating operation and increases the plating productivity. Particularly when the concentration of Mg is high, the plating operation efficiency is generally poor; thus, the concentration of Ca is preferably modified to satisfy the expression: $0.15+\frac{1}{20}*Mg<Ca$ (however, the symbol for each element in the expression represents the content of the element in percent by mass) in cases where the Mg concentration is above 7%.

Additionally, the Ca contained in the plating layer generates an intermetallic compound phase with Al and Zn. In cases where Si is further contained in the plating layer together with Ca, the Ca generates an intermetallic compound phase with the Si. These intermetallic compound phases each have a stable structure with a high melting point and consequently have an effect to prevent thermal evaporation of Zn during welding, which is attributed to the presence of Ca. The effect of Ca appears at a concentration of not less than 0.1%, leading to reduction of LME and the amount of generated blowholes and also to increase in the amount of the plating layer remaining intact at areas around welded zones. In cases where Ca is not contained in the plating layer, extreme deterioration of weldability tends to occur. That is, the tendency of LME and blowhole formation is pronounced. Accordingly, the minimum Ca concentration should be not less than 0.1%.

Calcium oxide is formed during welding from each of the Ca-containing intermetallic compound phases because Ca is the most easily oxidized element of all the constituent elements of the plating layer. An oxide layer containing the calcium oxide remains on the Al—Fe alloy layer at areas behind welded zones while maintaining a sufficient level of adhesion, and improves the corrosion resistance at the areas behind welded zones. Typically, oxides and the like (trace of fumes) formed on a plating layer containing no Ca at areas behind welded zones will be removed from and hardly left on the Al—Fe alloy layer when wiped off with a rag or the like. However, in cases where calcium oxide is contained in the oxide layer, the oxide layer is not easily removed from but left on the Al—Fe alloy layer in a dense state. Additionally, the oxide layer containing calcium oxide is relatively insoluble in, for example, a neutral or basic aqueous solution.

An oxide layer remaining on the Al—Fe alloy layer after welding typically contains elements such as Zn and Mg, in addition to Ca, and sometimes further contains a small amount of Si. The oxide layer exists as a compound phase of those oxides. To obtain the effects of the remaining oxide layer, Ca—Zn—Al and Ca—Zn—Al—Si intermetallic compound phases should be formed in the Zn—Al—Mg alloy layer. For the generation of these intermetallic compound phases, Ca is required to be contained in the plating layer at a concentration of not less than 0.1%. The higher the Ca concentration is, the higher the concentration of calcium oxide contained in oxide layer is. Calcium oxide has an effect on the adhesion of an oxide layer but has only an insignificant effect on the corrosion resistance of the oxide layer.

Additionally, in cases where Si is contained in the plating layer together with Ca, a Ca—Zn—Al—Si intermetallic compound phase may be generated as a phase containing Si, in addition to the generation of a Ca—Zn—Al intermetallic compound phase, and the corrosion resistance tends to be improved. However, the presence of large amounts of Ca—Zn—Al and Ca—Zn—Al—Si intermetallic compound phases in the plating layer causes a tendency to deteriorate the corrosion resistance even at the planar portion as well as deteriorates the corrosion resistance at areas around welded zones. Additionally, the presence of such intermetallic compounds results in an increase of dross and deterioration of plating properties. Thus, the maximum Ca concentration should be below 3.0%.

Next, the optional elements in the chemical composition of the plating layer will be described. Adoption of the various elements into the plating layer can impart weldability and other features to the plating layer.

<Si: From 0.1% to 1.0%>

Si contained in the plating layer generates an intermetallic compound phase with Mg (for example, $Mg_2Si$ phase). Additionally, in cases where Ca is also contained, Ca—Si intermetallic compound phases ($Ca_2Si$ phase, CaSi phase, and the like) are also generated by the strong bonding strength between Si and Ca. However, in cases where Si is contained at a higher concentration than that of Ca, an $Mg_2Si$ phase is still generated. Additionally, an Mg—Al—Si intermetallic compound phase, though in small quantity, may be generated. In cases where Ca and Si are used in combination, Ca is preferably contained at a concentration equal to or above twice the Si concentration. The higher the Ca concentration is, the lower the content of the generated $Mg_2Si$ is.

Additionally, it is expected that a Ca—Zn—Al—Si intermetallic compound phase is generated in a plating layer containing large amounts of Al and Zn. However, the intermetallic compound is not specifically identified using conventional databases such as JCPDS and the details of the intermetallic compound are unknown. Si may be incorporated into a Ca—Zn—Al intermetallic compound such as $Al_2CaZn_2$, without forming a rigid crystal structure, to form an interstitial solid solution. The effect of the Ca—Zn—Al—Si intermetallic compound phase, namely the effect of combinational use of Ca and Si, is to improve the corrosion resistance at areas behind welded zones. These effects are hardly obtained from an $Mg_2Si$ phase or MgAlSi phase. Then, the minimum Si concentration is preferably not less than 0.1% in terms of obtaining this effect.

Increases of the $Mg_2Si$ phase, MgAlSi phase, and Ca—Zn—Al—Si intermetallic compound phase accompanied by the presence of Si in a plating bath are not desirable in terms of operation efficiency because of increase in the viscosity of the plating bath. Additionally, the interaction between Si and Ca atoms results in generation of a $Ca_2Si$, CaSi, or Ca—Zn—Al—Si intermetallic compound phase in a large amount. Consequently, improvement of the operation efficiency by the presence of Ca is not expected and excellent plating properties are thus hardly obtained. Accordingly, the maximum Si concentration should be not more than 1.0%.

<B: From 0.05% to 0.5%>

B contained in the plating layer has an effect to reduce LME. It is assumed that the B contained at a concentration of not less than 0.05% reacts with the elements Zn, Al, Mg, and Ca in the plating layer to generate various intermetallic compound phases. In particular, boron has a strong affinity for Ca, which causes a tendency to generate a Ca—Al—B intermetallic compound phase, such as $Al_2CaB_5$ phase (see FIG. 4). Then, the generated Ca—Al—B intermetallic compound phase is considered to have an effect to reduce LME. Accordingly, the minimum B concentration is preferably not less than 0.05%.

Peaks of intermetallic compounds resulting from the presence of B are observed at 31.0°, 33.5°, and 35.2° in x-ray diffraction patterns from the surface of the "plating layer" tested using a Cu target, though those peaks are not found in the existing intermetallic compound data (JCPDS). From the analysis result, an intermetallic compound of $CaAl_{(2\ to\ 4)}B_{(5\ to\ 7)}$ which contains B at a concentration of not less than 40% by atom has been identified as an example of the intermetallic compound. Additionally, from the signals of Zn and Mg detected at the same time in the EDS spectrum, the intermetallic compound is also considered as a Ca—Al—B intermetallic compound with substitution of some atoms by Zn and Mg (for example, a Ca—Al—B intermetallic compound in which some of the Ca and Al atoms are substituted by Mg and Zn atoms, respectively). It is also considered that the boron may exist as Zn, Ca-substituted products, such as $MgB_7$, $MgB_4$, $MgB_2$, $Al_2B_3$, $AlB_2$, $AlBl_2$, $(Al,Mg)B_2$, and $AlMgB_{14}$ phases, in addition to a Ca—Al—B intermetallic compound phase.

Additionally, the presence of B is considered to have an effect to reduce LME by diffusion of B from the plating layer to the ground steel and the resulting change in the sensitivity of the steel product to LME through grain boundary strengthening. Additionally, the presence of B is considered to have effects to reduce the conversion of the Zn phase into a liquid phase and the subsequent evaporation by the aid of the quite high melting point of the generated intermetallic compound, in addition to the above effect.

The presence of B in a plating bath leads to sharp increase in the melting point of the plating layer and to deterioration of the plating productivity, which in turn hinders the production of metallic coated steel products with excellent plating properties. Thus, the maximum B concentration should be not more than 0.5%.

<Element Group A (Y, La, Ce): From 0.05% to 0.5%>

Y, La, and Ce in the element group A are elements that play almost the same roles as that of Ca. This is due to those elements having atomic radii close to that of Ca. When any of those elements is contained in the plating layer, the element can replace the positions of Ca and be detected at the same position as that of Ca by EDS analysis. Even after these elements are oxidized to form oxides by welding, those oxides are detected at the same position at that of CaO. When those elements are contained at a concentration of not less than 0.05% in total, the corrosion resistance at areas behind welded zones is improved. This indicates that the corrosion resistance of those oxides is higher than that of CaO. Accordingly, the content of each element selected from the element group A is preferably not less than 0.05%. Furthermore, the total content of elements selected from the element group A is also preferably not less than 0.05%.

On the other hand, in cases where a plating layer containing any element of the element group A in an excessive amount is expected, an increase in the viscosity of the plating bath will occur. Thus, even preparation of a plating bath is often difficult when the total concentration of elements of the element group A is more than 0.5%, which hinders the production of metallic coated steel products with excellent plating properties. Accordingly, the content of each element selected from the element group A should be not more than 0.5%. Furthermore, the total content of elements selected from the element group A should also be not more than 0.5%.

The elements of the element group A have a main role as substituent elements for Ca and the total concentration of elements selected from the element group A is consequently required to be lower than the Ca concentration. Thus, the total content of Ca and elements selected from the element group A should be from 0.1% to less than 3.0%.

<Element Group B (Cr, Ti, Ni, Co, V, Nb, Cu, Mn): From 0.05% to 0.25%>

When elements of the element group B are contained in the plating layer at a content of not less than 0.05% in total, those elements are incorporated into the Al—Fe alloy layer during welding. The presence of the elements of the element group B in the Al—Fe alloy layer improves the corrosion resistance at areas behind welded zones. The incorporation of the elements of the element group B is considered to improve the insulation property of the Al—Fe alloy layer. Accordingly, the content Of each element selected from the element group B is preferably not less than 0.05%. Additionally, the total content of elements selected from the element group B is also preferably not less than 0.05%.

On the other hand, in cases where a plating layer containing any element of the element group B in an excessive amount is expected, generation of various intermetallic compound phases and an increase of viscosity will occur. Because of this problem, even preparation of a plating bath is often difficult when the content of elements of the element group B is individually or collectively more than 0.25%, which hinders the production of metallic coated steel sheets with excellent plating properties. Accordingly, the content of each element selected from the element group B should be not more than 0.25%. Furthermore, the total content of elements selected from the element group B should also be not more than 0.25%.

In cases where elements of the element groups A and B are used in combination, it is difficult to determine to which group of elements the effect to improve the corrosion resistance at areas behind welded zones is attributed.

<Element Group C (Sr, Sb, Pb): From 0.05% to 0.5%>

When elements of the element group C are contained in the plating layer at a content of not less than 0.05% in total, the appearance of the resulting plating layer is changed, in which formation of spangle and improved metallic luster appearance are observed. No change in weldability occurs. Accordingly, the content of each element selected from the element group C is preferably not less than 0.05%. The total content of elements selected from the element group C is also preferably not less than 0.05%.

On the other hand, in cases where a plating layer containing any element of the element group C in an amount of more than 0.5% is expected, dross generation in a plating bath will be increased. Thus, even preparation of a plating bath is often difficult, which hinders the production of metallic coated steel products with excellent plating properties. Accordingly, the content of each element selected from the element group C should be not more than 0.5%.

Furthermore, the total content of elements selected from the element group C should also be not more than 0.5%.

Cd is also naturally an element included in the element group C and may be detected as a trace impurity (at a content of less than 0.1%) in Zn and Pb, but it has not been confirmed whether the presence of this element in the plating layer has effects on spangle formation and the like.

<Element Group D (Sn, Bi, in): 0.05% to 20.00%; However, Bi: From 0.05% to 2.0%, in: From 0.05% to 2.0%>

When elements of the element group D are contained in the plating layer at a content of not less than 0.05% in total, new intermetallic compound phases such as $Mg_2Sn$, $Mg_3Bi_2$, and $Mg_3In$ phases are generated and detected in the plating layer detection. Any element of the element group D does not generate any intermetallic compound phase with either of the elements Zn and Al, which are main constituent elements of the plating layer, but generates any intermetallic compound phase only with Mg. Because those new intermetallic compound phases are generated, those are elements that lead to a great change in the weldability of the plating layer. Among those elements, Sn is a metal with a low melting point and can be contained without compromising the properties of a plating bath. When elements of the element group D are contained at a higher concentration, larger amounts of those intermetallic compound phases are generated.

First of all, any of the intermetallic compound phases has a high melting point and therefore remains as an intermetallic compound phase without being evaporated even after welding. Mg, which is originally prone to be oxidized to form MgO by welding heat, is not oxidized when it generates intermetallic compound phases with Sn, Bi, and In, and Mg in the resulting intermetallic compound phases is easily left in the plating layer. The presence of these elements increases corrosion resistance/sacrificial corrosion protection and improves the corrosion resistance at areas around welded zones. Although $MgZn_2$ is similarly an Mg-based compound, these intermetallic compounds have a better sacrificial corrosion protection effect.

Accordingly, the content of each element selected from the element group D is preferably not less than 0.05%. Additionally, the total content of elements selected from the element group D is also preferably not less than 0.05%.

On the other hand, any element of the element group D, mostly Sn, can be contained at a concentration of up to 20.00%. In cases where the Sn concentration is more than 20.00%, the fraction of $Mg_2Sn$ phase is increased and deterioration of corrosion resistance occurs sharply after welding. Additionally, the same occurs when the total content of Sn, Bi and In is more than 20.00%. This is because the Zn originally present in the form of $MgZn_2$ phase turns into a Zn phase with increase in $Mg_2Sn$, which enhances LME and blowhole formation. Accordingly, the content of Sn should be not more than 20.00%. Additionally, the total content of elements selected from the element group D should also be not more than 20.00%.

Additionally, a plating layer containing Bi or In in an excessive amount is brittle and is easily removed, leading to poor plating properties. Furthermore, deterioration of corrosion resistance occurs sharply after welding. Thus, the contents of Bi and In are each not more than 2.0%.

<Fe: From 0% to 5.0%>

Fe is incorporated into the plating layer as an impurity when the plating layer is formed. The thicker the Al—Fe alloy layer is, the higher the Fe concentration tends to be; the content of Fe may be up to around 5.0%. In cases where the plating layer is formed by a typical hot-dip plating method, the content of Fe is often less than 1%. In cases where a new plating bath is prepared, the concentration of Fe in the plating bath is gradually increased by application of an original metallic uncoated product (for example, an original metallic uncoated sheet). Accordingly, the gradual increase in the Fe concentration of the plating bath can be prevented by adding Fe to the plating bath in advance to a supersaturated concentration of around 0.5%.

<Impurities>

Impurities refer to components contained in raw materials or contaminated during the production process, wherein the components are not intended to be incorporated. For example, atomic diffusion between the steel product (the ground steel) and materials in the plating bath may result in the plating layer containing trace amounts of components other than Fe as impurities.

<Preferred Chemical Composition>

Preferably, in the chemical composition of the plating layer, the content of Al is from more than 22% to less than 35%, and the content of Mg is from more than 10% to less than 20%, and the content of Ca is from 0.3% to less than 3.0%, and the content of Si is from 0.1% to 1.0%. Additionally, the content of Ca is preferably equal to or above twice the content of Si. When the concentration of each of the elements Al, Mg, Ca and Si is within the corresponding range defined above, the above-described various intermetallic compound phases are easily generated and the effects to reduce LME and blowhole formation and to improve the corrosion resistance at welding heat affected zones are enhanced.

Additionally, the content of Al may be from more than 15% to 22%, or from more than 15% to 20%. A decreased Al concentration leads to improvement of corrosion resistance after plating.

Many of welded structural objects are coated after welding. In cases where welded zones are exposed to the outside, the areas around the welded zones are prone to red rust early, and any plating is thus preferably applied to ensure the corrosion resistance at the welded zones. When an area around a welded zone is coated by, for example, electrodeposition plating and the behavior of red rust formation starting from the welded zone is then observed, a correlation is observed between the Al concentration and the corrosion resistance after plating. In cases where a welded zone is coated, a sufficient level of corrosion resistance after plating is achieved at the welded zone even if the Al concentration is more than 22%. However, from the observation of the behavior of red rust formation starting from the area around the welded zone, the Al concentration is preferably not more than 22%, more preferably not more than 20%, in terms of preventing red rust formation from an area around a welded zone. This is assumed to be because the corrosion resistance after plating is affected by the adhesion of the metallic surface of the plating layer to a coating film and the surface preparation, which affects the adhesion to a coating film, is more effective on a plating layer having a lower Al concentration.

Next, the constituent phases of the Zn—Al—Mg alloy layer will be described.

The Zn—Al—Mg alloy layer is a layer mainly composed of two phases, namely $MgZn_2$ and Al phases. The Zn—Al—Mg alloy layer contains no or little Zn—Al—$MgZn_2$ ternary eutectic structure. The Zn—Al—Mg alloy layer may additionally contain a Zn phase, intermetallic compound phases, and the like.

Specifically, in a cross-section of the Zn—Al—Mg alloy layer, the area fraction of $MgZn_2$ phase is from 45 to 75%, the total area fraction of $MgZn_2$ and Al phases is not less than 70%, and the area fraction of Zn—Al—$MgZn_2$ ternary eutectic structure is from 0 to 5%. Furthermore, the area fraction of Zn phase is preferably less than 25%, more preferably less than 10%.

The reason for defining the area fraction of each phase will be described below.

First, the $MgZn_2$ phase will be described.

When an $MgZn_2$ phase is contained in the Zn—Al—Mg alloy layer, the corrosion resistance of the Zn—Al—Mg alloy layer is improved. The $MgZn_2$ phase is an intermetallic compound phase with an excellent insulation property and thus provides a higher corrosion resistance than that of the Zn phase. Additionally, because Mg is contained as a constituent element, the $MgZn_2$ phase has a lower corrosion potential than that of the Zn phase and exhibits an excellent sacrificial corrosion protecting ability, and is favorable as a phase that improves the corrosion resistance at areas around welded zones. Additionally, Mg dissolved during the course of corrosion has an effect to produce a corrosion product in a dense state, which has an effect to prevent red rust formation at a higher level than that of a corrosion product produced by the Zn phase alone but may lead to long-term maintenance of white rust.

For the weldability, the $MgZn_2$ phase plays an important role. Zn atoms are prone to evaporation in cases where those atoms are present as a Zn phase. However, Zn atoms are less prone to evaporation in cases where those atoms are present as an $MgZn_2$ phase. First of all, the $MgZn_2$ phase is evaporated at an area (such as an area behind a welded zone) at a temperature of above 1000° C. and forms large amounts of oxides, MgO and ZnO. These intermetallic compounds are deposited on the Al—Fe alloy layer at the area behind the welded zone through the oxide of Ca, CaO, to improve the corrosion resistance at the area behind the welded zone. Additionally, the $MgZn_2$ phase is melted at an area (such as an area around a welded zone) at a temperature of 1000° C. to 500° C. but can remain there without being evaporated.

Additionally, the $MgZn_2$ phase remaining after welding is an $MgZn_2$ phase originally existing in a massive form in the Zn—Al—Mg alloy layer. Conventionally, an $MgZn_2$ phase is in a Zn—Al—Mg alloy layer. However, the concentration of Mg is low in either case and the $MgZn_2$ phase present in the Zn—Al—Mg alloy layer exists as a Zn—Al—$MgZn_2$ ternary eutectic structure and the fraction of $MgZn_2$ phase in a massive form in an arbitrary sectional structure of the Zn—Al—Mg alloy layer is as small as less than 5% (see FIG. 1).

That is, the $MgZn_2$ phase remaining after welding is different from the fine $MgZn_2$ phase in the Zn—Al—$MgZn_2$ ternary eutectic structure precipitated by a eutectic reaction. In other words, the $MgZn_2$ phase remaining after welding (an $MgZn_2$ phase whose area fraction is defined in the present disclosure) is an $MgZn_2$ phase precipitated not in the form of Zn—Al—$MgZn_2$ ternary eutectic structure but as a single solid phase.

The Zn—Al—$MgZn_2$ ternary eutectic structure is easily evaporated during welding and is unable to leave elements such as Mg and Zn on areas around welded zones. On the other hand, an $MgZn_2$ phase in a massive form can be left on areas around welded zones.

An SEM backscattered electron image of a representative example of the plating layer of the present disclosure is shown in FIG. 2. As shown in FIG. 2, many massive grains of $MgZn_2$ phase are observed in the Zn—Al—Mg alloy layer, which are combined together to form coarse grains of $MgZn_2$ phase. In cases where an increased amount of the $MgZn_2$ phase remaining after welding is desired, it is more preferable that grains of $MgZn_2$ phase are combined together to form coarse grains.

The presence of an $MgZn_2$ phase in a massive form hinders the evaporation of Zn and decreases LME and the amount of generated blowholes. These effects are also related to the fraction of Zn phase and the details of the effects will be described below.

Accordingly, the area fraction of $MgZn_2$ phase should be from 45 to 75%, preferably from 55 to 75%, to reduce LME and blowhole formation.

Next, the Al phase will be described.

The Al phase includes an α-phase of Al (typical α-phase) in which Zn is dissolved at a concentration of around 0 to 3% and a β-phase of Al (typical β-phase) in which a Zn phase (η-phase) is contained at a concentration of from more than 70% to 85% and the Zn phase (η-phase) is dissociated from the typical α-phase to form fine microstructures (see FIG. 2 and FIGS. 5 and 6).

In this respect, the Zn—Al phase diagram is shown in FIG. 3. According to the phase diagram shown in FIG. 3, the Zn—Al phase is decomposed at 275° C. into the α-phase in which Zn is dissolved at a concentration of 10% and the η-phase (Zn phase) in which little Al is dissolved, by a eutectoid reaction under equilibrium conditions in the final solidification reaction.

However, a solidification process for a plating layer generally includes a fast cooling speed, which may cause a situation that does not follow the phase diagram to occur. For example, in the solidification process for a plating layer, the above-described eutectoid reaction does not completely take place and a thermostable Al phase containing Zn at a concentration of 0 to 85% often remains as a supersaturated solid solution of Zn.

Specifically, the β-phase observed a magnification of 10,000 times or higher indicates that it is composed of fine Al and Zn phases, as shown, for example, in FIG. 6. However, the properties of the α- and β-phases, such as corrosion resistance and sacrificial corrosion protection, are generally indicative of those of the Al phase and are different from those of the Zn phase. Thus, the Al phase of the present disclosure also includes the β-phase.

For example, in the region indicated by the numerical sign 21 (β-phase) in FIG. 6, areas colored by white and by black correspond to the Zn and Al phases, respectively.

Additionally, in cases where a plating layer is formed by rapid cooling, for example, using water or the like, a supersaturated solid solution of Zn in an Al phase (an Al phase containing the same components as those of the typical α- and β-phases but in different concentrations) may be generated. The typical α- and β-phases are mostly generated unless rapid cooling is provided.

The supersaturated solid solution of Zn in an Al phase is a phase that is not eventually present under normal slow cooling conditions (under which the α-phase and the η-phase are generated) and refers to the α- and β-phases with distorted compositions.

Specifically, a supersaturated solid solution of Zn in an a phase is different from the typical α-phase of Al and is an Al phase in which Zn is dissolved at a concentration of from more than 3% to 70% to supersaturation levels. The α-Al—Zn supersaturated solid solution is brittle and causes deterioration of processability.

A supersaturated solid solution of Zn in a β phase is an Al phase which contains a Zn phase (η-phase) at a concentration of from more than 70% to 85% and has fine microstructures formed by dissociation between the Zn phase (η-phase) and an α-phase in which Zn is dissolved at a concentration of more than from 3% to 70% to supersaturation levels (a supersaturated solid solution of α-Al—Zn). The β-phase in the β-Al—Zn supersaturated solid solution also contains a supersaturated solid solution of α-Al—Zn and is consequently brittle and causes deterioration of processability.

As seen above, the supersaturated solid solution of Zn in an Al phase is an Al phase containing the same components as those of the typical α- and β-phases but in different concentrations and causes deterioration of processability, and is thus not included in the Al phase of the present disclosure.

In this respect, a method of determining the identities of Al phases (α- and β-phases) is as follow.

To determine the identities of Al phases (α- and β-phases), an SEM backscattered electron image of a cross-section of a plating layer (a cut surface of the plating layer cut in the thickness direction) is first captured (see FIGS. 5 and 6).

For the measurement of the area fractions of Al phases (α- and β-phases) in a cross-section of the Zn—Al—Mg alloy layer, the same SEM backscattered electron image of a cross-section of the plating layer (a cut surface of the plating layer cut in the thickness direction) for the measurement of the area fraction of each phase is used.

However, FIGS. 5 and 6 show SEM backscattered electron images of a tilt surface (at an angle of 4°) of a plating layer prepared by cutting the plating layer in the thickness direction and obliquely polishing the cut surface at an angle of 4° from the cut surface, for illustrative purposes.

Next, the α-phase is identified in the captured SEM backscattered electron image (see FIG. 5) by EDS analysis or the like. In the solidification process of a hot-dip plating layer, each phase is precipitated in such a manner that a core α-phase is surrounded by a β-phase. This is because the solidification of the plating layer starts with crystallization of the Al phase and Zn is then transferred from the resulting Al phase which cannot contain Zn anymore because of reduction in solid solubility due to the solidification to the surrounding Al phase.

Specifically, when the quantitative component analysis is performed on a certain area (for example 1 μm×1 μm) of an Al phase in an SEM backscattered electron image at a magnification of around 1,000 times (see FIG. 5), an Al phase in which Zn is dissolved at a concentration of 0 to 3% is identified as a α-phase (typical α-phase). If a phase surrounding the α-phase (typical α-phase) is an Al phase dissociated into the typical α-phase and the Zn phase (η-phase) to form fine microstructures, the phase is identified as a β-phase (typical β-phase).

An Al phase in which Zn is dissolved at a concentration of from more than 3% to 70% to supersaturation levels is identified as a supersaturated solid solution of α-Al—Zn. Additionally, an Al phase in which a supersaturated solid solution of α-Al—Zn is dissociated from a Zn phase (η-phase) to form fine microstructures is identified as a supersaturated solid solution of β-Al—Zn.

In the present disclosure, Zn is an element found in the largest amount in the plating layer, and the content of Al is restricted to from more than 15% to less than 35%. Thus, differing from Al phases in commonly used Al-coated and Al—Zn-coated steel sheets (so-called Galvalume steel sheet (registered brand name) with a content of Al of mainly 55%), the Al phase in the present disclosure is not a main component and does not form a 3-dimensional network structure in the Zn—Al—Mg alloy layer; it is often that the content of $MgZn_2$ phase is the largest and the content of Al phase is the second largest in the structural organization. Instead, a peritectic structure composed of an Al phase core surrounded by an $MgZn_2$ phase is predominant in the Zn—Al—Mg alloy layer and forms a 3-dimensional network structure. This is related to the combination ratio in concentration of Al and Mg in the plating layer.

In general, if the ratio in concentration of Mg/Al is less than 1/10, the occupancy of Al phase in the Zn—Al—Mg alloy layer is increased relative to that of $MgZn_2$ phase. On the other hand, if the ratio in concentration of Mg/Al is 1/10 or more, the occupancy of $MgZn_2$ phase is increased, leading to failure in preparation of a Zn—Al—Mg alloy layer containing an Al phase as a main component. Thus, the corrosion resistance, sacrificial corrosion protection, and other properties at, for example, a planar portion but not at welded zones are close to those of Zn-coated steel sheets, rather than those of Al-coated and Al—Zn-coated steel sheets.

Once exposed heat at a temperature of 500° C. or higher inputted from welding, Al phases (α- and β-phase) react with Fe of a ground steel (a steel product) and form an Al—Fe alloy layer of an Al—Fe intermetallic compound phase in a spherical or massive form. For example, AlFe, $Al_2Fe$, $Al_3Fe$, $Al_{3.2}Fe$, and $Al_5Fe_2$ phases are composed of almost the same constituent substances as those of the above-described Al—Fe alloy layer and form intermetallic compound phases in which some of Al atoms are replaced by Zn dissolved in the Al phases. Additionally, as described above, the Al—Fe alloy layer and Al—Fe intermetallic compound phase each have a certain level of corrosion resistance for the ground steel (a steel product). Particularly at areas behind welded zones, most Zn and Mg are evaporated or oxidized to form oxides, but Al forms an Al—Fe alloy layer, which improves the corrosion resistance at areas behind welded zones. At, for example, areas around welded zones, generation of an Al—Fe intermetallic compound phase is not enough to form a layer, and the intermetallic compound phase often exhibits a spherical or massive form. The Al—Fe alloy layer and Al—Fe intermetallic compound phase are less effective on corrosion resistance than the Zn—Al—Mg alloy layer but make a certain level of contribution to corrosion resistance.

Accordingly, in terms of improving the corrosion resistance at welding heat affected zones, the total area fraction of $MgZn_2$ and Al phases should be not less than 70%, preferably not less than 80%, more preferably not less than 90%, and most preferably not less than 95%. The maximum total area fraction of $MgZn_2$ and Al phases is preferably not more than 98%, more preferably not more than 100%.

The presence of $MgZn_2$ and Al phases at this area fraction in total promotes survival of the Zn—Al—Mg alloy layer at welding heat affected zones with a temperature of 500 to 1000° C., whereby a clear improving effect on the corrosion resistance at areas around welded zones can be observed. In cases where the total area fraction is less than 70%, a majority of the Zn—Al—Mg alloy layer is evaporated, leading to a poor corrosion resistance at areas around welded zones.

Next, the Zn—Al—$MgZn_2$ ternary eutectic structure will be described.

The ternary eutectic structure contains Al, Zn, and MgZn phases. The morphology of each phase is variable because the size of each phase varies depending on the composition. However, because atomic diffusion during solidification is reduced in the transformation of a eutectic structure at a constant temperature, an intricate network composed of those phases is formed, in which each phase is typically precipitated to form fine microstructures (see FIG. 7).

Typically, Zn phases are largest and have islet-like shapes, and MgZn phase are second largest and fill gaps between Zn phases, and Al phases are often distributed in a spot-like pattern in $MgZn_2$ phases. The phases that constitute the structure are not changed but a phase that appears in an islet shape may be an $MgZn_2$ phase, Al phase, or $MgZn_2$ phase depending on the composition, indicating the dependence of the positional relationship on the change in the composition just before solidification.

A method of determining the identity of a ternary eutectic structure will be described below.

The presence of such a ternary eutectic structure composed of fine phases promotes evaporation of Zn during welding and increase LME and the amount of generated blowholes.

Accordingly, the area fraction of Zn—Al—$MgZn_2$ ternary eutectic structure should be from 0 to 5%, preferably from 0 to 2%. The area fraction of the ternary eutectic structure is most preferably 0%.

Next, the Zn phase will be described.

A small amount of Zn phase may be present in the Zn—Al—Mg alloy layer (see FIG. 2). The presence of a Zn phase in the Zn—Al—Mg alloy layer is favorable in terms of corrosion resistance and sacrificial corrosion protection but undesirably causes LME and blowhole formation during welding. Additionally, corrosion resistance cannot be expected at welding heat affected zones because a Zn phase is easily evaporated. Thus, the content of Zn phase should also be controlled. In cases where the concentration of Zn is high, a Zn phase is easily generated; however, in cases where the area fraction of Zn phase in the Zn—Al—Mg alloy layer is not less than 10%, LME and the amount of generated blowholes are increased.

However, even in cases where the area fraction of Zn phase is not less than 10%, LME and blowhole formation can be reduced by achieving a state where Ca—Zn—Al and Ca—Zn—Al—Si intermetallic compound phases exist in the Zn—Al—Mg alloy layer, as described below.

Accordingly, the area fraction of Zn phase may be less than 25%.

However, a tendency to see a small amount of Zn phase as favorable is not changed in terms of weldability.

Thus, the area fraction of Zn phase should be preferably less than 10%, more preferably not more than 5%, and further preferably not more than 3%. However, the area fraction of Zn phase is ideally 0% and may be not less than 2% in terms of manufacture.

The final solidification portion in the plating layer (420 to 380° C.) is often the Zn phase, but precipitation of a single Zn phase can be inhibited as much as possible by applying any component adjustment, element addition, and even solidification method for Zn phase reduction.

Next, the intermetallic compound phases will be described.

The presence of Ca in the plating layer may cause generation of a Ca—Zn—Al intermetallic compound phase in the Zn—Al—Mg alloy layer. This is due to the intrinsic nature of Ca to promote the generation of intermetallic compound phases with Al and Zn (such as $CaZn_2$, $CaZn_5$, $CaZn_{11}$, and $Al_4Ca$ phases). In cases where the concentration of Ca is high, an intermetallic compound phase in which the Ca is linked to those elements is not allocated to only one of these intermetallic compound phases because Ca is very prone to segregation. The Ca—Zn—Al intermetallic compound phase is oxidized to form CaO at areas behind welded zones during welding and forms an oxide layer with excellent adhesiveness on the Al—Fe alloy layer. The formation of the oxide layer improves the corrosion resistance at the areas behind the welded zones.

In this respect, the amount and size of the Ca—Zn—Al intermetallic compound phase depend on the weldability and the corrosion resistance at welding heat affected zones. In cases where the sizes of grains are large in the Ca—Zn—Al intermetallic compound phase, the intermetallic compound phase easily forms an oxide layer of CaO with excellent adhesiveness at areas behind welded zones. That is, the effect to improve the corrosion resistance at areas behind welded zones is enhanced. Additionally, in cases where the sizes of grains are large in the Ca—Zn—Al intermetallic compound phase, the ratio of Zn linking to the Ca—Zn—Al intermetallic compound phase tends to increase, which prevents evaporation of the Zn phase and also improves the effect to reduce LME and blowhole formation.

If any treatment is applied to a plating layer originally having a low content of Zn phase to form coarse grains of a Ca—Zn—Al intermetallic compound phase, a tendency that the effect to reduce LME and blowhole formation is difficult to detect is observed.

The Ca—Zn—Al intermetallic compound phase may typically have various shapes (such as cubic, needle-like, rod-like, and indefinite shapes) in the Zn—Al—Mg alloy layer. When a Ca—Zn—Al intermetallic compound phase is formed in a "cubic, needle-like, or rod-like shape," the length of the longest line (such as diagonal line) is determined as the grain size of the Ca—Zn—Al intermetallic compound phase. When a Ca—Zn—Al intermetallic compound phase is formed in an "indefinite shape excluding cubic, needle-like, and rod-like shapes," the diameter of the corresponding circle with an equivalent area is determined as the grain size of the Ca—Zn—Al intermetallic compound phase. When the mean grain size of the Ca—Zn—Al intermetallic compound phase is 1 μm or longer, the plating layer is changed in the properties. Although all the detected Ca—Zn—Al intermetallic compound phases have a grain size of not less than 1 μm, the effect to improve the corrosion resistance at areas behind welded zones tends to be reduced when no Ca—Zn—Al intermetallic compound phase having a grain size of not less than 1 μm is detected. Additionally, the effect to reduce LME and blowhole formation tends to be reduced.

That is, the presence of a Ca—Zn—Al intermetallic compound phase having a mean grain size of not less than 1 μm in the Zn—Al—Mg alloy layer enhances the effects to improve the corrosion resistance at areas behind welded zones and to reduce LME and blowhole formation. The maximum mean grain size of the Ca—Zn—Al intermetallic compound phase is not limited to a particular value but is, for example, not more than 100 μm.

The Ca—Zn—Al intermetallic compound phase is an intermetallic compound phase having a very high melting point and grains of the intermetallic compound phase are generated just after the solidification of the plating layer and exist countlessly in the Zn—Al—Mg alloy layer. Additionally, in cases where any liquid phase is present in the Zn—Al—Mg alloy layer during the solidification of the plating layer, the liquid phase combines adjacent Ca—Zn—Al intermetallic compound phases, which reduces the number of fine precipitated Ca—Zn—Al intermetallic compound phases and promotes growth of Ca—Zn—Al intermetallic compound phases. When a typical plating method or a rapid cooling technique is used in the solidification process for a plating layer, Ca—Zn—Al intermetallic compound phase grains having fine grain sizes (less than 1 μm) are countlessly present. On the other hand, slow cooling under conditions where a liquid phase is present (up to a melting point of about 350° C.) results in an reduction in the number of Ca—Zn—Al intermetallic compound phase grains and an increase in the grain size, leading to precipitation of Ca—Zn—Al intermetallic compound phase grains having fine grain sizes of not less than 1 μm in the Zn—Al—Mg alloy layer. The size of a Ca—Zn—Al intermetallic compound phase grain are easily increased when the concentrations of Ca and Al are high, and can be increased by slow cooling even in cases where those concentrations are low.

Additionally, the presence of a high concentration of Si in the plating layer may result in generation of an $Mg_2Si$ phase in the Zn—Al—Mg alloy layer. In cases where the concentration of Ca is high, $Ca_2Si$, CaSi, and Ca—Zn—Al—Si intermetallic compound phases may be contained. When these compound phases are present in the Zn—Al—Mg alloy layer, the effect to improve the corrosion resistance at welding heat affected zones is enhanced.

In particular, the Ca—Zn—Al—Si intermetallic compound phase has similar effects to those of the Ca—Zn—Al intermetallic compound phase (the effects to improve the corrosion resistance at areas behind welded zones and to reduce LME and blowhole formation). In addition, the presence of a Ca—Zn—Al—Si intermetallic compound phase results in the presence of Si in an oxide layer remaining on the Al—Fe alloy layer after welding, which enhances the effect to improve the corrosion resistance at areas behind welded zones.

Particularly, in cases where Ca—Zn—Al—Si intermetallic compound phase grains having a mean grain size of not less than 1 μm (or 1 to 100 μm) are present in the Zn—Al—Mg alloy layer, the effects to improve the corrosion resistance at areas behind welded zones and to reduce LME and blowhole formation are enhanced, similarly to the case of the Ca—Zn—Al—Si intermetallic compound phase.

Accordingly, the Zn—Al—Mg alloy layer preferably contains at least one intermetallic compound phase selected from the group consisting of $Mg_2Si$ phase, $Ca_2Si$ phase, CaSi phase, Ca—Zn—Al intermetallic compound phase, and Ca—Zn—Al—Si intermetallic compound phase.

Additionally, the presence of B in the plating layer may result in generation of a Ca—Al—B intermetallic compound phase in the Zn—Al—Mg alloy layer, wherein the Ca—Al—B intermetallic compound phase is selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

The presence of this Ca—Al—B intermetallic compound phase in the Zn—Al—Mg alloy layer is favorable because LME is reduced.

Additionally, the presence of elements selected from the element group D in the plating layer (specifically, the presence of elements selected from the element group D at a content of 0.05% to 20% in total) may result in generation of at least one intermetallic compound phase selected from the group consisting of $Mg_2Sn$, $Mg_3Bi_2$, and $Mg_3In$ phases in the Zn—Al—Mg alloy layer.

The presence of this an intermetallic compound phase in the Zn—Al—Mg alloy layer improves the corrosion resistance at areas around welded zones.

In the metallic coated steel product of the present disclosure, the hardness of the plating layer is included in other properties of the plating layer. As described above, $MgZn_2$ phase contained much in the Zn—Al—Mg alloy layer is a hard intermetallic compound and other intermetallic compounds formed with added elements are also generally hard, which results in the plating layer exhibiting a hardness of not less than 150 Hv.

Next, one example method of producing the metallic coated steel product of the present disclosure will be described.

The metallic coated steel product of the present disclosure is obtained by forming the plating layer on the surface (one or both surfaces) of a steel product (an original metallic uncoated product such as an original metallic uncoated sheet) by a hot-dip plating method.

Pure metals or alloys of a predetermined composition prepared using, for example, a vacuum melting furnace are used and combined in predetermined amounts and dissolved under atmospheric conditions to prepare a plating bath with a composition of interest. Typically, an operation temperature equal to or above the melting point of the metals is required for hot-dip plating.

For the production of metallic coated steel products, steel products rolled by, for example, Sendzimir mill and reduced with hydrogen under non-oxidation conditions at 800° C. are directly immersed in the plating bath. Immersion time affects the thickness of the Al—Fe alloy layer in the plating layer, and an immersion time of 0.5 seconds is typically enough. The amount of deposit is adjusted by $N_2$ gas blow after the immersion process.

In the production method for the metallic coated steel product of the present disclosure, temperature control in a plating bath and in a solidification process is essential for texture control. In cases where the temperature control is not performed, precipitation of a Zn phase cannot be reduced.

In cases where the composition of the present disclosure is adopted as the chemical composition of a plating layer, a metallic coated steel product produced, for example, with incubation at a plating bath temperature (the melting point of a plating bath+20° C.) of 420° C. or higher for a retention time of not more than 5 seconds after the plating process (after withdrawal of the steel product from the plating bath) increases the amount of Zn phase remaining in the Zn—Al—Mg alloy layer, which causes the final solidification portion in the Zn—Al—Mg alloy layer to be the Zn—Al—$MgZn_2$ ternary eutectic structure and tends to decrease the amounts of Al and $MgZn_2$ phases, leading to a plating layer with poor weldability.

Also in cases where: 1) a plating is fixed at the top roll, 2) rapid cooling using a mist cooling system is applied to prevent failure in spangle formation during the course of solidification of the plating layer, or 3) cooling at a cooling rate of 30° C./sec or higher is applied to decrease the temperature from the plating bath temperature (the melting point of a plating bath+20° C.) or the melting point of the plating bath to 150° C. after the plating process, a supersaturated solid solution of Zn in an Al phase (an Al phase containing the same components as those of the typical α- and β-phases but in different concentrations) is formed in the Zn—Al—Mg alloy layer and the $MgZn_2$ phase is reduced, which causes an abnormal increase in the amount of Zn phase, leading to a plating layer with poor processability.

The solidification process analyzed in detail for the plating layer having the chemical composition of the present disclosure is as follows.

First of all, an Al—Fe alloy layer is formed just after immersion in the plating bath, and then intermetallic compounds having a high melting point (such as $Mg_2Si$, $Ca_2Si$, CaSi, Ca—Zn—Al intermetallic compound, and Ca—Al—B intermetallic compound phases) are first precipitated immediately after the temperature drops below each own solidifying point. Because the amount of these phases is less than 5% in total, the most part of the Zn—Al—Mg alloy layer is still in the form of liquid phase at a temperature immediately below the melting point of the plating bath.

$MgZn_2$, Al, and Zn phases are precipitated from the liquid phase; in cases where a commonly used solidification process for a plating layer as described above is used, the fast cooling rate of the solidification process causes the liquid phase to be maintained independently of the phase diagram until the temperature drops low enough, which results in formation of a Zn—Al—$MgZn_2$ ternary eutectic structure or an abundant precipitation of Zn phase. In cases where rapid cooling is used, a supersaturated solid solution of Zn in an Al phase (an Al phase containing the same components as those of the typical α- and β-phases but in different concentrations) is abundantly precipitated. As a result, undesirable structures are increased.

On the other hand, in the optimal cooling condition, $MgZn_2$ and Al phases are allowed to grow enough by holding at a high temperature equal to or above the melting point of Zn, 420° C. As a result, the area fraction of $MgZn_2$ and Al phases in the plating layer can be maximized.

In this temperature range, the solidification follows the eutectic reaction of the Al—$MgZn_2$ phase (which can also be considered as a peritectic reaction because the Al phase crystallizes slightly faster). Additionally, maximization of the amount of Al—$MgZn_2$ phase could simultaneously minimize the amount of Zn phase.

Accordingly, incubation at a plating bath temperature (the melting point of a plating bath+20° C.) of 420° C. or higher after the plating process (after withdrawal of the steel product from the plating bath) should be retained for more than 5 seconds to achieve the structure of the plating layer of the present disclosure (namely, the Zn—Al—Mg alloy layer). That is, incubation at a temperature of 420° C. or higher for a retention time of more than 5 seconds can lead to securing a sufficient length of time to precipitate $MgZn_2$ and Al phases, which in turn reduces precipitation of a Zn phase, a Zn—Al—$MgZn_2$ ternary eutectic structure, or a supersaturated solid solution of Zn in an Al phase (an Al phase containing the same components as those of the typical α- and β-phases but in different concentrations).

Specifically, a plating bath temperature (the melting point of a plating bath+20° C.) is used, and the temperature is decreased from the melting point of the plating bath to 420° C. at a cooling rate of 5° C./sec or lower after the plating process (after withdrawal of the steel product from the plating bath), and incubation at a temperature of 420° C. or higher is retained for more than 5 seconds. However, in cases where the melting point of the plating bath is 500° C. or higher, a sufficient length of time to precipitate $MgZn_2$ and Al phases is secured and no problem is found, even if temperature drops from the melting point of the plating bath to 420° C. at a cooling rate of 10° C./sec or lower.

When incubation at a temperature of 420° C. or higher is retained for less than 5 seconds, generation of a supersaturated solid solution of Zn in a Zn phase, Zn—Al—$MgZn_2$ ternary eutectic structure, or Al phase is increased.

Additionally, for the growth of Ca—Zn—Al and Ca—Zn—Al—Si intermetallic compounds, the grain sizes of these intermetallic compounds can be increased during solidification by gradually cooling the plating layer well to a temperature (about 350° C.) at which the liquid phase disappears in the Zn—Al—Mg alloy layer. In particular, a low concentration of Al in the range of the Al concentration from more than 15% to 20% leads to the requirement of longer time for the growth of these intermetallic compounds, which requires temperature to decrease from the melting point of the plating bath to 350° C. at a cooling rate of less than 5° C./sec.

Additionally, the chemical composition of the plating layer originally containing Mg abundantly leads to a hard plating layer, as described above, and is inconvenient in terms of processability and plating adhesion. Although the most of the $MgZn_2$ and Al phases are solidified, a eutectic reaction from Al phase to Zn phase occurs at a temperature below 420° C., namely the aforementioned 275° C. Then, this eutectic reaction is completed before the temperature reaches 250° C. If incubation continues at temperatures below 420° C. for a long time for the purpose of providing good processability to the plating layer, the supersaturated solid solution of Zn in an Al phase (an Al phase containing the same components as those of the typical α- and β-phases but in different concentrations) disappears, which is a favorable condition in terms of processability. However, the amount of a Zn phase precipitated in the eutectic reaction is mutually increased, suggesting slight deterioration of weldability due to the increased amount of Zn phase. On the other hand, rapid cooling of the plating layer leaves the supersaturated solid solution of Zn in an Al phase (an Al phase containing the same components as those of the typical α- and β-phases but in different concentrations) inside, which is undesirable in terms of processability.

Accordingly, in consideration of these properties, the mean cooling rate applied to this temperature range (the temperature range from 420° C. to 250° C.) is preferably in the range of 10 to 20° C./sec, similarly to that for the normal plating process. Cooling at this cooling rate can result in formation of a Zn—Al—Mg alloy layer containing almost no supersaturated solid solution of Zn in an Al phase (an Al phase containing the same components as those of the typical α- and β-phases but in different concentrations) with overgrowth of no Zn phase.

A mean cooling rate of less than 10° C./sec results in a tendency of the amount of Zn phase to increase slightly, which is undesirable in terms of weldability. On the other hand, a mean cooling rate of not less than 20° C./sec results in a tendency to form a supersaturated solid solution of Zn in an Al phase.

The cooling at a mean cooling rate within the above-described range applied to the temperature range from 420° C. to 250° C. is an effective measure particularly in cases where the Al concentration is low and the Zn concentration is high.

In the production method for the metallic coated steel product of the present disclosure, particularly in cases where a plating layer containing Al at a concentration in the range of more than 15 to 20% is formed, longer time is required for precipitation of an Al phase because of a low Al concentration. Accordingly, to secure a good total area fraction of $MgZn_2$ and Al phases, incubation at a temperature of 420° C. or higher for a retention time of more than 5 seconds and cooling from the melting point of the plating bath to 350° C. (or 250° C.) at a cooling rate of less than 5° C./sec are required.

Next, the methods of measuring various properties of the plating layer will be described.

The chemical composition of the plating layer is measured by the following method.

First of all, the plating layer is removed with and dissolved in an acid solution containing an inhibitor for the corrosion of a ground steel (a steel product), to obtain an acidic sample solution. Then, the obtained acidic sample solution can be measured by ICP analysis to obtain the chemical composition of the plating layer (in cases where the plating layer has a single layer structure consisting of a Zn—Al—Mg alloy layer, the chemical composition of the Zn—Al—Mg alloy layer; in cases where the plating layer has a laminate structure consisting of an Al—Fe alloy layer and a Zn—Al—Mg alloy layer, the total chemical composition of the Al—Fe alloy layer and the Zn—Al—Mg alloy layer). The type of the acid is not limited to a particular acid as long as it can dissolve the plating layer. The mean chemical composition is obtained as the chemical composition of the plating layer.

Additionally, in cases where the individual chemical composition is determined for Al—Fe and Zn—Al—Mg alloy layers, a standard curve for quantitative analysis is prepared for each element by GDS (high-frequency glow discharge spectrophotometry). Then, the chemical composition of the subject plating layer may be measured in the depth direction. For example, several GDS samples of 30 mm square are prepared from a produced sample metallic coated steel sheet. Argon ion sputtering is used to study the distribution of elements in the depth direction from the surface of the plating layer and the peak intensities of elements are plotted. Furthermore, standard samples corresponding to the metallic elements, such as pure metal sheets, are prepared and used to obtain a plot of intensities of the elements in advance, which allows conversion of intensities to concentrations. When GDS is used for the analysis of chemical composition, preferably, the area of an analyzed sample is equal to or above the area of a circle having a diameter of 4 mm, and the measurement is replicated 10 times, and the mean intensity corresponding to each constituent element at each position is adopted.

The sputtering rate is preferably from about 0.04 to 0.1 μm/sec. When the values of the components in the Zn—Al—Mg alloy layer analyzed at each GDS analysis position are adopted, the average of the concentrations of each constituent element at depths from 1 to 10 μm (5-μm width) is preferably adopted to eliminate the influence of the outermost oxidized layer, with neglecting the profiles of constituent elements obtained from the surface to a depth of 1 μm.

Additionally, when the chemical composition of the Al—Fe alloy layer is measured, a position where the intensity of the element Fe is measured to be not less than 95% of the total intensity of all the elements is defined as the boundary between the ground steel (a steel product) and the plating layer (namely, the Al—Fe alloy layer) and the layer from the surface of the plating layer to the boundary is defined as the Al—Fe alloy layer. With making reference to the thickness of the Al—Fe alloy layer which has been independently obtained from observation by SEM or the like, the average of the concentrations of each constituent element at depths covering the thickness of the Al—Fe alloy layer is adopted.

Additionally, the individual chemical compositions of the Al—Fe and Zn—Al—Mg alloy layers can easily be determined from values obtained by a quantitative analysis using EPMA.

A method of determining the identity of each phase in the Zn—Al—Mg alloy layer (however, the Zn—Al—$MgZn_2$ ternary eutectic structure is excluded) is as follows.

The identities of phases in the Zn—Al—Mg alloy layer may be determined from x-ray diffraction patterns of the surface of the Zn—Al—Mg alloy layer. The intensities of x-ray diffraction are required to be calculated and modified to diffraction angles according to a Cu radiation source, though radiation sources such as Cu and Co radiation sources are available. Preferably, the scan range is from 5° to 90° with a step size of around 0.01°. The intensity (cps) at a particular diffraction angle is obtained as the average of the intensities measured in the range from plus to minus 0.05° of the particular angle. In cases where the amount of an added component is very small, any intermetallic compound related to the added element may not be detected. In that case, the identity of a trace intermetallic compound found in a TEM sample which has been prepared from the Zn—Al—Mg alloy layer may be determined from the electron diffraction pattern.

For the observation of the structure of the Zn—Al—Mg alloy layer, a cross-section of the Zn—Al—Mg alloy layer is polished and examined after nital etching to observe the structure, whereby the thicknesses of the Al—Fe and Zn—Al—Mg alloy layers can be measured. Use of the CP process allows the structure of the plating layer to be observed in more detail. An FE-SEM is preferably used for the observation of the Zn—Al—Mg alloy layer.

The area fraction of each phase in the Zn—Al—Mg alloy layer (however, the Zn—Al—$MgZn_2$ ternary eutectic structure is excluded) is measured by the following method.

To measure the area fraction of each phase in the Zn—Al—Mg alloy layer, an FE-SEM or TEM equipped with EDS (energy dispersive X-ray spectrometer) is used. An EPMA may be used for the identification of each phase.

The CP (cross section polisher) process is applied to an arbitrary cross-section of the Zn—Al—Mg alloy layer (a cross-section prepared by cutting in the thickness direction) as a measurement subject. After the CP process, SEM backscattered electron images of the cross-section of the Zn—Al—Mg alloy layer are acquired. The SEM backscattered electron images are defined as images captured at three or more different locations for measurement of areas within an arbitrary region of about 100 μm or more (in the thickness direction; a visual field covering the Zn—Al—Mg alloy layer is selected)×2,000 μm (in the direction parallel to the surface of the steel product) at a magnification of 1,000 times (image size: the approximate thickness of the Zn—Al—Mg alloy layer in μm×about 150 μm).

Next, the FIB (focused ion beam) process is applied to the same arbitrary cross-section of the Zn—Al—Mg alloy layer (a cross-section prepared by cutting the Zn—Al—Mg alloy layer in the thickness direction) as a measurement subject. After the FIB process, TEM (transmission electron microscope) electron diffraction patterns of the sectional structure of the Zn—Al—Mg alloy layer are obtained. Then, metals or intermetallic compounds contained in the Zn—Al—Mg alloy layer are identified.

Next, the identities of the phases contained in the Zn—Al—Mg alloy layer are determined in the SEM backscattered electron images by comparing the SEM backscattered electron images and the results from the identification of the TEM electron diffraction patterns. In the identification of the phases contained in the Zn—Al—Mg alloy layer, EDS mapping analysis may be carried out and the results of the EDS mapping analysis may be compared with the results from the identification of the TEM electron diffraction patterns.

Next, in the SEM backscattered electron images in grayscale, three values of brightness, hue, and contrast are determined for each phase contained in the Zn—Al—Mg alloy layer. Because the three values of brightness, hue, and contrast corresponding to each phase reflect the atomic number of each element contained in the each phase, phases containing more Al or Mg, which are elements with a low atomic number, than others tend to be colored darker and phases containing more Zn than others tend to be colored brighter in the images.

Computer image processing is carried out to change colors in only areas with three values which fall within the above ranges indicated by each phase contained in the Zn—Al—Mg alloy layer, to be consistent with the SEM backscattered electron images, based on the result of the above comparison with EDS (for example, the area of each phase in a visual field (in pixel number) or the like is calculated under a condition where only a particular phase is visually displayed in white). This image processing is carried out on each phase to determine the area fraction of the each phase contained in the Zn—Al—Mg alloy layer in each SEM backscattered electron image.

Furthermore, the area fraction of each phase of the Zn—Al—Mg alloy layer is defined as the average of the area fractions of each phase obtained at least three visual fields in an arbitrary cross-section of the Zn—Al—Mg alloy layer (a cross-section prepared by cutting the Zn—Al—Mg alloy layer in the thickness direction) according to the above-described operation.

Incidentally, in SEM backscattered electron images at a magnification of 1,000 times, "$MgZn_2$, Al, and Zn phases" present in the Zn—Al—$MgZn_2$ ternary eutectic structure are indistinguishable in terms of boundaries and area fractions. That is, the area fractions of "$MgZn_2$, Al, and Zn phases" in the below-described Zn—Al—$MgZn_2$ ternary eutectic structure are excluded from the "area fractions of $MgZn_2$ phase, Al phase and Zn phase" to be here determined.

However, the area fraction of each phase even in the ternary eutectic structure could be determined in enlarged images at a magnification of around 10,000 times, and it is thus possible to calculate the fraction of each phase in the ternary eutectic crystal under the following conditions for image processing.

In this respect, both SEM images of cross-sections of the Zn—Al—Mg alloy layer are backscattered electron images and those images are easily distinguishable from each other, as shown in FIGS. 2 and 4, which is attributed to the constituent phases of the Zn—Al—Mg alloy layer (such as Al phase, $MgZn_2$ phase, and Zn phases) typically having a clear difference in atomic number.

Other intermetallic compound phases (such as Ca—Zn—Al intermetallic compound) may have values of contrast close to that of an $MgZn_2$ phase but have unique appearances. Thus, these intermetallic compound phases are also relatively easily distinguishable.

Intermetallic compound phases containing Si, an element with a low atomic number, (such as Ca—Zn—Al—Si intermetallic compound) are also relatively easily distinguishable by the low contrast.

Intermetallic compound phases containing B, an element with a low atomic number, (such as Ca—Al—B intermetallic compound phase) are also relatively easily distinguishable by the low contrast, similarly to intermetallic compound phases containing Si. In cases where discrimination is difficult, TEM electron diffraction will be carried out.

The mean grain size of each of the Ca—Zn—Al and Ca—Zn—Al—Si intermetallic compound phases is determined as follows.

Among grains of each compound phase detected in the above-described SEM observation for measuring the area fraction of each phase, the top five largest grain sizes are selected in the each compound phase. Then, this operation is replicated for five visual fields and the arithmetic mean of the grain sizes of the total 25 grains is defined as the mean grain size of each of the Ca—Zn—Al and Ca—Zn—Al—Si intermetallic compound phases.

A Zn—Al—$MgZn_2$ ternary eutectic structure in the Zn—Al—Mg alloy layer is identified and the area fraction thereof is measured by the following methods.

First of all, a eutectic structure composed of Al, Zn, and $MgZn_2$ phases is identified in an SEM backscattered electron image by the same technique as used for measuring the area fraction of each phase in the Zn—Al—Mg alloy layer. A part of the structure corresponding to a rectangular vision field of 3 μm×4 μm (diagonal line length: 5 μm) is observed at a magnification of 30,000 times (see FIG. 7). In cases where two diagonal lines within the rectangular vision field are drawn and these diagonal lines individually pass through a Zn phase and an $MgZn_2$ or Al phase, which spreads around the Zn phase, five times or more, the structure is determined as a ternary eutectic structure. This determination is based on the presence of "a structure composed of fine dispersed three phases," which is specific to a ternary eutectic structure.

In cases where the ternary eutectic structure corresponding to a region of 3 μm×4 μm is unlikely to be observed because of a possible uneven distribution of the ternary eutectic structure or the composition that hinders the formation of a ternary eutectic structure, the structure is partitioned into a lattice of 1-μm square cells. If one or more cells contain all the phases, the structure is determined as a ternary eutectic structure.

Next, the above-described operation is repeated on the same SEM backscattered electron image as used for measuring the area fraction of each phase in the Zn—Al—Mg alloy layer (the image observed at a magnification of 1,000 times and having a size equal to the approximate thickness of the Zn—Al—Mg alloy layer in μm×about 150 μm) to grasp the outline (area) of a ternary eutectic structure while confirming the continuous nature of the ternary eutectic structure. Then, the area fraction of the ternary eutectic structure in the Zn—Al—Mg alloy layer in the SEM backscattered electron image is determined.

The area fraction of the ternary eutectic structure is defined as the average of the area fractions of each phase obtained at least three visual fields in an arbitrary cross-section of the Zn—Al—Mg alloy layer (a cross-section prepared by cutting the Zn—Al—Mg alloy layer in the thickness direction) according to the above-described operation.

For the plating layer hardness, the depth of an indent made at a load of 10 gf may be measured from the surface of the plating layer to determine the Vickers hardness. The Vickers hardness is preferably determined as the average of values measured at around 30 different positions.

The processability of the plating layer is preferably evaluated by analyzing the powder formation by a press during the V-bending test. Compressive stress is applied and powders are formed at the bottom of the V trough in a metallic coated steel sheet exhibiting poor plastic deformability. In cases where the processability is evaluated more strictly, the processability is preferably evaluated by the draw-bending test, in which the test piece in a V-shape is returned flat and then evaluated by tape peeling.

Post-treatments that can be applied to the metallic coated steel sheet of the present disclosure will be described below.

In the metallic coated steel sheet of the present disclosure, a coating film may be prepared on the plating layer. The coating film may be a single layer or include two or more layers. Examples of the coating film just above the plating layer include chromate coating films, phosphate coating films, and chromate-free coating films. Any known methods can be used to perform chromate conversion coating, phosphate conversion coating, chromate-free coating for the production of these coating films.

Chromate conversion coating includes electrolytic chromate conversion coating where a chromate coating film is formed by electrolysis, chemical reaction-mediated chromate conversion coating where a coating film is formed by allowing the reaction of a coating liquid with a coating material and subsequently washing away an excess amount of the coating liquid, and dry-in-place chromate conversion coating where a coating film is formed by applying a coating liquid to an object of interest and drying the object without washing. Any of the treatments may be adopted.

The electrolytic chromate conversion coating can include various types of electrolytic chromate conversion coating using chromic acid, silica sol, resins (such as phosphate, acrylic resin, vinyl ester resin, vinyl acetate-acrylic emulsion, carboxylated styrene-butadiene latex, diisopropanol amine-modified epoxy resin), and hard silica.

Examples of the phosphate conversion coating include zinc phosphate conversion coating zinc calcium phosphate conversion coating, and manganese phosphate conversion coating.

Chromate-free coating particularly imposes no burden on the environment and is favorable. Chromate-free coating includes electrolytic chromate-free coating where a chromate-free coating film is formed by electrolysis, chemical reaction-mediated chromate-free coating where a coating film is formed by allowing the reaction of a coating liquid with a coating material and subsequently washing away an excess amount of the coating liquid, and dry-in-place chromate-free coating where a coating film is formed by applying a coating liquid to an object of interest and drying the object without washing. Any of the treatments may be adopted.

Furthermore, an organic resin coating film composed of a single layer or two or more layers may be prepared on the coating film just above the plating layer. The organic resin is not limited to a particular type of resin, and includes, for example, polyester resins, polyurethane resins, epoxy resins, acrylic resins, polyolefin resins, and modified derivatives of these resins. The modified derivatives refer to resins resulting from the reaction of any reactive functional group contained in the structures of these resins with another functional group that can react with the former functional group and is contained in the structure of another compound (such as a monomer or cross-linking agent).

Such organic resins may be used in combination with one or more organic resins (unmodified resins), or in combination with one or more organic resins produced by modification of at least one organic resin in the presence of at least one other organic resin. In addition, any coloring pigment or rust preventive pigment may be contained in the organic resin coating film. An aqueous pigment prepared by dissolving or dispersing the pigment in water may also be used.

EXAMPLES

Examples of the present disclosure will be described, but conditions used in the examples are an illustration of conditions adopted for confirming the feasibility and effects of the present disclosure, and the present disclosure will not be limited by the illustration of conditions. Various conditions can be applied to the present disclosure as long as the object of the present disclosure will be achieved without departing from the spirit of the present disclosure.

Example A

Plating baths were prepared using a vacuum melting furnace and predetermined amounts of pure metal ingots under atmospheric conditions to obtain plating layers having any of the chemical compositions indicated in Tables from 1-1 to 1-3. A batch-type hot-dip plating apparatus was used to prepare metallic coated steel sheets.

Commercially available Zn—Al—Mg alloy-coated and hot-dip Zn-coated steel sheets were used as the comparative materials Nos. 102 and 103. Both of the comparative materials have a plating layer with a thickness of 20 μm.

As an original metallic uncoated sheet, a 3.2-mm-thick general hot-rolled carbon steel sheet having a size of 100×200 mm (C=0.15%, Si=0.005%, Mn=0.55%, P=0.015%, S=0.005%) was used and cleaned just before plating by degreasing and acid pickling.

In the preparation of any sample, the same reduction method was conducted on the original metallic uncoated sheet in the process from immersion into a plating bath to withdrawal from the plating bath. That is, a metallic coated steel sheet was heated from room temperature to 800° C. by electrical heating in a $N_2$—$H_2$ (5%) (at a dew point of −40° or lower; an oxygen concentration of less than 25 ppm) environment, kept for 60 seconds and then cooled to a temperature of the plating bath temperature plus 10° C. by blowing $N_2$ gas, and then directly immersed into a plating bath.

The immersion time in a plating bath was defined as 0.2 seconds for the original metallic uncoated sheet in any plating process. Each metallic coated steel sheet was prepared by adjusting the pressure of gas in a $N_2$ gas wiping operation in such a manner that the thickness of a plating layer was 20 μm (±1 μm). The process from immersion into a plating bath to completion of wiping was completed within one second by high-speed running of the batch-type plating apparatus, and the temperature was immediately decreased to the melting point of a resulting plating layer by blowing $N_2$ gas.

The following six different plating processes were carried out.

Method A: The plating bath temperature was the melting point of a plating bath plus 20° C. After withdrawal of the original metallic uncoated sheet from the plating bath, the wiping operation was completed at a temperature just above the melting point of a resulting plating layer. The plating layer was obtained in a cooling process where the temperature decreased from the melting point of the plating bath to 250° C. at a mean cooling rate of 15 (±5) ° C./sec and from 250° C. to 150° C. at a mean cooling rate of 7.5 (±2.5) ° C./sec. However, the temperature is decreased from the melting point of the plating bath to 420° C. at a cooling rate of more than 5° C./sec and incubation at a temperature of 420° C. or higher is retained for less than 5 seconds.

Method B: The plating bath temperature was the melting point of a plating bath plus 20° C. After withdrawal of the original metallic uncoated sheet from the plating bath, the wiping operation was completed at a temperature just above the melting point of a resulting plating layer. The plating layer was obtained in a cooling process (mist cooling) where the temperature decreased from the melting point of the plating bath to 150° C. at a mean cooling rate of 40 (±10) ° C./sec). However, the temperature is decreased from the melting point of the plating bath to 420° C. at a cooling rate of more than 5° C./sec and incubation at a temperature of 420° C. or higher is retained for less than 0.5 seconds.

Method C: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 420° C. at a mean cooling rate of 4 (±1) ° C./sec (incubation at a temperature of 420° C. or higher was retained for more than 5 seconds) and from 420° C. to 250° C. at a mean cooling rate of 15 (±5) ° C./sec.

Method D: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 420° C. at a mean cooling rate of 4 (±1) ° C./sec (incubation at a temperature of 420° C. or higher was retained for more than 5 seconds) and from 420° C. to 250° C. at a mean cooling rate of 30 (±5) ° C./sec.

Method E: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 420° C. at a mean cooling rate of 8 (±2) ° C./sec (incubation at a temperature of 420° C. or higher was retained for more than 5 seconds) and from 420° C. to 250° C. at a mean cooling rate of 15 (±5) ° C./sec).

Method F: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 420° C. at a mean cooling rate of 8 (±2) ° C./sec (incubation at a temperature of 420° C. or higher was retained for more than 5 seconds) and from 420° C. to 250° C. at a mean cooling rate of 30 (±5) ° C./sec.

Measurement of the Area Fraction of Each Phase

Sample pieces containing a cross-section of a plating layer (a cross-section of the plating layer cut in the thickness direction) were excised from the obtained metallic coated steel sheets. Then, the area fractions of the following phases present in the Zn—Al—Mg alloy layer were measured according to any existing method:

the area fraction of $MgZn_2$ phase, the area fraction of Al phase, the area fraction of Zn phase, the area fraction of Zn—Al—$MgZn_2$ ternary eutectic structure (indicated in tables by "Ternary eutectic structure"), the area fraction of Ca—Al—B intermetallic compound phase (indicated in tables by "B compound"): the total area fraction of $Al_2CaB_5$ phase and compound phases derived from $Al_2CaB_5$ phase with substitution of some atoms by Zn and Mg, the area fraction of intermetallic compound phases of Mg with Sn, Bi or In (indicated in tables by "Sn compound"): the total area fraction of $Mg_2Sn$, $Mg_3Bi_2$, and $Mg_3In$ phases the area fraction of other intermetallic compounds: the total area fraction of $Mg_2Si$ phase, $Ca_2Si$ phase, CaSi phase, Ca—Zn—Al intermetallic compound phase (indicated in tables by "CZA"), and Ca—Zn—Al—Si intermetallic compound phase (indicated in tables by "CZAS") (however, each phase with confirmation of its presence is indicated by "Ex" without showing the area fraction of the phase).

Arc Weldability of a Plating Layer

The obtained metallic coated steel sheets were used for evaluating the arc weldability of a plating layer as follows.

Two samples of 100 mm square were prepared and a $CO_2$/MAG welding machine was used to weld them into a fillet welded lap sample. The metallic coated steel sheets were joined to each other by arc welding with an overlap width of 10 mm along one edge of each metallic coated steel sheet and with a welding gap of 0 mm and a leg length of around 6 mm. The welding speed was 0.3 m/min; the welding wire was the solid wire YGW14, φ12; the $CO_2$ shield gas flow rate was 15 l/min; the welding current was from 150 to 250 (A); the arc voltage was from 20 to 24 V; the welding consisted of two passes. Weld beads were confirmed by observing prospective weld beads from the top in the x-ray transmission test to determine the blowhole occupancy Bs (%).

The blowhole occupancy Bs of the Zn—Al—Mg alloy-coated and Zn-coated steel sheets were about 40%; a blowhole occupancy Bs of not less than 40% was graded as "B," a blowhole occupancy Bs of 20 to 40% was graded as "A," and a blowhole occupancy Bs of less than 20% was graded as "S."

Evaluation of LME

The obtained metallic coated steel sheets were used for evaluating LME as follows.

A stainless steel welding wire of φ1.2 mm (JIS Z3323 YF309LC) was welded to the middle of each metallic coated steel sheet having a size of 70 mm×150 mm according to the above-described welding conditions (however, one pass) by bead-on-plate welding over a length of 75 mm and a width of 3 to 5 mm to prepare a bead-on-plate test specimen. Then, the presence or absence of any crack in each test specimen was confirmed by the penetrant test.

In the Zn—Al—Mg alloy-coated and Zn-coated steel sheets, LME was detected at plural locations, showing visually detectable cracks with a length of not less than 3 mm.

Then, LME showing a visually detectable crack with a length of not less than 5 mm was graded as "B."

In a case where no LME at a welded zone (weld metal) but a trace of marker confirmed at the boundary between the weld metal and the welding heat affected zone (HAZ) having a length of less than 5% of the circumference length was detected and, however, EPMA observation of a cross-section of a crack indicated no presence of Zn around the crack, the case was graded as "A."

In a case where no crack at an area around a welded zone (weld metal) and no trace of marker were detected, the case was graded as "S."

Corrosion Resistance at an Area Behind a Welded Zone

The obtained metallic coated steel sheets were used for evaluating the corrosion resistance at an area behind a welded zone as follows.

Bead-on-plate test specimens were obtained in the same manner as in the evaluation of LME. The back surface of each specimen was evaluated for red rust formation on the back surface of a weld bead after 90 to 180 cycles of the accelerated corrosion test (JASO M 609-91). In the Zn—Al—Mg alloy-coated steel sheet, rust specks were formed on the back surface of a weld bead after 90 cycles. In the Zn-coated steel sheet, a totally red rusted surface was formed.

Detection of red rust specks on the back surface of a weld bead after 90 cycles was graded as "B."

Detection of red rust specks on the back surface of a weld bead after 120 cycles was graded as "A."

Detection of red rust specks on the back surface of a weld bead after 150 cycles was graded as "AA."

Detection of red rust specks on the back surface of a weld bead after 180 cycles was graded as "AAA."

Detection of no red rust formation on the back surface of a weld bead after 180 cycles was graded as "S."

Corrosion Resistance at an Area Around a Welded Zone

The obtained metallic coated steel sheets were used for evaluating the corrosion resistance at an area around a welded zone as follow.

Bead-on-plate test specimens were obtained in the same manner as in the evaluation of LME. The surface of each test specimen was used in the salt spray test (JIS Z 2371) for 1,000 to 1,300 hours to evaluate the corrosion resistance.

In the Zn—Al—Mg alloy-coated steel sheet, dripping of red rust-containing water from an area around a welded zone was detected after 1,000 hours. In the Zn-coated steel sheet, a totally red rusted surface was formed.

Detection of red rust specks on an area around a welded zone after 1,000 hours was graded as "B."

Detection of red rust specks on an area around a welded zone after 1,100 hours was graded as "A."

Detection of red rust specks on an area around a welded zone after 1,200 hours was graded as "AA."

Detection of red rust specks on an area around a welded zone after 1,300 hours was graded as "AAA."

Detection of no red rust formation on an area around a welded zone after 1,300 hours was graded as "S."

Processability of a Plating Layer

The obtained metallic coated steel sheets were used for evaluating the processability of a plating layer as follows.

The 10R-90° V-bending test was performed on each metallic coated steel sheet and a cellophane tape having a width of 24 mm was attached to the V trough and then peeled off to detect visually any powder formation at the trough.

Detection of peeled powders attached to the tape was graded as "B."

Detection of no peeled powders on the tape was graded as "A."

The results of Example A are summarized in Tables from 1-1 to 1-6.

TABLE 1-1-1

| | | Melting point of a plating bath | Plating method | Components (% by mass) | | | | | | | | |
|---|---|---|---|---|---|---|---|---|---|---|---|---|
| | | | | | | | | | | | Group A | |
| No. | Category | | | Zn | Al | Mg | Ca | Si | Fe | B | Y | La |
| 1A | C | 460 | Method C | 73 | 20 | 6 | 0.5 | 0 | 0.5 | 0 | 0 | 0 |
| 2A | C | 460 | Method C | 73 | 21 | 5 | 0.5 | 0 | 0.5 | 0 | 0 | 0 |
| 3A | E | 460 | Method C | 72 | 21 | 6 | 0.5 | 0 | 0.5 | 0 | 0 | 0 |
| 4A | C | 460 | Method A | 72 | 21 | 6 | 0.5 | 0 | 0.5 | 0 | 0 | 0 |
| 5A | C | 460 | Method B | 72 | 21 | 6 | 0.5 | 0 | 0.5 | 0 | 0 | 0 |
| 6A | E | 460 | Method D | 72 | 21 | 6 | 0.5 | 0 | 0.5 | 0 | 0 | 0 |
| 7A | E | 460 | Method C | 69.9 | 22 | 6 | 0.5 | 0 | 0.5 | 0.1 | 0 | 0.1 |
| 8A | E | 460 | Method C | 69.7 | 23 | 6 | 0.5 | 0 | 0.5 | 0.3 | 0 | 0 |
| 9A | E | 460 | Method C | 67.3 | 25 | 6 | 0.5 | 0.2 | 0.5 | 0 | 0 | 0 |
| 10A | E | 470 | Method C | 65.8 | 27 | 6 | 0.5 | 0.2 | 0.5 | 0 | 0 | 0 |
| 11A | E | 490 | Method C | 63.8 | 29 | 6 | 0.5 | 0.2 | 0.5 | 0 | 0 | 0 |
| 12A | E | 510 | Method E | 61.8 | 31 | 6 | 0.5 | 0.2 | 0.5 | 0 | 0 | 0 |
| 13A | C | 510 | Method B | 61.8 | 31 | 6 | 0.5 | 0.2 | 0.5 | 0 | 0 | 0 |
| 14A | E | 520 | Method E | 59.8 | 33 | 6 | 0.5 | 0.2 | 0.5 | 0 | 0 | 0 |
| 15A | E | 523 | Method F | 59.8 | 33 | 6 | 0.5 | 0.2 | 0.5 | 0 | 0 | 0 |
| 16A | E | 530 | Method E | 58.8 | 34 | 6 | 0.5 | 0.2 | 0.5 | 0 | 0 | 0 |
| 17A | C | 530 | Method E | 57.8 | 35 | 6 | 0.5 | 0.2 | 0.5 | 0 | 0 | 0 |
| 18A | E | 470 | Method C | 66 | 25 | 8 | 0.5 | 0 | 0.5 | 0 | 0 | 0 |
| 19A | E | 470 | Method D | 66 | 25 | 8 | 0.5 | 0 | 0.5 | 0 | 0 | 0 |
| 20A | E | 480 | Method C | 64 | 27 | 8 | 0.5 | 0 | 0.5 | 0 | 0 | 0 |
| 21A | C | 480 | Method A | 64 | 27 | 8 | 0.5 | 0 | 0.5 | 0 | 0 | 0 |
| 22A | E | 490 | Method C | 62 | 29 | 8 | 0.5 | 0 | 0.5 | 0 | 0 | 0 |
| 23A | E | 510 | Method E | 59.8 | 31 | 8 | 0.5 | 0.2 | 0.5 | 0 | 0 | 0 |
| 24A | E | 520 | Method E | 57.8 | 33 | 8 | 0.5 | 0.2 | 0.5 | 0 | 0 | 0 |
| 25A | E | 470 | Method C | 63.5 | 25 | 10 | 1 | 0 | 0.5 | 0 | 0 | 0 |
| 26A | C | 470 | Method B | 63.5 | 25 | 10 | 1 | 0 | 0.5 | 0 | 0 | 0 |
| 27A | E | 490 | Method C | 59.5 | 29 | 10 | 1 | 0 | 0.5 | 0 | 0 | 0 |
| 28A | E | 490 | Method C | 55.3 | 33 | 10 | 1 | 0.2 | 0.5 | 0 | 0 | 0 |
| 29A | E | 530 | Method E | 58 | 25 | 15 | 1.5 | 0 | 0.5 | 0 | 0 | 0 |
| 30A | E | 530 | Method E | 54 | 29 | 15 | 1.5 | 0 | 0.5 | 0 | 0 | 0 |
| 31A | E | 490 | Method C | 49.8 | 33 | 15 | 1.5 | 0.2 | 0.5 | 0 | 0 | 0 |
| 32A | E | 520 | Method E | 53.5 | 25 | 19 | 2 | 0 | 0.5 | 0 | 0 | 0 |
| 33A | E | 520 | Method E | 49.5 | 29 | 19 | 2 | 0 | 0.5 | 0 | 0 | 0 |
| 34A | E | 510 | Method E | 45.3 | 33 | 19 | 2 | 0.2 | 0.5 | 0 | 0 | 0 |
| 35A | C | 520 | Method E | 54 | 25 | 20 | 0.5 | 0 | 0.5 | 0 | 0 | 0 |

TABLE 1-1-1-continued

| | Components (% by mass) | | | | | | | | | | | | | | |
|---|---|---|---|---|---|---|---|---|---|---|---|---|---|---|---|
| | Group A | Group B | | | | | | | | Group C | | | Group D | | |
| No. | Ce | Cr | Ti | Ni | Co | V | Nb | Cu | Mn | Sr | Sb | Pb | Sn | Bi | In |
| 1A | 0 | 0 | 0 | 0 | 0 | 0 | 0 | 0 | 0 | 0 | 0 | 0 | 0 | 0 | 0 |
| 2A | 0 | 0 | 0 | 0 | 0 | 0 | 0 | 0 | 0 | 0 | 0 | 0 | 0 | 0 | 0 |
| 3A | 0 | 0 | 0 | 0 | 0 | 0 | 0 | 0 | 0 | 0.05 | 0 | 0 | 0 | 0 | 0 |
| 4A | 0 | 0 | 0 | 0 | 0 | 0 | 0 | 0 | 0 | 0.05 | 0 | 0 | 0 | 0 | 0 |
| 5A | 0 | 0 | 0 | 0 | 0 | 0 | 0 | 0 | 0 | 0.05 | 0 | 0 | 0 | 0 | 0 |
| 6A | 0 | 0 | 0 | 0 | 0 | 0 | 0 | 0 | 0 | 0.05 | 0 | 0 | 0 | 0 | 0 |
| 7A | 0 | 0.1 | 0 | 0.1 | 0 | 0 | 0 | 0 | 0 | 0 | 0.2 | 0 | 0.5 | 0 | 0 |
| 8A | 0 | 0 | 0 | 0 | 0 | 0 | 0 | 0 | 0 | 0 | 0 | 0.05 | 0 | 0 | 0 |
| 9A | 0 | 0 | 0 | 0 | 0 | 0 | 0 | 0 | 0 | 0.5 | 0 | 0 | 0 | 0 | 0 |
| 10A | 0 | 0 | 0 | 0 | 0 | 0 | 0 | 0 | 0 | 0 | 0 | 0 | 0 | 0 | 0 |
| 11A | 0 | 0 | 0 | 0 | 0 | 0 | 0 | 0 | 0 | 0 | 0 | 0 | 0 | 0 | 0 |
| 12A | 0 | 0 | 0 | 0 | 0 | 0 | 0 | 0 | 0 | 0 | 0 | 0 | 0 | 0 | 0 |
| 13A | 0 | 0 | 0 | 0 | 0 | 0 | 0 | 0 | 0 | 0 | 0 | 0 | 0 | 0 | 0 |
| 14A | 0 | 0 | 0 | 0 | 0 | 0 | 0 | 0 | 0 | 0 | 0 | 0 | 0 | 0 | 0 |
| 15A | 0 | 0 | 0 | 0 | 0 | 0 | 0 | 0 | 0 | 0 | 0 | 0 | 0 | 0 | 0 |
| 16A | 0 | 0 | 0 | 0 | 0 | 0 | 0 | 0 | 0 | 0 | 0 | 0 | 0 | 0 | 0 |
| 17A | 0 | 0 | 0 | 0 | 0 | 0 | 0 | 0 | 0 | 0 | 0 | 0 | 0 | 0 | 0 |
| 18A | 0 | 0 | 0 | 0 | 0 | 0 | 0 | 0 | 0 | 0 | 0 | 0 | 0 | 0 | 0 |
| 19A | 0 | 0 | 0 | 0 | 0 | 0 | 0 | 0 | 0 | 0 | 0 | 0 | 0 | 0 | 0 |
| 20A | 0 | 0 | 0 | 0 | 0 | 0 | 0 | 0 | 0 | 0 | 0 | 0 | 0 | 0 | 0 |
| 21A | 0 | 0 | 0 | 0 | 0 | 0 | 0 | 0 | 0 | 0 | 0 | 0 | 0 | 0 | 0 |
| 22A | 0 | 0 | 0 | 0 | 0 | 0 | 0 | 0 | 0 | 0 | 0 | 0 | 0 | 0 | 0 |
| 23A | 0 | 0 | 0 | 0 | 0 | 0 | 0 | 0 | 0 | 0 | 0 | 0 | 0 | 0 | 0 |
| 24A | 0 | 0 | 0 | 0 | 0 | 0 | 0 | 0 | 0 | 0 | 0 | 0 | 0 | 0 | 0 |
| 25A | 0 | 0 | 0 | 0 | 0 | 0 | 0 | 0 | 0 | 0 | 0 | 0 | 0 | 0 | 0 |
| 26A | 0 | 0 | 0 | 0 | 0 | 0 | 0 | 0 | 0 | 0 | 0 | 0 | 0 | 0 | 0 |
| 27A | 0 | 0 | 0 | 0 | 0 | 0 | 0 | 0 | 0 | 0 | 0 | 0 | 0 | 0 | 0 |
| 28A | 0 | 0 | 0 | 0 | 0 | 0 | 0 | 0 | 0 | 0 | 0 | 0 | 0 | 0 | 0 |
| 29A | 0 | 0 | 0 | 0 | 0 | 0 | 0 | 0 | 0 | 0 | 0 | 0 | 0 | 0 | 0 |
| 30A | 0 | 0 | 0 | 0 | 0 | 0 | 0 | 0 | 0 | 0 | 0 | 0 | 0 | 0 | 0 |
| 31A | 0 | 0 | 0 | 0 | 0 | 0 | 0 | 0 | 0 | 0 | 0 | 0 | 0 | 0 | 0 |
| 32A | 0 | 0 | 0 | 0 | 0 | 0 | 0 | 0 | 0 | 0 | 0 | 0 | 0 | 0 | 0 |
| 33A | 0 | 0 | 0 | 0 | 0 | 0 | 0 | 0 | 0 | 0 | 0 | 0 | 0 | 0 | 0 |
| 34A | 0 | 0 | 0 | 0 | 0 | 0 | 0 | 0 | 0 | 0 | 0 | 0 | 0 | 0 | 0 |
| 35A | 0 | 0 | 0 | 0 | 0 | 0 | 0 | 0 | 0 | 0 | 0 | 0 | 0 | 0 | 0 |

TABLE 1-1-2

| | Components (% by mass) | | | | |
|---|---|---|---|---|---|
| No. | Total content of Group A | Total content of Ca + Group A | Total content of Group B | Total content of Group C | Total content of Group D |
| 1A | 0 | 0.5 | 0 | 0 | 0 |
| 2A | 0 | 0.5 | 0 | 0 | 0 |
| 3A | 0 | 0.5 | 0 | 0.05 | 0 |
| 4A | 0 | 0.5 | 0 | 0.05 | 0 |
| 5A | 0 | 0.5 | 0 | 0.05 | 0 |
| 6A | 0 | 0.5 | 0 | 0.05 | 0 |
| 7A | 0.1 | 0.6 | 0.2 | 0.2 | 0.5 |
| 8A | 0 | 0.5 | 0 | 0.05 | 0 |
| 9A | 0 | 0.5 | 0 | 0.5 | 0 |
| 10A | 0 | 0.5 | 0 | 0 | 0 |
| 11A | 0 | 0.5 | 0 | 0 | 0 |
| 12A | 0 | 0.5 | 0 | 0 | 0 |
| 13A | 0 | 0.5 | 0 | 0 | 0 |
| 14A | 0 | 0.5 | 0 | 0 | 0 |
| 15A | 0 | 0.5 | 0 | 0 | 0 |
| 16A | 0 | 0.5 | 0 | 0 | 0 |
| 17A | 0 | 0.5 | 0 | 0 | 0 |
| 18A | 0 | 0.5 | 0 | 0 | 0 |
| 19A | 0 | 0.5 | 0 | 0 | 0 |
| 20A | 0 | 0.5 | 0 | 0 | 0 |
| 21A | 0 | 0.5 | 0 | 0 | 0 |
| 22A | 0 | 0.5 | 0 | 0 | 0 |

TABLE 1-1-2-continued

| | Components (% by mass) | | | | |
|---|---|---|---|---|---|
| No. | Total content of Group A | Total content of Ca + Group A | Total content of Group B | Total content of Group C | Total content of Group D |
| 23A | 0 | 0.5 | 0 | 0 | 0 |
| 24A | 0 | 0.5 | 0 | 0 | 0 |
| 25A | 0 | 1 | 0 | 0 | 0 |
| 26A | 0 | 1 | 0 | 0 | 0 |
| 27A | 0 | 1 | 0 | 0 | 0 |
| 28A | 0 | 1 | 0 | 0 | 0 |
| 29A | 0 | 1.5 | 0 | 0 | 0 |
| 30A | 0 | 1.5 | 0 | 0 | 0 |
| 31A | 0 | 1.5 | 0 | 0 | 0 |
| 32A | 0 | 2 | 0 | 0 | 0 |
| 33A | 0 | 2 | 0 | 0 | 0 |
| 34A | 0 | 2 | 0 | 0 | 0 |
| 35A | 0 | 0.5 | 0 | 0 | 0 |

TABLE 1-2-1

| No. | Category | Melting point of a plating bath | Plating method | Components (% by mass) Zn | Al | Mg | Ca | Si | Fe | B | Group A Y | La |
|---|---|---|---|---|---|---|---|---|---|---|---|---|
| 36A | C | 490 | Method C | 66.5 | 25 | 8 | 0 | 0 | 0.5 | 0 | 0 | 0 |
| 37A | E | 490 | Method C | 66.4 | 25 | 8 | 0.1 | 0 | 0.5 | 0 | 0 | 0 |
| 38A | E | 490 | Method D | 66.4 | 25 | 8 | 0.1 | 0 | 0.5 | 0 | 0 | 0 |
| 39A | E | 490 | Method C | 65.5 | 25 | 8 | 1 | 0 | 0.5 | 0 | 0 | 0 |
| 40A | E | 520 | Method E | 57.5 | 33 | 8 | 1 | 0 | 0.5 | 0 | 0 | 0 |
| 41A | C | 520 | Method A | 57.5 | 33 | 8 | 1 | 0 | 0.5 | 0 | 0 | 0 |
| 42A | E | 520 | Method F | 57.5 | 33 | 8 | 1 | 0 | 0.5 | 0 | 0 | 0 |
| 43A | E | 490 | Method C | 64.5 | 25 | 8 | 2 | 0 | 0.5 | 0 | 0 | 0 |
| 44A | E | 520 | Method E | 56.5 | 33 | 8 | 2 | 0 | 0.5 | 0 | 0 | 0 |
| 45A | E | 520 | Method F | 56.5 | 33 | 8 | 2 | 0 | 0.5 | 0 | 0 | 0 |
| 46A | E | 490 | Method C | 64 | 25 | 8 | 2.5 | 0 | 0.5 | 0 | 0 | 0 |
| 47A | E | 520 | Method E | 56 | 33 | 8 | 2.5 | 0 | 0.5 | 0 | 0 | 0 |
| 48A | C | 500 | Method E | 63.5 | 25 | 8 | 3 | 0 | 0.5 | 0 | 0 | 0 |
| 49A | E | 480 | Method C | 60.6 | 27 | 11 | 0.8 | 0.1 | 0.5 | 0 | 0 | 0 |
| 50A | E | 500 | Method E | 55.6 | 32 | 11 | 0.8 | 0.1 | 0.5 | 0 | 0 | 0 |
| 51A | E | 480 | Method C | 60.2 | 27 | 11 | 0.8 | 0.5 | 0.5 | 0 | 0 | 0 |
| 52A | E | 500 | Method E | 55.2 | 32 | 11 | 0.8 | 0.5 | 0.5 | 0 | 0 | 0 |
| 53A | E | 480 | Method C | 59.7 | 27 | 11 | 0.8 | 1 | 0.5 | 0 | 0 | 0 |
| 54A | E | 500 | Method E | 54.7 | 32 | 11 | 0.8 | 1 | 0.5 | 0 | 0 | 0 |
| 55A | C | 480 | Method C | 59.5 | 27 | 11 | 0.8 | 1.2 | 0.5 | 0 | 0 | 0 |
| 56A | E | 470 | Method C | 67 | 25 | 7 | 0.5 | 0 | 0.5 | 0.05 | 0 | 0 |
| 57A | E | 520 | Method E | 60.8 | 31 | 7 | 0.5 | 0 | 0.5 | 0.2 | 0 | 0 |
| 58A | E | 510 | Method E | 61.4 | 25 | 12 | 1 | 0 | 0.5 | 0.1 | 0 | 0 |
| 59A | E | 520 | Method E | 55.1 | 31 | 12 | 1 | 0.1 | 0.5 | 0.3 | 0 | 0 |
| 60A | E | 520 | Method E | 60.1 | 25 | 13 | 1 | 0 | 0.5 | 0.4 | 0 | 0 |
| 61A | E | 530 | Method E | 53.9 | 31 | 13 | 1 | 0.1 | 0.5 | 0.5 | 0 | 0 |
| 62A | E | 530 | Method E | 57.7 | 25 | 15 | 1.5 | 0 | 0.5 | 0.3 | 0 | 0 |
| 63A | C | 580 | Method E | 51.3 | 31 | 15 | 1.5 | 0.1 | 0.5 | 0.6 | 0 | 0 |
| 64A | E | 470 | Method C | 67.6 | 22 | 9 | 0.9 | 0 | 0.5 | 0 | 0.05 | 0 |
| 65A | E | 490 | Method C | 61.5 | 28 | 9 | 0.9 | 0 | 0.5 | 0 | 0 | 0.1 |
| 66A | E | 520 | Method E | 56.4 | 33 | 9 | 0.9 | 0 | 0.5 | 0 | 0 | 0 |
| 67A | E | 470 | Method C | 67.5 | 22 | 9 | 0.6 | 0 | 0.5 | 0 | 0.2 | 0.2 |
| 68A | E | 480 | Method C | 65.4 | 24 | 9 | 0.6 | 0 | 0.5 | 0 | 0.5 | 0 |
| 69A | E | 480 | Method C | 65.4 | 24 | 9 | 0.6 | 0 | 0.5 | 0.05 | 0 | 0.5 |
| 70A | E | 480 | Method C | 65.4 | 24 | 9 | 0.6 | 0 | 0.5 | 0.05 | 0 | 0 |

| No. | Components (% by mass) Group A Ce | Group B Cr | Ti | Ni | Co | V | Nb | Cu | Mn | Group C Sr | Sb | Pb | Group D Sn | Bi | In |
|---|---|---|---|---|---|---|---|---|---|---|---|---|---|---|---|
| 36A | 0 | 0 | 0 | 0 | 0 | 0 | 0 | 0 | 0 | 0 | 0 | 0 | 0 | 0 | 0 |
| 37A | 0 | 0 | 0 | 0 | 0 | 0 | 0 | 0 | 0 | 0 | 0 | 0 | 0 | 0 | 0 |
| 38A | 0 | 0 | 0 | 0 | 0 | 0 | 0 | 0 | 0 | 0 | 0 | 0 | 0 | 0 | 0 |
| 39A | 0 | 0 | 0 | 0 | 0 | 0 | 0 | 0 | 0 | 0 | 0 | 0 | 0 | 0 | 0 |
| 40A | 0 | 0 | 0 | 0 | 0 | 0 | 0 | 0 | 0 | 0 | 0 | 0 | 0 | 0 | 0 |
| 41A | 0 | 0 | 0 | 0 | 0 | 0 | 0 | 0 | 0 | 0 | 0 | 0 | 0 | 0 | 0 |
| 42A | 0 | 0 | 0 | 0 | 0 | 0 | 0 | 0 | 0 | 0 | 0 | 0 | 0 | 0 | 0 |
| 43A | 0 | 0 | 0 | 0 | 0 | 0 | 0 | 0 | 0 | 0 | 0 | 0 | 0 | 0 | 0 |
| 44A | 0 | 0 | 0 | 0 | 0 | 0 | 0 | 0 | 0 | 0 | 0 | 0 | 0 | 0 | 0 |
| 45A | 0 | 0 | 0 | 0 | 0 | 0 | 0 | 0 | 0 | 0 | 0 | 0 | 0 | 0 | 0 |
| 46A | 0 | 0 | 0 | 0 | 0 | 0 | 0 | 0 | 0 | 0 | 0 | 0 | 0 | 0 | 0 |
| 47A | 0 | 0 | 0 | 0 | 0 | 0 | 0 | 0 | 0 | 0 | 0 | 0 | 0 | 0 | 0 |
| 48A | 0 | 0 | 0 | 0 | 0 | 0 | 0 | 0 | 0 | 0 | 0 | 0 | 0 | 0 | 0 |
| 49A | 0 | 0 | 0 | 0 | 0 | 0 | 0 | 0 | 0 | 0 | 0 | 0 | 0 | 0 | 0 |
| 50A | 0 | 0 | 0 | 0 | 0 | 0 | 0 | 0 | 0 | 0 | 0 | 0 | 0 | 0 | 0 |
| 51A | 0 | 0 | 0 | 0 | 0 | 0 | 0 | 0 | 0 | 0 | 0 | 0 | 0 | 0 | 0 |
| 52A | 0 | 0 | 0 | 0 | 0 | 0 | 0 | 0 | 0 | 0 | 0 | 0 | 0 | 0 | 0 |
| 53A | 0 | 0 | 0 | 0 | 0 | 0 | 0 | 0 | 0 | 0 | 0 | 0 | 0 | 0 | 0 |
| 54A | 0 | 0 | 0 | 0 | 0 | 0 | 0 | 0 | 0 | 0 | 0 | 0 | 0 | 0 | 0 |
| 55A | 0 | 0 | 0 | 0 | 0 | 0 | 0 | 0 | 0 | 0 | 0 | 0 | 0 | 0 | 0 |
| 56A | 0 | 0 | 0 | 0 | 0 | 0 | 0 | 0 | 0 | 0 | 0 | 0 | 0 | 0 | 0 |
| 57A | 0 | 0 | 0 | 0 | 0 | 0 | 0 | 0 | 0 | 0 | 0 | 0 | 0 | 0 | 0 |
| 58A | 0 | 0 | 0 | 0 | 0 | 0 | 0 | 0 | 0 | 0 | 0 | 0 | 0 | 0 | 0 |
| 59A | 0 | 0 | 0 | 0 | 0 | 0 | 0 | 0 | 0 | 0 | 0 | 0 | 0 | 0 | 0 |
| 60A | 0 | 0 | 0 | 0 | 0 | 0 | 0 | 0 | 0 | 0 | 0 | 0 | 0 | 0 | 0 |
| 61A | 0 | 0 | 0 | 0 | 0 | 0 | 0 | 0 | 0 | 0 | 0 | 0 | 0 | 0 | 0 |
| 62A | 0 | 0 | 0 | 0 | 0 | 0 | 0 | 0 | 0 | 0 | 0 | 0 | 0 | 0 | 0 |
| 63A | 0 | 0 | 0 | 0 | 0 | 0 | 0 | 0 | 0 | 0 | 0 | 0 | 0 | 0 | 0 |
| 64A | 0 | 0 | 0 | 0 | 0 | 0 | 0 | 0 | 0 | 0 | 0 | 0 | 0 | 0 | 0 |
| 65A | 0 | 0 | 0 | 0 | 0 | 0 | 0 | 0 | 0 | 0 | 0 | 0 | 0 | 0 | 0 |
| 66A | 0.2 | 0 | 0 | 0 | 0 | 0 | 0 | 0 | 0 | 0 | 0 | 0 | 0 | 0 | 0 |

TABLE 1-2-1-continued

| | | | | | | | | | | | | | | | |
|---|---|---|---|---|---|---|---|---|---|---|---|---|---|---|---|
| 67A | 0 | 0 | 0 | 0 | 0 | 0 | 0 | 0 | 0 | 0 | 0 | 0 | 0 | 0 | 0 |
| 68A | 0 | 0 | 0 | 0 | 0 | 0 | 0 | 0 | 0 | 0 | 0 | 0 | 0 | 0 | 0 |
| 69A | 0 | 0 | 0 | 0 | 0 | 0 | 0 | 0 | 0 | 0 | 0 | 0 | 0 | 0 | 0 |
| 70A | 0.5 | 0 | 0 | 0 | 0 | 0 | 0 | 0 | 0 | 0 | 0 | 0 | 0 | 0 | 0 |

TABLE 1-2-2

| | Components (% by mass) | | | | |
|---|---|---|---|---|---|
| No. | Total content of Group A | Total content of Ca + Group A | Total content of Group B | Total content of Group C | Total content of Group D |
| 36A | 0 | 0 | 0 | 0 | 0 |
| 37A | 0 | 0.1 | 0 | 0 | 0 |
| 38A | 0 | 0.1 | 0 | 0 | 0 |
| 39A | 0 | 1 | 0 | 0 | 0 |
| 40A | 0 | 1 | 0 | 0 | 0 |
| 41A | 0 | 1 | 0 | 0 | 0 |
| 42A | 0 | 1 | 0 | 0 | 0 |
| 43A | 0 | 2 | 0 | 0 | 0 |
| 44A | 0 | 2 | 0 | 0 | 0 |
| 45A | 0 | 2 | 0 | 0 | 0 |
| 46A | 0 | 2.5 | 0 | 0 | 0 |
| 47A | 0 | 2.5 | 0 | 0 | 0 |
| 48A | 0 | 3 | 0 | 0 | 0 |
| 49A | 0 | 0.8 | 0 | 0 | 0 |
| 50A | 0 | 0.8 | 0 | 0 | 0 |
| 51A | 0 | 0.8 | 0 | 0 | 0 |
| 52A | 0 | 0.8 | 0 | 0 | 0 |
| 53A | 0 | 0.8 | 0 | 0 | 0 |

TABLE 1-2-2-continued

| | Components (% by mass) | | | | |
|---|---|---|---|---|---|
| No. | Total content of Group A | Total content of Ca + Group A | Total content of Group B | Total content of Group C | Total content of Group D |
| 54A | 0 | 0.8 | 0 | 0 | 0 |
| 55A | 0 | 0.8 | 0 | 0 | 0 |
| 56A | 0 | 0.5 | 0 | 0 | 0 |
| 57A | 0 | 0.5 | 0 | 0 | 0 |
| 58A | 0 | 1 | 0 | 0 | 0 |
| 59A | 0 | 1 | 0 | 0 | 0 |
| 60A | 0 | 1 | 0 | 0 | 0 |
| 61A | 0 | 1 | 0 | 0 | 0 |
| 62A | 0 | 1.5 | 0 | 0 | 0 |
| 63A | 0 | 1.5 | 0 | 0 | 0 |
| 64A | 0.05 | 0.95 | 0 | 0 | 0 |
| 65A | 0.1 | 1 | 0 | 0 | 0 |
| 66A | 0.2 | 1.1 | 0 | 0 | 0 |
| 67A | 0.4 | 1 | 0 | 0 | 0 |
| 68A | 0.5 | 1.1 | 0 | 0 | 0 |
| 69A | 0.5 | 1.1 | 0 | 0 | 0 |
| 70A | 0.5 | 1.1 | 0 | 0 | 0 |

TABLE 1-3-1

| | | | | Components (% by mass) | | | | | | | | | |
|---|---|---|---|---|---|---|---|---|---|---|---|---|---|
| | | | | | | | | | | | Group A | | |
| No. | Category | Melting point of a plating bath | Plating method | Zn | Al | Mg | Ca | Si | Fe | B | Y | La | Ce |
| 71A | C | 480 | Method C | 64.2 | 25 | 9 | 0.7 | 0 | 0.5 | 0 | 0.6 | 0 | 0 |
| 72A | C | 480 | Method C | 64.2 | 25 | 9 | 0.7 | 0 | 0.5 | 0 | 0 | 0.6 | 0 |
| 73A | C | 480 | Method C | 64.2 | 25 | 9 | 0.7 | 0 | 0.5 | 0 | 0 | 0 | 0.6 |
| 74A | C | 480 | Method C | 64.5 | 25 | 9 | 0.4 | 0 | 0.5 | 0 | 0.2 | 0.2 | 0.2 |
| 75A | C | 500 | Method E | 60.5 | 29 | 7 | 2.6 | 0 | 0.5 | 0 | 0 | 0.2 | 0.2 |
| 76A | E | 530 | Method E | 58.3 | 26 | 14 | 1 | 0.2 | 0.5 | 0 | 0 | 0 | 0 |
| 77A | E | 530 | Method E | 58.2 | 26 | 14 | 1 | 0.2 | 0.5 | 0 | 0 | 0 | 0 |
| 78A | E | 530 | Method F | 58.2 | 26 | 14 | 1 | 0.2 | 0.5 | 0 | 0 | 0 | 0 |
| 79A | E | 530 | Method E | 58.1 | 26 | 14 | 1 | 0.2 | 0.5 | 0 | 0 | 0 | 0 |
| 80A | E | 490 | Method C | 60.3 | 28 | 10 | 1 | 0 | 0.5 | 0 | 0 | 0 | 0 |
| 81A | C | 490 | Method C | 60.2 | 28 | 10 | 1 | 0 | 0.5 | 0 | 0 | 0 | 0 |
| 82A | E | 490 | Method C | 60.3 | 28 | 10 | 1 | 0 | 0.5 | 0 | 0 | 0 | 0 |
| 83A | E | 490 | Method C | 62.6 | 29 | 7 | 0.5 | 0.2 | 0.5 | 0 | 0 | 0 | 0 |
| 84A | C | 490 | Method A | 62.6 | 29 | 7 | 0.5 | 0.2 | 0.5 | 0 | 0 | 0 | 0 |
| 85A | C | 490 | Method C | 62.5 | 29 | 7 | 0.5 | 0.2 | 0.5 | 0 | 0 | 0 | 0 |
| 86A | C | 490 | Method C | 55.9 | 31 | 11 | 1 | 0 | 0.5 | 0 | 0 | 0 | 0 |
| 87A | E | 490 | Method C | 56.1 | 31 | 11 | 1 | 0 | 0.5 | 0 | 0 | 0 | 0 |
| 88A | C | 490 | Method C | 55.9 | 31 | 11 | 1 | 0 | 0.5 | 0 | 0 | 0 | 0 |
| 89A | E | 460 | Method C | 71.8 | 21 | 6 | 0.5 | 0.2 | 0.5 | 0 | 0 | 0 | 0 |
| 90A | E | 460 | Method C | 69.8 | 21 | 6 | 0.5 | 0.2 | 0.5 | 0 | 0 | 0 | 0 |
| 91A | E | 460 | Method C | 66.8 | 21 | 6 | 0.5 | 0.2 | 0.5 | 0 | 0 | 0 | 0 |
| 92A | E | 460 | Method C | 61.8 | 21 | 6 | 0.5 | 0.2 | 0.5 | 0 | 0 | 0 | 0 |
| 93A | E | 460 | Method C | 56.8 | 21 | 6 | 0.5 | 0.2 | 0.5 | 0 | 0 | 0 | 0 |
| 94A | E | 460 | Method C | 51.8 | 21 | 6 | 0.5 | 0.2 | 0.5 | 0 | 0 | 0 | 0 |
| 95A | C | 460 | Method C | 49.8 | 21 | 6 | 0.5 | 0.2 | 0.5 | 0 | 0 | 0 | 0 |
| 96A | E | 470 | Method C | 62.5 | 23 | 11 | 1 | 0 | 0.5 | 0 | 0 | 0 | 0 |
| 97A | E | 470 | Method C | 62.5 | 23 | 11 | 1 | 0 | 0.5 | 0 | 0 | 0 | 0 |
| 98A | C | 480 | Method C | 59 | 25 | 12 | 1 | 0 | 0.5 | 0 | 0 | 0 | 0 |
| 99A | C | 480 | Method C | 59 | 25 | 12 | 1 | 0 | 0.5 | 0 | 0 | 0 | 0 |

TABLE 1-3-1-continued

| | | | | | | | | | | | | | |
|---|---|---|---|---|---|---|---|---|---|---|---|---|---|
| 100A | E | 490 | Method C | 57 | 26 | 6 | 0.5 | 0 | 0.5 | 0 | 0 | 0 | 0 |
| 101A | C | 490 | Method C | 46 | 26 | 6 | 0.5 | 0 | 0.5 | 0 | 0 | 0 | 0 |
| 102A | C | Zn-Al-Mg | | 85.8 | 11 | 3 | 0 | 0.2 | 0 | 0 | 0 | 0 | 0 |
| 103A | C | Hot-dip Zn plating | | 99.8 | 0.2 | 0 | 0 | 0 | 0 | 0 | 0 | 0 | 0 |

| | Components (% by mass) | | | | | | | | | | | | | |
|---|---|---|---|---|---|---|---|---|---|---|---|---|---|---|
| | Group B | | | | | | | | Group C | | | Group D | | |
| No. | Cr | Ti | Ni | Co | V | Nb | Cu | Mn | Sr | Sb | Pb | Sn | Bi | In |
| 71A | 0 | 0 | 0 | 0 | 0 | 0 | 0 | 0 | 0 | 0 | 0 | 0 | 0 | 0 |
| 72A | 0 | 0 | 0 | 0 | 0 | 0 | 0 | 0 | 0 | 0 | 0 | 0 | 0 | 0 |
| 73A | 0 | 0 | 0 | 0 | 0 | 0 | 0 | 0 | 0 | 0 | 0 | 0 | 0 | 0 |
| 74A | 0 | 0 | 0 | 0 | 0 | 0 | 0 | 0 | 0 | 0 | 0 | 0 | 0 | 0 |
| 75A | 0 | 0 | 0 | 0 | 0 | 0 | 0 | 0 | 0 | 0 | 0 | 0 | 0 | 0 |
| 76A | 0.05 | 0 | 0 | 0 | 0 | 0 | 0 | 0 | 0 | 0 | 0 | 0 | 0 | 0 |
| 77A | 0 | 0.1 | 0 | 0 | 0 | 0 | 0 | 0 | 0 | 0 | 0 | 0 | 0 | 0 |
| 78A | 0 | 0.1 | 0 | 0 | 0 | 0 | 0 | 0 | 0 | 0 | 0 | 0 | 0 | 0 |
| 79A | 0 | 0 | 0.2 | 0 | 0 | 0 | 0 | 0 | 0 | 0 | 0 | 0 | 0 | 0 |
| 80A | 0 | 0 | 0 | 0.25 | 0 | 0 | 0 | 0 | 0 | 0 | 0 | 0 | 0 | 0 |
| 81A | 0.3 | 0 | 0 | 0 | 0 | 0 | 0 | 0 | 0 | 0 | 0 | 0 | 0 | 0 |
| 82A | 0.1 | 0 | 0.1 | 0 | 0.05 | 0 | 0 | 0 | 0 | 0 | 0 | 0 | 0 | 0 |
| 83A | 0 | 0 | 0 | 0 | 0 | 0.1 | 0.1 | 0.05 | 0 | 0 | 0 | 0 | 0 | 0 |
| 84A | 0 | 0 | 0 | 0 | 0 | 0.1 | 0.1 | 0.05 | 0 | 0 | 0 | 0 | 0 | 0 |
| 85A | 0.1 | 0.1 | 0.1 | 0 | 0 | 0 | 0 | 0 | 0 | 0 | 0 | 0 | 0 | 0 |
| 86A | 0 | 0 | 0 | 0 | 0 | 0 | 0 | 0 | 0.6 | 0 | 0 | 0 | 0 | 0 |
| 87A | 0 | 0 | 0 | 0 | 0 | 0 | 0 | 0 | 0.2 | 0.2 | 0 | 0 | 0 | 0 |
| 88A | 0 | 0 | 0 | 0 | 0 | 0 | 0 | 0 | 0.2 | 0.2 | 0.2 | 0 | 0 | 0 |
| 89A | 0 | 0 | 0 | 0 | 0 | 0 | 0 | 0 | 0 | 0 | 0 | 0.05 | 0 | 0 |
| 90A | 0 | 0 | 0 | 0 | 0 | 0 | 0 | 0 | 0 | 0 | 0 | 2 | 0 | 0 |
| 91A | 0 | 0 | 0 | 0 | 0 | 0 | 0 | 0 | 0 | 0 | 0 | 5 | 0 | 0 |
| 92A | 0 | 0 | 0 | 0 | 0 | 0 | 0 | 0 | 0 | 0 | 0 | 10 | 0 | 0 |
| 93A | 0 | 0 | 0 | 0 | 0 | 0 | 0 | 0 | 0 | 0 | 0 | 15 | 0 | 0 |
| 94A | 0 | 0 | 0 | 0 | 0 | 0 | 0 | 0 | 0 | 0 | 0 | 20 | 0 | 0 |
| 95A | 0 | 0 | 0 | 0 | 0 | 0 | 0 | 0 | 0 | 0 | 0 | 22 | 0 | 0 |
| 96A | 0 | 0 | 0 | 0 | 0 | 0 | 0 | 0 | 0 | 0 | 0 | 0 | 2 | 0 |
| 97A | 0 | 0 | 0 | 0 | 0 | 0 | 0 | 0 | 0 | 0 | 0 | 0 | 0 | 2 |
| 98A | 0 | 0 | 0 | 0 | 0 | 0 | 0 | 0 | 0 | 0 | 0 | 0 | 2.5 | 0 |
| 99A | 0 | 0 | 0 | 0 | 0 | 0 | 0 | 0 | 0 | 0 | 0 | 0 | 0 | 2.5 |
| 100A | 0 | 0 | 0 | 0 | 0 | 0 | 0 | 0 | 0 | 0 | 0 | 8 | 1 | 1 |
| 101A | 0 | 0 | 0 | 0 | 0 | 0 | 0 | 0 | 0 | 0 | 0 | 18 | 1.5 | 1.5 |
| 102A | 0 | 0 | 0 | 0 | 0 | 0 | 0 | 0 | 0 | 0 | 0 | 0 | 0 | 0 |
| 103A | 0 | 0 | 0 | 0 | 0 | 0 | 0 | 0 | 0 | 0 | 0 | 0 | 0 | 0 |

TABLE 1-3-2

| | Components (% by mass) | | | | |
|---|---|---|---|---|---|
| No. | Total content of Group A | Total content of Ca + Group A | Total content of Group B | Total content of Group C | Total content of Group D |
| 71A | 0.6 | 1.3 | 0 | 0 | 0 |
| 72A | 0.6 | 1.3 | 0 | 0 | 0 |
| 73A | 0.6 | 1.3 | 0 | 0 | 0 |
| 74A | 0.6 | 1 | 0 | 0 | 0 |
| 75A | 0.4 | 3 | 0 | 0 | 0 |
| 76A | 0 | 1 | 0.05 | 0 | 0 |
| 77A | 0 | 1 | 0.1 | 0 | 0 |
| 78A | 0 | 1 | 0.1 | 0 | 0 |
| 79A | 0 | 1 | 0.2 | 0 | 0 |
| 80A | 0 | 1 | 0.25 | 0 | 0 |
| 81A | 0 | 1 | 0.3 | 0 | 0 |
| 82A | 0 | 1 | 0.25 | 0 | 0 |
| 83A | 0 | 0.5 | 0.25 | 0 | 0 |
| 84A | 0 | 0.5 | 0.25 | 0 | 0 |
| 85A | 0 | 0.5 | 0.3 | 0 | 0 |
| 86A | 0 | 1 | 0 | 0.6 | 0 |
| 87A | 0 | 1 | 0 | 0.4 | 0 |
| 88A | 0 | 1 | 0 | 0.6 | 0 |
| 89A | 0 | 0.5 | 0 | 0 | 0.05 |
| 90A | 0 | 0.5 | 0 | 0 | 2 |
| 91A | 0 | 0.5 | 0 | 0 | 5 |

TABLE 1-3-2-continued

| | Components (% by mass) | | | | |
|---|---|---|---|---|---|
| No. | Total content of Group A | Total content of Ca + Group A | Total content of Group B | Total content of Group C | Total content of Group D |
| 92A | 0 | 0.5 | 0 | 0 | 10 |
| 93A | 0 | 0.5 | 0 | 0 | 15 |
| 94A | 0 | 0.5 | 0 | 0 | 20 |
| 95A | 0 | 0.5 | 0 | 0 | 22 |
| 96A | 0 | 1 | 0 | 0 | 2 |
| 97A | 0 | 1 | 0 | 0 | 2 |
| 98A | 0 | 1 | 0 | 0 | 2.5 |
| 99A | 0 | 1 | 0 | 0 | 2.5 |
| 100A | 0 | 0.5 | 0 | 0 | 10 |
| 101A | 0 | 0.5 | 0 | 0 | 21 |
| 102A | 0 | 0 | 0 | 0 | 0 |
| 103A | 0 | 0 | 0 | 0 | 0 |

TABLE 1-4-1

| | | Constituent phases of the Zn—Al—Mg alloy layer (area fraction, %) | | | | | | | | | | | | |
|---|---|---|---|---|---|---|---|---|---|---|---|---|---|---|
| | | $MgZn_2$ | Al | Zn | | | Ternary eutectic | B | Sn | Other intermetallic compounds | | | | |
| No. | Category | A | B | C | A + B | A + B + C | structure | compound | compound | Total | $Mg_2Si$ | $Ca_2Si$ | CaSi | CZAS | CZA |
| 1A | C | 59 | 9 | 23 | 68 | 91 | 3 | 0 | 0 | 6 | | | | | Ex |
| 2A | C | 48 | 20 | 22 | 68 | 90 | 3 | 0 | 0 | 7 | | | | | Ex |
| 3A | E | 61 | 21 | 8 | 82 | 90 | 2 | 0 | 0 | 8 | | | | | Ex |
| 4A | C | 56 | 17 | 13 | 73 | 86 | 8 | 0 | 0 | 6 | | | | | Ex |
| 5A | C | 54 | 23 | 9 | 77 | 86 | 7 | 0 | 0 | 7 | | | | | Ex |
| 6A | E | 62 | 25 | 8 | 87 | 95 | 2 | 0 | 0 | 3 | | | | | Ex |
| 7A | E | 62 | 20 | 6 | 82 | 88 | 2 | 2 | 1 | 7 | | | | | Ex |
| 8A | E | 69 | 21 | 7 | 90 | 97 | 1 | 1 | 0 | 1 | | | | | Ex |
| 9A | E | 68 | 23 | 6 | 91 | 97 | 0 | 0 | 0 | 3 | | Ex | Ex | Ex | Ex |
| 10A | E | 67 | 27 | 3 | 94 | 97 | 0 | 0 | 0 | 3 | | Ex | Ex | Ex | Ex |
| 11A | E | 65 | 28 | 4 | 93 | 97 | 0 | 0 | 0 | 3 | | Ex | Ex | Ex | Ex |
| 12A | E | 63 | 31 | 4 | 94 | 98 | 0 | 0 | 0 | 2 | | Ex | Ex | Ex | Ex |
| 13A | C | 53 | 31 | 8 | 84 | 92 | 6 | 0 | 0 | 2 | | Ex | Ex | Ex | Ex |
| 14A | E | 62 | 33 | 3 | 95 | 98 | 0 | 0 | 0 | 2 | | Ex | Ex | Ex | Ex |
| 15A | E | 62 | 33 | 3 | 95 | 98 | 0 | 0 | 0 | 2 | | Ex | Ex | Ex | Ex |
| 16A | E | 60 | 35 | 1 | 95 | 96 | 0 | 0 | 0 | 4 | | Ex | Ex | Ex | Ex |
| 17A | C | 58 | 37 | 1 | 95 | 96 | 0 | 0 | 0 | 4 | | Ex | Ex | Ex | Ex |
| 18A | E | 66 | 26 | 6.5 | 92 | 98.5 | 0 | 0 | 0 | 1.5 | | | | | Ex |
| 19A | E | 60 | 26 | 5 | 86 | 91 | 0 | 0 | 0 | 9 | | | | | Ex |
| 20A | E | 64 | 26 | 5 | 90 | 95 | 0 | 0 | 0 | 5 | | | | | Ex |
| 21A | C | 61 | 22 | 11 | 83 | 94 | 0 | 0 | 0 | 6 | | | | | Ex |
| 22A | E | 65 | 28 | 3 | 83 | 96 | 0 | 0 | 0 | 4 | | | | | Ex |
| 23A | E | 66 | 31 | 0 | 97 | 97 | 0 | 0 | 0 | 3 | | Ex | Ex | Ex | Ex |
| 24A | E | 66 | 32 | 0 | 98 | 98 | 0 | 0 | 0 | 2 | | Ex | Ex | Ex | Ex |
| 25A | E | 69 | 23 | 4 | 92 | 96 | 0 | 0 | 0 | 4 | | | | | Ex |
| 26A | C | 63 | 23 | 7 | 86 | 93 | 6 | 0 | 0 | 1 | | | | | Ex |
| 27A | E | 69 | 27 | 2 | 96 | 98 | 0 | 0 | 0 | 2 | | | | | Ex |
| 28A | E | 66 | 32 | 0 | 98 | 98 | 0 | 0 | 0 | 2 | | Ex | Ex | Ex | Ex |
| 29A | E | 75 | 20 | 2 | 95 | 97 | 0 | 0 | 0 | 3 | | | | | Ex |
| 30A | E | 73 | 23 | 2 | 96 | 98 | 0 | 0 | 0 | 2 | | | | | Ex |
| 31A | E | 70 | 27 | 0 | 97 | 97 | 0 | 0 | 0 | 3 | | Ex | Ex | Ex | Ex |
| 32A | E | 75 | 23 | 0 | 98 | 98 | 0 | 0 | 0 | 2 | | | | | Ex |
| 33A | E | 74 | 23 | 0 | 97 | 97 | 0 | 0 | 0 | 3 | | | | | Ex |
| 34A | E | 71 | 25 | 0 | 96 | 96 | 0 | 0 | 0 | 4 | | Ex | Ex | Ex | Ex |
| 35A | C | 76 | 23 | 0 | 99 | 99 | 0 | 0 | 0 | 1 | | | | | Ex |

TABLE 1-4-2

| No. | blowhole occupancy | LME | Corrosion resistance at areas behind welding joints | Corrosion resistance at areas around welding joints | V-bending processability |
|---|---|---|---|---|---|
| 1A | B | B | B | AAA | A |
| 2A | B | B | A | AAA | A |
| 3A | A | A | A | AAA | A |
| 4A | B | B | A | AAA | A |
| 5A | B | B | A | AAA | B |
| 6A | A | A | A | AAA | B |
| 7A | A | S | AA | S | A |
| 8A | S | S | A | AAA | A |
| 9A | S | A | AA | AAA | A |
| 10A | S | A | AA | AAA | A |
| 11A | S | A | AA | AA | A |
| 12A | S | A | AA | A | A |
| 13A | B | B | AA | A | B |
| 14A | S | A | AA | A | A |
| 15A | S | A | AA | A | B |
| 16A | S | A | AA | A | A |
| 17A | S | A | AA | B | A |
| 18A | S | A | A | AAA | A |
| 19A | S | A | A | AAA | B |
| 20A | S | A | A | AA | A |
| 21A | B | B | A | AA | A |
| 22A | S | A | A | AA | A |
| 23A | S | A | AA | A | A |
| 24A | S | A | AA | A | A |
| 25A | S | A | AA | AA | A |
| 26A | B | B | AA | AA | B |

TABLE 1-4-2-continued

| No. | blowhole occupancy | LME | Corrosion resistance at areas behind welding joints | Corrosion resistance at areas around welding joints | V-bending processability |
|---|---|---|---|---|---|
| 27A | S | A | AA | AA | A |
| 28A | S | A | AAA | A | A |
| 29A | S | A | AA | AA | A |
| 30A | S | A | AA | AA | A |
| 31A | S | A | AAA | A | A |
| 32A | S | A | AA | AA | A |
| 33A | S | A | AA | AA | A |
| 34A | S | A | AAA | A | A |
| 35A | B | B | B | B | B |

15

TABLE 1-5-1

| | | Constituent phases of the Zn—Al—Mg alloy layer (area fraction, %) | | | | | | | | | | | | |
|---|---|---|---|---|---|---|---|---|---|---|---|---|---|---|
| | | $MgZn_2$ | Al | Zn | | | Ternary eutectic | B | Sn | Other intermetallic compounds | | | | |
| No. | Category | A | B | C | A + B | A + B + C | structure | compound | compound | Total | $Mg_2Si$ | $Ca_2Si$ | CaSi | CZAS | CZA |
| 36A | C | 65 | 26 | 9 | 91 | 100 | 0 | 0 | 0 | 0 | | | | | |
| 37A | E | 65 | 26 | 8 | 91 | 99 | 0 | 0 | 0 | 1 | | | | | Ex |
| 38A | E | 65 | 25 | 9 | 90 | 99 | 0 | 0 | 0 | 1 | | | | | Ex |
| 39A | E | 65 | 25 | 6 | 90 | 96 | 0 | 0 | 0 | 4 | | | | | Ex |
| 40A | E | 65 | 32 | 1 | 97 | 98 | 0 | 0 | 0 | 2 | | | | | Ex |
| 41A | C | 61 | 23 | 7 | 84 | 91 | 6 | 0 | 0 | 3 | | | | | Ex |
| 42A | E | 65 | 32 | 1 | 97 | 98 | 0 | 0 | 0 | 2 | | | | | Ex |
| 43A | E | 65 | 25 | 4 | 90 | 94 | 0 | 0 | 0 | 6 | | | | | Ex |
| 44A | E | 65 | 33 | 0 | 98 | 98 | 0 | 0 | 0 | 2 | | | | | Ex |
| 45A | E | 65 | 33 | 0 | 98 | 98 | 0 | 0 | 0 | 2 | | | | | Ex |
| 46A | E | 67 | 26 | 2 | 93 | 95 | 0 | 0 | 0 | 5 | | | | | Ex |
| 47A | E | 66 | 32 | 0 | 98 | 98 | 0 | 0 | 0 | 2 | | | | | Ex |
| 48A | C | 62 | 24 | 0 | 86 | 86 | 0 | 0 | 0 | 14 | | | | | Ex |
| 49A | E | 72 | 23 | 0 | 95 | 95 | 0 | 0 | 0 | 5 | | Ex | | Ex | Ex |
| 50A | E | 70 | 28 | 0 | 98 | 98 | 0 | 0 | 0 | 2 | | Ex | | Ex | Ex |
| 51A | E | 72 | 22 | 0 | 94 | 94 | 0 | 0 | 0 | 6 | | Ex | Ex | Ex | |
| 52A | E | 71 | 27 | 0 | 98 | 98 | 0 | 0 | 0 | 2 | | Ex | Ex | Ex | |
| 53A | E | 73 | 23 | 0 | 96 | 96 | 0 | 0 | 0 | 4 | Ex | Ex | Ex | Ex | Ex |
| 54A | E | 70 | 28 | 0 | 98 | 98 | 0 | 0 | 0 | 2 | Ex | Ex | Ex | Ex | Ex |
| 55A | C | 72 | 23 | 0 | 95 | 95 | 0 | 0 | 0 | 5 | Ex | Ex | Ex | Ex | Ex |
| 56A | E | 65 | 24 | 8 | 89 | 97 | 0 | 1 | 0 | 2 | | | | | Ex |
| 57A | E | 64 | 28 | 6 | 92 | 98 | 0 | 1 | 0 | 1 | | | | | Ex |
| 58A | E | 65 | 27 | 4 | 92 | 96 | 0 | 1 | 0 | 3 | | | | | Ex |
| 59A | E | 67 | 29 | 0 | 96 | 96 | 0 | 1 | 0 | 3 | | Ex | | Ex | Ex |
| 60A | E | 68 | 24 | 3 | 92 | 95 | 0 | 1 | 0 | 4 | | | | | Ex |
| 61A | E | 67 | 29 | 0 | 96 | 96 | 0 | 1 | 0 | 3 | | Ex | | Ex | Ex |
| 62A | E | 69 | 23 | 3 | 92 | 95 | 0 | 1 | 0 | 4 | | | | | Ex |
| 63A | C | 68 | 29 | 1 | 97 | 98 | 0 | 1 | 0 | 1 | | Ex | | Ex | Ex |
| 64A | E | 70 | 22 | 1 | 92 | 93 | 3 | 0 | 0 | 4 | | | | | Ex |
| 65A | E | 68 | 27 | 2 | 95 | 97 | 0 | 0 | 0 | 3 | | | | | Ex |
| 66A | E | 66 | 32 | 0 | 98 | 98 | 0 | 0 | 0 | 2 | | | | | Ex |
| 67A | E | 69 | 22 | 4 | 91 | 95 | 3 | 0 | 0 | 2 | | | | | Ex |
| 68A | E | 71 | 23 | 3 | 94 | 97 | 1 | 0 | 0 | 2 | | | | | Ex |
| 69A | E | 70 | 23 | 3 | 93 | 96 | 1 | 1 | 0 | 2 | | | | | Ex |
| 70A | E | 70 | 24 | 3 | 94 | 97 | 1 | 1 | 0 | 1 | | | | | Ex |

TABLE 1-5-2

| No. | blowhole occupancy | LME | Corrosion resistance at areas behind welding joints | Corrosion resistance at areas around welding joints | V-bending processability |
|---|---|---|---|---|---|
| 36A | B | B | B | B | A |
| 37A | S | A | A | AAA | B |
| 38A | S | A | A | AAA | A |
| 39A | S | A | A | AAA | A |

TABLE 1-5-2-continued

| No. | blowhole occupancy | LME | Corrosion resistance at areas behind welding joints | Corrosion resistance at areas around welding joints | V-bending processability |
|---|---|---|---|---|---|
| 40A | S | A | A | A | A |
| 41A | B | B | A | A | A |
| 42A | S | A | A | A | B |
| 43A | S | A | A | AA | A |
| 44A | S | A | A | A | A |
| 45A | S | A | A | A | B |
| 46A | S | A | A | AA | A |
| 47A | S | A | A | A | A |
| 48A | B | B | B | B | B |
| 49A | S | A | AAA | AA | A |
| 50A | S | A | AAA | AA | A |
| 51A | S | A | AAA | AA | A |
| 52A | S | A | AAA | A | A |
| 53A | S | A | AAA | AA | A |
| 54A | S | A | AAA | A | A |
| 55A | B | B | B | B | B |
| 56A | S | S | A | AA | A |
| 57A | S | S | A | A | A |
| 58A | S | S | AA | AA | A |
| 59A | S | S | AAA | A | A |
| 60A | S | S | AA | AA | A |
| 61A | S | S | AAA | A | A |
| 62A | S | S | AA | AA | A |
| 63A | B | B | B | B | B |
| 64A | A | A | AA | AAA | A |
| 65A | S | A | AA | AA | A |
| 66A | S | A | AA | A | A |
| 67A | A | A | AA | AAA | A |
| 68A | S | A | AA | AA | A |
| 69A | S | S | AA | AA | A |
| 70A | S | S | AA | AA | A |

TABLE 1-6-1

| | | Constituent phases of the Zn—Al—Mg alloy layer (area fraction, %) | | | | | | | | | | | | | |
|---|---|---|---|---|---|---|---|---|---|---|---|---|---|---|---|
| | | $MgZn_2$ | Al | Zn | | | Ternary eutectic | B | Sn | Other intermetallic compounds | | | | | |
| No. | Category | A | B | C | A + B | A + B + C | structure | compound | compound | Total | $Mg_2Si$ | $Ca_2Si$ | CaSi | CZAS | CZA |
| 71A | C | 70 | 23 | 4 | 93 | 97 | 0 | 0 | 0 | 3 | | | | | Ex |
| 72A | C | 70 | 24 | 4 | 94 | 98 | 0 | 0 | 0 | 2 | | | | | Ex |
| 73A | C | 70 | 23 | 4 | 93 | 97 | 0 | 0 | 0 | 3 | | | | | Ex |
| 74A | C | 69 | 25 | 4 | 94 | 98 | 0 | 0 | 0 | 2 | | | | | Ex |
| 75A | C | 67 | 27 | 1 | 94 | 95 | 0 | 0 | 0 | 5 | | | | | Ex |
| 76A | E | 73 | 23 | 1 | 96 | 97 | 0 | 0 | 0 | 3 | | | | Ex | Ex |
| 77A | E | 72 | 23 | 1 | 95 | 96 | 0 | 0 | 0 | 4 | | | | Ex | Ex |
| 78A | E | 72 | 23 | 1 | 95 | 96 | 0 | 0 | 0 | 4 | | | | Ex | Ex |
| 79A | E | 73 | 24 | 1 | 97 | 98 | 0 | 0 | 0 | 2 | | | | Ex | Ex |
| 80A | E | 72 | 26 | 0 | 98 | 98 | 0 | 0 | 0 | 2 | | | | | Ex |
| 81A | C | 72 | 27 | 0 | 99 | 99 | 0 | 0 | 0 | 1 | | | | | Ex |
| 82A | E | 70 | 28 | 0 | 98 | 98 | 0 | 0 | 0 | 2 | | | | | Ex |
| 83A | E | 64 | 28 | 6 | 92 | 98 | 0 | 0 | 0 | 2 | | | | Ex | Ex |
| 84A | C | 58 | 21 | 10 | 79 | 89 | 6 | 0 | 0 | 5 | | | | Ex | Ex |
| 85A | C | 62 | 30 | 6 | 92 | 98 | 0 | 0 | 0 | 2 | | | | Ex | Ex |
| 86A | C | 66 | 31 | 0 | 97 | 97 | 0 | 0 | 0 | 3 | | | | | Ex |
| 87A | E | 65 | 32 | 0 | 97 | 97 | 0 | 0 | 0 | 3 | | | | | Ex |
| 88A | C | 67 | 30 | 0 | 97 | 97 | 0 | 0 | 0 | 3 | | | | | Ex |
| 89A | E | 63 | 24 | 8 | 87 | 95 | 2 | 0 | 1 | 2 | | | | Ex | Ex |
| 90A | E | 64 | 23 | 7 | 87 | 94 | 3 | 0 | 1 | 2 | | | | Ex | Ex |
| 91A | E | 60 | 21 | 6 | 81 | 87 | 2 | 0 | 2 | 9 | | | | Ex | Ex |
| 92A | E | 57 | 20 | 6 | 77 | 83 | 3 | 0 | 12 | 2 | | | | Ex | Ex |
| 93A | E | 54 | 20 | 7 | 74 | 81 | 2 | 0 | 15 | 2 | | | | Ex | Ex |
| 94A | E | 50 | 20 | 6 | 70 | 76 | 3 | 0 | 18 | 3 | | | | Ex | Ex |
| 95A | C | 46 | 22 | 7 | 68 | 75 | 2 | 0 | 21 | 2 | | | | Ex | Ex |
| 96A | E | 69 | 25 | 0 | 94 | 94 | 1 | 0 | 0 | 5 | | | | | Ex |
| 97A | E | 70 | 24 | 1 | 94 | 95 | 1 | 0 | 0 | 4 | | | | | Ex |
| 98A | C | 66 | 26 | 1 | 92 | 93 | 0 | 0 | 0 | 7 | | | | | Ex |
| 99A | C | 66 | 25 | 1 | 91 | 92 | 0 | 0 | 0 | 8 | | | | | Ex |
| 100A | E | 66 | 27 | 5 | 93 | 98 | 0 | 0 | 1 | 1 | | | | | Ex |

TABLE 1-6-1-continued

| | | Constituent phases of the Zn—Al—Mg alloy layer (area fraction, %) | | | | | | | | | | | | | |
|---|---|---|---|---|---|---|---|---|---|---|---|---|---|---|---|
| | | $MgZn_2$ | Al | Zn | | | Ternary eutectic | B | Sn | Other intermetallic compounds | | | | | |
| No. | Category | A | B | C | A + B | A + B + C | structure | compound | compound | Total | $Mg_2Si$ | $Ca_2Si$ | CaSi | CZAS | CZA |
| 101A | C | 58 | 27 | 5 | 85 | 90 | 0 | 0 | 9 | 1 | | | | | Ex |
| 102A | C | 5 | 48 | 0 | 53 | 53 | 46 | 0 | 0 | 1 | | Ex | | | |
| 103A | c | 0 | 0 | 100 | 0 | 100 | 0 | 0 | 0 | 0 | | | | | |

TABLE 1-6-2

| No. | blowhole occupancy | LME | Corrosion resistance at areas behind welding joints | Corrosion resistance at areas around welding joints | V-bending processability |
|---|---|---|---|---|---|
| 71A | B | B | B | B | A |
| 72A | B | B | B | B | A |
| 73A | B | B | B | B | A |
| 74A | B | B | B | B | A |
| 75A | B | B | B | B | B |
| 76A | S | A | S | AA | A |
| 77A | S | A | S | AA | A |
| 78A | S | A | S | AA | B |
| 79A | S | A | S | AA | A |
| 80A | S | A | AAA | AA | A |
| 81A | B | B | B | B | B |
| 82A | S | A | AAA | AA | A |
| 83A | S | A | AAA | AA | A |
| 84A | B | B | AAA | AA | A |
| 85A | B | B | B | B | B |
| 86A | B | B | B | B | B |
| 87A | S | A | AA | A | A |
| 88A | B | B | B | B | B |
| 89A | A | A | AA | S | A |
| 90A | A | A | AA | S | A |
| 91A | A | A | AA | S | A |
| 92A | A | A | AA | S | A |
| 93A | A | A | AA | S | A |
| 94A | A | A | AA | S | A |
| 95A | A | A | AA | B | A |
| 96A | S | A | AA | AAA | A |
| 97A | S | A | AA | AAA | A |
| 98A | B | B | B | B | B |
| 99A | B | B | B | B | B |
| 100A | S | A | A | AAA | A |
| 101A | B | B | B | B | A |
| 102A | B | B | B | B | A |
| 103A | B | B | B | B | A |

Example B

Plating baths were prepared using a vacuum melting furnace and predetermined amounts of pure metal ingots under atmospheric conditions to obtain plating layers having any of the chemical compositions indicated in Table 2-1. A batch-type hot-dip plating apparatus was used to prepare metallic coated steel sheets.

As an original metallic uncoated sheet, a 3.2-mm-thick general hot-rolled carbon steel sheet having a size of 100×200 mm (C=0.15%, Si=0.005%, Mn=0.55%, P=0.015%, S=0.005%) was used and cleaned just before plating by degreasing and acid pickling.

In the preparation of any sample, the same reduction method was conducted on the original metallic uncoated sheet in the process from immersion into a plating bath to withdrawal from the plating bath. That is, a metallic coated steel sheet was heated from room temperature to 800° C. by electrical heating in a $N_2$—$H_2$ (5%) (at a dew point of −40° or lower; an oxygen concentration of less than 25 ppm) environment, kept for 60 seconds and then cooled to a temperature of the plating bath temperature plus 10° C. by blowing $N_2$ gas, and then directly immersed into a plating bath.

The immersion time in a plating bath was defined as 0.2 seconds for the original metallic uncoated sheet in any plating process. Each metallic coated steel sheet was prepared by adjusting the pressure of gas in a $N_2$ gas wiping operation in such a manner that the thickness of a plating layer was 20 μm (±1 μm). The process from immersion into a plating bath to completion of wiping was completed within one second by high-speed running of the batch-type plating apparatus, and the temperature was immediately decreased to the melting point of the plating bath by blowing $N_2$ gas.

The following two different plating processes were carried out.

Method C (similar to that in Example A: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 420° C. at a mean cooling rate of 4 (+1) ° C./sec (incubation at a temperature of 420° C. or higher was retained for more than 5 seconds) and from 420° C. to 250° C. at a mean cooling rate of 15 (±5) ° C./sec.

Method G: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 350° C. at a mean cooling rate of 4 (+1) ° C./sec (incubation at a temperature of 420° C. or higher was retained for more than 7 seconds) and from 350° C. to 250° C. at a mean cooling rate of 15 (±5) ° C./sec.

Method H: The plating bath temperature was the melting point of a plating bath plus 20° C. After withdrawal of the original metallic uncoated sheet from the plating bath, the wiping operation was completed at a temperature just above the melting point of the plating bath. The plating layer was obtained in a cooling process where the temperature decreased from the melting point of the plating bath to 250° C. at a mean cooling rate of 4 (±2) ° C./sec (incubation at a temperature of 420° C. or higher was retained for more than 10 seconds).

The obtained metallic coated steel sheets were used similarly to Example A to determine the area fraction of each phase and evaluate various properties.

However, when the presence of Ca—Zn—Al and Ca—Zn—Al intermetallic compound phases were confirmed, the mean grain size of each compound phase was measured according to any existing method. Then, the mean grain sizes are shown in tables. The unit for the mean grain sizes is "μm."

Additionally, the obtained metallic coated steel sheets were used for evaluating the corrosion resistance after coating as follows.

Bead-on-plate test specimens were prepared in the same manner as in the evaluation of LME performed in Example A. Surface conditioning was performed at room temperature for 20 seconds on each test specimen by using a surface conditioning treatment agent (product name: Prepalene-X) manufactured by Nihon Parkerizing Co., Ltd.

Next, phosphate conversion coating was performed using a zinc phosphate-based conversion treatment solution (product name: Palbond 3020) manufactured by Nihon Parkerizing Co., Ltd. Specifically, the hot-rolled steel product was immersed in the treatment solution at 43° C. for 120 seconds. The immersion resulted in formation of a phosphate conversion coating film on the surface of the steel product.

Next, the bead-on-plate test specimen after the phosphate conversion coating was painted with a cationic electrodeposition paint manufactured by Nipponpaint Co., Ltd., by electrodeposition coating with slope application of electricity at 160 V, and then baked at 170° C. for 20 minutes. The mean coating film thickness after the electrodeposition coating was 15 μm in any specimen.

Next, the test specimen was subjected to the JASO test (M609-91) to identify the red rust formation around a bead after the painting.

Detection of red rust specks on a weld bead or heat affected zone before up to 90 cycles was graded as "B."

Detection of red rust specks on a weld bead or heat affected zone before up to 120 cycles was graded as "A."

Detection of red rust specks on a weld bead or heat affected zone before up to 150 cycles was graded as "AA."

Detection of red rust specks on a weld bead or heat affected zone before up to 180 cycles was graded as "AAA."

The results of Example B are summarized in Tables from 2-1 to 2-2.

TABLE 2-1-1

| No. | Category | Melting point of a plating bath | Plating method | Components (% by mass) | | | | | | | | |
|---|---|---|---|---|---|---|---|---|---|---|---|---|
| | | | | | | | | | | | Group A | |
| | | | | Zn | Al | Mg | Ca | Si | Fe | B | Y | La |
| 1B | C | 460 | Method C | 73 | 20 | 6 | 0.5 | 0 | 0.5 | 0 | 0 | 0 |
| 2B | E | 460 | Method G | 73 | 20 | 6 | 0.5 | 0 | 0.5 | 0 | 0 | 0 |
| 3B | E | 460 | Method H | 73 | 20 | 6 | 0.5 | 0 | 0.5 | 0 | 0 | 0 |
| 4B | E | 470 | Method C | 68 | 22 | 9 | 0.6 | 0 | 0.5 | 0 | 0.2 | 0.2 |
| 5B | E | 460 | Method G | 68 | 22 | 9 | 0.6 | 0 | 0.5 | 0 | 0.2 | 0.2 |
| 6B | E | 460 | Method H | 68 | 22 | 9 | 0.6 | 0 | 0.5 | 0 | 0.2 | 0.2 |
| 7B | E | 460 | Method C | 70 | 23 | 6 | 0.5 | 0 | 0.5 | 0.3 | 0 | 0 |
| 8B | E | 460 | Method G | 70 | 23 | 6 | 0.5 | 0 | 0.5 | 0.3 | 0 | 0 |
| 9B | E | 460 | Method H | 70 | 23 | 6 | 0.5 | 0 | 0.5 | 0.3 | 0 | 0 |
| 10B | E | 460 | Method G | 73 | 20 | 6 | 0.5 | 0.3 | 0.5 | 0 | 0 | 0 |
| 11B | E | 460 | Method H | 73 | 20 | 6 | 0.5 | 0.3 | 0.5 | 0 | 0 | 0 |
| 12B | E | 460 | Method G | 74 | 19 | 6 | 0.5 | 0 | 0.5 | 0 | 0 | 0 |
| 13B | E | 460 | Method H | 74 | 19 | 6 | 0.5 | 0 | 0.5 | 0 | 0 | 0 |
| 14B | E | 460 | Method G | 74 | 19 | 6 | 0.5 | 0 | 0.5 | 0 | 0 | 0 |
| 15B | E | 460 | Method H | 74 | 19 | 6 | 0.5 | 0 | 0.5 | 0 | 0 | 0 |
| 16B | E | 460 | Method G | 74 | 19 | 6 | 0.5 | 0.3 | 0.5 | 0 | 0 | 0 |
| 17B | E | 460 | Method H | 74 | 19 | 6 | 0.5 | 0.3 | 0.5 | 0 | 0 | 0 |
| 18B | E | 460 | Method G | 74 | 18 | 6 | 0.5 | 0.3 | 0.5 | 0 | 0 | 0 |
| 19B | E | 460 | Method H | 74 | 18 | 6 | 0.5 | 0.3 | 0.5 | 0 | 0 | 0 |
| 20B | E | 460 | Method G | 75 | 18 | 6 | 0.5 | 0 | 0.5 | 0 | 0.2 | 0 |
| 21B | E | 460 | Method H | 75 | 18 | 6 | 0.5 | 0 | 0.5 | 0 | 0.2 | 0 |
| 22B | E | 460 | Method G | 76 | 17 | 6 | 0.5 | 0 | 0.5 | 0 | 0 | 0 |
| 23B | E | 460 | Method H | 76 | 17 | 6 | 0.5 | 0 | 0.5 | 0 | 0 | 0 |

TABLE 2-1-1-continued

| | | | | | | | | | | | | |
|---|---|---|---|---|---|---|---|---|---|---|---|---|
| 24B | E | 460 | Method G | 76 | 17 | 6 | 0.5 | 0.3 | 0.5 | 0 | 0 | 0 |
| 25B | E | 460 | Method H | 76 | 17 | 6 | 0.5 | 0.3 | 0.5 | 0 | 0 | 0 |
| 26B | E | 460 | Method G | 76 | 17 | 9 | 0.5 | 0.3 | 0.5 | 0 | 0 | 0 |
| 27B | E | 470 | Method H | 76 | 17 | 9 | 0.5 | 0.3 | 0.5 | 0 | 0 | 0 |
| 28B | E | 470 | Method G | 76 | 17 | 6 | 0.5 | 0.3 | 0.5 | 0.1 | 0 | 0 |
| 29B | E | 460 | Method H | 76 | 17 | 6 | 0.5 | 0.3 | 0.5 | 0.1 | 0 | 0 |
| 30B | E | 460 | Method G | 77 | 16 | 6 | 0.2 | 0 | 0.5 | 0 | 0 | 0 |
| 31B | E | 450 | Method H | 77 | 16 | 6 | 0.2 | 0 | 0.5 | 0 | 0 | 0 |
| 32B | E | 450 | Method G | 77 | 16 | 6 | 0.2 | 0.3 | 0.5 | 0 | 0 | 0 |
| 33B | E | 450 | Method H | 77 | 16 | 6 | 0.2 | 0.3 | 0.5 | 0 | 0 | 0 |
| 34B | C | 450 | Method G | 78 | 15 | 6 | 0.2 | 0 | 0.5 | 0 | 0 | 0 |
| 35B | C | 450 | Method H | 78 | 15 | 6 | 0.2 | 0 | 0.5 | 0 | 0 | 0 |
| 36B | C | 450 | Method G | 78 | 15 | 6 | 0.2 | 0.3 | 0.5 | 0 | 0 | 0 |
| 37B | C | 450 | Method H | 78 | 15 | 6 | 0.2 | 0.3 | 0.5 | 0 | 0 | 0 |

| | Components (% by mass) | | | | | | | | | | | | | | |
|---|---|---|---|---|---|---|---|---|---|---|---|---|---|---|---|
| | Group A | Group B | | | | | | | | Group C | | | Group D | | |
| No. | Ce | Cr | Ti | Ni | Co | V | Nb | Cu | Mn | Sr | Sb | Pb | Sn | Bi | In |
| 1B | 0 | 0 | 0 | 0 | 0 | 0 | 0 | 0 | 0 | 0 | 0 | 0 | 0 | 0 | 0 |
| 2B | 0 | 0 | 0 | 0 | 0 | 0 | 0 | 0 | 0 | 0 | 0 | 0 | 0 | 0 | 0 |
| 3B | 0 | 0 | 0 | 0 | 0 | 0 | 0 | 0 | 0 | 0 | 0 | 0 | 0 | 0 | 0 |
| 4B | 0 | 0 | 0 | 0 | 0 | 0 | 0 | 0 | 0 | 0 | 0 | 0 | 0 | 0 | 0 |
| 5B | 0 | 0 | 0 | 0 | 0 | 0 | 0 | 0 | 0 | 0 | 0 | 0 | 0 | 0 | 0 |
| 6B | 0 | 0 | 0 | 0 | 0 | 0 | 0 | 0 | 0 | 0 | 0 | 0 | 0 | 0 | 0 |
| 7B | 0 | 0 | 0 | 0 | 0 | 0 | 0 | 0 | 0 | 0 | 0 | 0.05 | 0 | 0 | 0 |
| 8B | 0 | 0 | 0 | 0 | 0 | 0 | 0 | 0 | 0 | 0 | 0 | 0.05 | 0 | 0 | 0 |
| 9B | 0 | 0 | 0 | 0 | 0 | 0 | 0 | 0 | 0 | 0 | 0 | 0.05 | 0 | 0 | 0 |
| 10B | 0 | 0 | 0 | 0 | 0 | 0 | 0 | 0 | 0 | 0 | 0 | 0 | 0 | 0 | 0 |
| 11B | 0 | 0 | 0 | 0 | 0 | 0 | 0 | 0 | 0 | 0 | 0 | 0 | 0 | 0 | 0 |
| 12B | 0 | 0 | 0 | 0 | 0 | 0 | 0 | 0 | 0 | 0 | 0 | 0 | 0 | 0 | 0 |
| 13B | 0 | 0 | 0 | 0 | 0 | 0 | 0 | 0 | 0 | 0 | 0 | 0 | 0 | 0 | 0 |
| 14B | 0 | 0 | 0 | 0.2 | 0 | 0 | 0 | 0 | 0 | 0 | 0 | 0 | 0 | 0 | 0 |
| 15B | 0 | 0 | 0 | 0.2 | 0 | 0 | 0 | 0 | 0 | 0 | 0 | 0 | 0 | 0 | 0 |
| 16B | 0 | 0 | 0 | 0 | 0 | 0 | 0 | 0 | 0 | 0 | 0 | 0 | 0 | 0 | 0 |
| 17B | 0 | 0 | 0 | 0 | 0 | 0 | 0 | 0 | 0 | 0 | 0 | 0 | 0 | 0 | 0 |
| 18B | 0 | 0 | 0 | 0 | 0 | 0 | 0 | 0 | 0 | 0 | 0 | 0 | 1 | 0 | 0 |
| 19B | 0 | 0 | 0 | 0 | 0 | 0 | 0 | 0 | 0 | 0 | 0 | 0 | 1 | 0 | 0 |
| 20B | 0 | 0 | 0 | 0 | 0 | 0 | 0 | 0 | 0 | 0 | 0 | 0 | 0 | 0 | 0 |
| 21B | 0 | 0 | 0 | 0 | 0 | 0 | 0 | 0 | 0 | 0 | 0 | 0 | 0 | 0 | 0 |
| 22B | 0 | 0 | 0 | 0 | 0 | 0 | 0 | 0 | 0 | 0 | 0 | 0 | 0 | 0 | 0 |
| 23B | 0 | 0 | 0 | 0 | 0 | 0 | 0 | 0 | 0 | 0 | 0 | 0 | 0 | 0 | 0 |
| 24B | 0 | 0 | 0 | 0 | 0 | 0 | 0 | 0 | 0 | 0 | 0 | 0 | 0 | 0 | 0 |
| 25B | 0 | 0 | 0 | 0 | 0 | 0 | 0 | 0 | 0 | 0 | 0 | 0 | 0 | 0 | 0 |
| 26B | 0 | 0 | 0 | 0 | 0 | 0 | 0 | 0 | 0 | 0 | 0 | 0 | 0 | 0 | 0 |
| 27B | 0 | 0 | 0 | 0 | 0 | 0 | 0 | 0 | 0 | 0 | 0 | 0 | 0 | 0 | 0 |
| 28B | 0 | 0 | 0 | 0 | 0 | 0 | 0 | 0 | 0 | 0 | 0 | 0 | 0 | 0 | 0 |
| 29B | 0 | 0 | 0 | 0 | 0 | 0 | 0 | 0 | 0 | 0 | 0 | 0 | 0 | 0 | 0 |
| 30B | 0 | 0 | 0 | 0 | 0 | 0 | 0 | 0 | 0 | 0 | 0 | 0 | 0 | 0 | 0 |
| 31B | 0 | 0 | 0 | 0 | 0 | 0 | 0 | 0 | 0 | 0 | 0 | 0 | 0 | 0 | 0 |
| 32B | 0 | 0 | 0 | 0 | 0 | 0 | 0 | 0 | 0 | 0 | 0 | 0 | 0 | 0 | 0 |
| 33B | 0 | 0 | 0 | 0 | 0 | 0 | 0 | 0 | 0 | 0 | 0 | 0 | 0 | 0 | 0 |
| 34B | 0 | 0 | 0 | 0 | 0 | 0 | 0 | 0 | 0 | 0 | 0 | 0 | 0 | 0 | 0 |
| 35B | 0 | 0 | 0 | 0 | 0 | 0 | 0 | 0 | 0 | 0 | 0 | 0 | 0 | 0 | 0 |
| 36B | 0 | 0 | 0 | 0 | 0 | 0 | 0 | 0 | 0 | 0 | 0 | 0 | 0 | 0 | 0 |
| 37B | 0 | 0 | 0 | 0 | 0 | 0 | 0 | 0 | 0 | 0 | 0 | 0 | 0 | 0 | 0 |

TABLE 2-1-2

| | Component (% by mass) | | | | |
|---|---|---|---|---|---|
| No. | Total content of Group A | Total content of Ca + Group A | Total content of Group B | Total content of Group C | Total content of Group D |
| 1B | 0 | 0.5 | 0 | 0 | 0 |
| 2B | 0 | 0.5 | 0 | 0 | 0 |
| 3B | 0 | 0.5 | 0 | 0 | 0 |
| 4B | 0.4 | 1 | 0 | 0 | 0 |
| 5B | 0.4 | 1 | 0 | 0 | 0 |
| 6B | 0.4 | 1 | 0 | 0 | 0 |
| 7B | 0 | 0.5 | 0 | 0.05 | 0 |
| 8B | 0 | 0.5 | 0 | 0.05 | 0 |
| 9B | 0 | 0.5 | 0 | 0.05 | 0 |

TABLE 2-1-2-continued

| | Component (% by mass) | | | | |
|---|---|---|---|---|---|
| No. | Total content of Group A | Total content of Ca + Group A | Total content of Group B | Total content of Group C | Total content of Group D |
| 10B | 0 | 0.5 | 0 | 0 | 0 |
| 11B | 0 | 0.5 | 0 | 0 | 0 |
| 12B | 0 | 0.5 | 0 | 0 | 0 |
| 13B | 0 | 0.5 | 0 | 0 | 0 |
| 14B | 0 | 0.5 | 0.2 | 0 | 0 |
| 15B | 0 | 0.5 | 0.2 | 0 | 0 |
| 16B | 0 | 0.5 | 0 | 0 | 0 |
| 17B | 0 | 0.5 | 0 | 0 | 0 |
| 18B | 0 | 0.5 | 0 | 0 | 1 |

TABLE 2-1-2-continued

| No. | Component (% by mass) Total content of Group A | Total content of Ca + Group A | Total content of Group B | Total content of Group C | Total content of Group D |
|---|---|---|---|---|---|
| 19B | 0 | 0.5 | 0 | 0 | 1 |
| 20B | 0.2 | 0.7 | 0 | 0 | 0 |
| 21B | 0.2 | 0.7 | 0 | 0 | 0 |
| 22B | 0 | 0.5 | 0 | 0 | 0 |
| 23B | 0 | 0.5 | 0 | 0 | 0 |
| 24B | 0 | 0.5 | 0 | 0 | 0 |
| 25B | 0 | 0.5 | 0 | 0 | 0 |
| 26B | 0 | 0.5 | 0 | 0 | 0 |
| 27B | 0 | 0.5 | 0 | 0 | 0 |
| 28B | 0 | 0.5 | 0 | 0 | 0 |

TABLE 2-1-2-continued

| No. | Component (% by mass) Total content of Group A | Total content of Ca + Group A | Total content of Group B | Total content of Group C | Total content of Group D |
|---|---|---|---|---|---|
| 29B | 0 | 0.5 | 0 | 0 | 0 |
| 30B | 0 | 0.2 | 0 | 0 | 0 |
| 31B | 0 | 0.2 | 0 | 0 | 0 |
| 32B | 0 | 0.2 | 0 | 0 | 0 |
| 33B | 0 | 0.2 | 0 | 0 | 0 |
| 34B | 0 | 0.2 | 0 | 0 | 0 |
| 35B | 0 | 0.2 | 0 | 0 | 0 |
| 36B | 0 | 0.2 | 0 | 0 | 0 |
| 37B | 0 | 0.2 | 0 | 0 | 0 |

TABLE 2-2-1

| No. | Category | Constituent phases of the Zn—Al—Mg alloy layer (area fraction, %) $MgZn_2$ A | Al B | Zn C | A + B | A + B + C | Ternary eutectic structure | B compound | Sn compound | Other intermetallic compounds Total | $Mg_2Si$ | $Ca_2Si$ | CaSi | CZAS | CZA |
|---|---|---|---|---|---|---|---|---|---|---|---|---|---|---|---|
| 1B | C | 59 | 9 | 23 | 68 | 91 | 3 | 0 | 0 | | 6 | | | | 0.5 |
| 2B | E | 60 | 16 | 9 | 76 | 85 | 4 | 0 | 0 | | 11 | | | | 1 |
| 3B | E | 60 | 16 | 11 | 76 | 87 | 4 | 0 | 0 | | 9 | | | | 1.1 |
| 4B | E | 69 | 22 | 4 | 91 | 95 | 3 | 0 | 0 | | 2 | | | | 0.5 |
| 5B | E | 70 | 21 | 3 | 91 | 94 | 3 | 2 | 0 | | 1 | | | | 1.1 |
| 6B | E | 70 | 21 | 3 | 91 | 94 | 3 | 2 | 0 | | 1 | | | | 1.1 |
| 7B | E | 69 | 21 | 7 | 90 | 97 | 1 | 1 | 0 | | 1 | | | | 0.5 |
| 8B | E | 68 | 22 | 7 | 90 | 97 | 1 | 1 | 0 | | 1 | | | | 1.1 |
| 9B | E | 68 | 22 | 7 | 90 | 97 | 1 | 1 | 0 | | 1 | | | | 1.1 |
| 10B | E | 60 | 16 | 9 | 76 | 85 | 4 | 0 | 0 | | 11 | | | 1.1 | 1.1 |
| 11B | E | 60 | 16 | 11 | 76 | 87 | 4 | 0 | 0 | | 9 | | | 1.1 | 1.1 |
| 12B | E | 60 | 14 | 10 | 74 | 84 | 4 | 0 | 0 | | 12 | | | | 1.1 |
| 13B | E | 60 | 14 | 12 | 74 | 86 | 4 | 0 | 0 | | 10 | | | | 1.1 |
| 14B | E | 60 | 14 | 10 | 74 | 84 | 4 | 0 | 0 | | 12 | | | | 1.1 |
| 15B | E | 60 | 14 | 12 | 74 | 86 | 4 | 0 | 0 | | 10 | | | | 1.1 |
| 16B | E | 60 | 14 | 10 | 74 | 84 | 4 | 0 | 0 | | 12 | | | | 1.1 |
| 17B | E | 60 | 14 | 12 | 74 | 86 | 4 | 0 | 0 | | 10 | | | 1.1 | 1.1 |
| 18B | E | 58 | 11 | 9 | 69 | 78 | 5 | 0 | 1 | | 16 | | | 1.1 | 1.1 |
| 19B | E | 58 | 11 | 11 | 69 | 80 | 5 | 0 | 1 | | 14 | | | 1.1 | 1.1 |
| 20B | E | 58 | 12 | 9 | 70 | 79 | 5 | 0 | 0 | | 16 | | | | 1.1 |
| 21B | E | 58 | 12 | 11 | 70 | 81 | 5 | 0 | 0 | | 14 | | | | 1.1 |
| 22B | E | 60 | 10 | 10 | 70 | 80 | 5 | 0 | 0 | | 15 | | | | 1.1 |
| 23B | E | 60 | 10 | 13 | 70 | 83 | 5 | 0 | 0 | | 12 | | | | 1.1 |
| 24B | E | 60 | 10 | 11 | 70 | 81 | 5 | 0 | 0 | | 14 | | | 1.1 | 1.1 |
| 25B | E | 60 | 10 | 13 | 70 | 83 | 5 | 0 | 0 | | 12 | | | 1.1 | 1.1 |
| 26B | E | 66 | 10 | 10 | 76 | 86 | 5 | 0 | 0 | | 9 | | | 1.1 | 1.1 |
| 27B | E | 66 | 10 | 12 | 76 | 88 | 5 | 0 | 0 | | 7 | | | 1.1 | 1.1 |
| 28B | E | 60 | 10 | 11 | 70 | 81 | 5 | 1 | 0 | | 13 | | | 1.1 | 1.1 |
| 29B | E | 60 | 10 | 13 | 70 | 83 | 5 | 1 | 0 | | 11 | | | 1.1 | 1.1 |
| 30B | E | 59 | 8 | 13 | 67 | 80 | 5 | 0 | 0 | | 15 | | | | 1 |
| 31B | E | 59 | 8 | 15 | 67 | 82 | 5 | 0 | 0 | | 13 | | | | 1 |
| 32B | E | 59 | 8 | 13 | 67 | 80 | 5 | 0 | 0 | | 15 | | | 1.1 | 1.1 |
| 33B | E | 59 | 8 | 15 | 67 | 82 | 5 | 0 | 0 | | 13 | | | 1.1 | 1.1 |
| 34B | C | 57 | 8 | 18 | 65 | 83 | 7 | 0 | 0 | | 10 | | | | 0.8 |
| 35B | C | 57 | 8 | 20 | 65 | 85 | 7 | 0 | 0 | | 8 | | | | 0.8 |
| 36B | C | 57 | 8 | 18 | 65 | 83 | 7 | 0 | 0 | | 10 | | | | 0.8 |
| 37B | C | 57 | 8 | 20 | 65 | 85 | 7 | 0 | 0 | | 8 | | | 0.8 | 0.8 |

TABLE 2-2-2

| No. | blowhole occupancy | LME | Corrosion resistance at areas behind welding joints | Corrosion resistance at areas around welding joints | V-bending processability | Corrosion resistance after coating |
|---|---|---|---|---|---|---|
| 1B | B | B | B | AAA | A | AAA |
| 2B | A | A | A | AAA | A | AAA |

TABLE 2-2-2-continued

| No. | blowhole occupancy | LME | Corrosion resistance at areas behind welding joints | Corrosion resistance at areas around welding joints | V-bending processability | Corrosion resistance after coating |
|---|---|---|---|---|---|---|
| 3B | A | A | A | AAA | A | AAA |
| 4B | A | A | AA | AAA | A | AA |
| 5B | A | A | AA | AAA | A | AA |
| 6B | A | A | AA | AAA | A | AA |
| 7B | S | S | A | AAA | A | A |
| 8B | S | S | A | AAA | A | A |
| 9B | S | S | A | AAA | A | A |
| 10B | A | A | AA | AAA | A | AAA |
| 11B | A | A | AA | AAA | A | AAA |
| 12B | A | A | A | AAA | A | AAA |
| 13B | A | A | A | AAA | A | AAA |
| 14B | A | A | AA | AAA | A | AAA |
| 15B | A | A | AA | AAA | A | AAA |
| 16B | A | A | AA | AAA | A | AAA |
| 17B | A | A | AA | AAA | A | AAA |
| 18B | A | A | AA | S | A | AAA |
| 19B | A | A | AA | S | A | AAA |
| 20B | A | A | AA | AAA | A | AAA |
| 21B | A | A | AA | AAA | A | AAA |
| 22B | A | A | AA | AAA | A | AAA |
| 23B | A | A | A | AAA | A | AAA |
| 24B | A | A | A | AAA | A | AAA |
| 25B | A | A | AA | AAA | A | AAA |
| 26B | A | A | AA | AAA | A | AAA |
| 27B | A | A | AA | AAA | A | AAA |
| 28B | A | AA | AA | AAA | A | AAA |
| 29B | A | AA | AA | AAA | A | AAA |
| 30B | A | A | A | AAA | A | AAA |
| 31B | A | A | A | AAA | A | AAA |
| 32B | A | A | AA | AAA | A | AAA |
| 33B | A | A | AA | AAA | A | AAA |
| 34B | B | B | B | AAA | A | AAA |
| 35B | B | B | B | AAA | A | AAA |
| 36B | B | B | B | AAA | A | AAA |
| 37B | B | B | B | AAA | A | AAA |

Although preferred embodiments of the present disclosure have been described in detail with reference to appended figures, the present disclosure is not restricted to them. Obviously, various changes or modifications within the spirit and scope as defined in the appended claims may occur to a person with an ordinary skill in the art to which the present disclosure belongs, and it is to be understood that such changes or modifications should be within the technical scope of the present disclosure.

The objects indicated by numerical signs in FIGS. 1 to 7 are as follows.

1: Al phase (including fine Zn phase)
2: $MgZn_2$ phase (in a massive form)
3: Zn—Al-$MgZn_2$ ternary eutectic structure
4: $MgZn_2$ phase (in a massive form)
5: Al phase (α-phase)
6: Al phase (β-phase)
7: Zn phase
8: Ca—Al—B intermetallic compound phase B compound ($Al_2CaB_5$ phase: with an atomic ratio estimated by quantitative EDS analysis)
9: Zn phase in Zn—Al-$MgZn_2$ ternary eutectic structure
10: $MgZn_2$ phase in Zn—Al-$MgZn_2$ ternary eutectic structure
11: Al phase in Zn—Al-$MgZn_2$ ternary eutectic structure
20: α-phase (typical α-phase)
21: β-phase (typical β-phase)
100: Plating layer
100A: Plating layer
101: Zn—Al—Mg alloy layer
101A: Zn—Al—Mg alloy layer
102: Al—Fe alloy layer
102A: Al—Fe alloy layer
103: Steel product
103A: Steel product The following appendixes are further disclosed in the present disclosure.

APPENDIX 1

A hot-dip metallic coated steel sheet including a steel product and a plating layer that is provided on a surface of the steel product and includes a Zn—Al—Mg alloy layer, wherein in an arbitrary sectional structure of the Zn—Al—Mg alloy layer the total area fraction of $MgZn_2$ and Al phases is not less than 70%, and the area fraction of Zn phase is less than 10%, each phase having a grain size of not less than 1 μm in terms of the diameter of the corresponding diameter;

wherein the Zn—Al—Mg alloy layer contains at least one intermetallic compound phase selected from the group consisting of $Mg_2Si$ phase, $Ca_2Si$ phase, CaSi phase, Ca—Zn—Al phase, and Ca—Zn—Al—Si phase; and wherein the plating layer has a chemical composition consisting of, by mass, Zn: from more than 44.9% to less than 74.9%;
Al: from more than 20% to less than 35%;
Mg: from more than 5% to less than 20%;
Ca: from 0.1% to less than 3.0%;
Si: from 0% to 1%;

B: from 0% to 0.5%;
Y: from 0% to 0.5%;
La: from 0% to 0.5%;
Ce: from 0% to 0.5%;
Cr: from 0% to 0.25%;
Ti: from 0% to 0.25%;
Ni: from 0% to 0.25%;
Co: from 0% to 0.25%;
V: from 0% to 0.25%;
Nb: from 0% to 0.25%;
Cu: from 0% to 0.25%;
Mn: from 0% to 0.25%;
Sr: from 0% to 0.5%;
Sb: from 0% to 0.5%;
Pb: from 0% to 0.5%;
Sn: from 0% to 20%;
Bi: from 0% to 2%;
In: from 0% to 2%;
Fe: from 0% to 5%; and
impurities, provided that an element group A consists of Y, La, and Ce, and an element group B consists of Cr, Ti, Ni, Co, V, Nb, Cu, and Mn, and an element group C consists of Sr, Sb, and Pb, and an element group D consists of Sn, Bi, and In, and that the total content of elements selected from the element group A is not more than 0.5%; the total content of Ca and elements selected from the element group A is less than 3.0%; the total content of elements selected from the element group B is not more than 0.25%; the total content of elements selected from the element group C is not more than 0.5%; and the total content of elements selected from the element group D is not more than 20%.

APPENDIX 2

The hot-dip metallic coated steel sheet according to Appendix 1, wherein the content of Al is from more than 22% to less than 35%, and the content of Mg is from more than 10% to less than 20%, and the content of Ca is from 0.3% to less than 3.0%, and the content of Si is from 0.1% to 1%.

APPENDIX 3

The hot-dip metallic coated steel sheet according to Appendix 1 or 2, wherein the plating layer contains at least one selected from the group consisting of B, an element group A (Y, La, Ce), an element group B (Cr, Ti, Ni, Co, V, Nb, Cu, Mn), and an element group C (Sr, Sb, Pb); and the content of B ranges from 0.05% to 0.5% by mass in cases where the plating layer contains B;

the total content of elements selected from the element group A ranges from 0.05% to 0.5% by mass in cases where the plating layer contains the elements;

the total content of elements selected from the element group B ranges from 0.05% to 0.25% by mass in cases where the plating layer contains the elements; and the total content of elements selected from the element group C ranges from 0.05% to 0.5% by mass in cases where the plating layer contains the elements.

APPENDIX 4

The hot-dip metallic coated steel sheet according to any one Appendixes 1 to 3, wherein the Zn—Al—Mg alloy layer contains $Al_2CaB_5$ or a Ca—Al—B compound with substitution of some atoms by Zn and Mg, and wherein the Ca—Al—B intermetallic compound phase contains B at a concentration of not less than 40% by atom.

APPENDIX 5

The hot-dip metallic coated steel sheet according to any one of Appendixes 1 to 4, wherein the plating layer contains at least one element selected from the element group D (Sn, Bi, In), and the plating layer satisfies the following formula, by mass, $$Sn+Bi+In=0.05\% \text{ to } 20\%,$$

and the plating layer further contains at least one intermetallic compound selected from the group consisting of $Mg_2Sn$, $Mg_3Bi_2$, and $Mg_3In$.

APPENDIX 6

The hot-dip metallic coated steel sheet according to any one of Appendixes 1 to 5, wherein the plating layer further contains an Al—Fe alloy layer, and the Al—Fe alloy layer is formed on a surface of the steel product, and the Zn—Al—Mg alloy layer is formed on the Al—Fe alloy layer.

The disclosure of the Japanese Patent Application No. 2017-013259 is herein incorporated by reference in its entirety.

All publications, patent applications, and technical standards described in this specification are incorporated by reference to the same extent as if each individual publication, patent application, or technical standard was specifically and individually indicated to be incorporated by reference.

The invention claimed is:

1. A metallic coated steel product including a steel product and a plating layer that is provided on a surface of the steel product and comprises a Zn— Al—Mg alloy layer, wherein, in a cross-section of the Zn—Al—Mg alloy layer, an area fraction of $MgZn_2$ phase is from 45 to 75%, a total area fraction of $MgZn_2$ and Al phases is not less than 70%, and an area fraction of Zn—Al—$MgZn_2$ ternary eutectic structure is from 0 to 5%, and wherein the plating layer has a chemical composition consisting of, by mass:

Zn: from more than 44.90% to less than 79.90%;
Al: from more than 15% to less than 35%;
Mg: from more than 5% to less than 20%;
Ca: from 0.1% to less than 3.0%;
Si: from 0% to 1.0%;
B: from 0% to 0.5%;
Y: from 0% to 0.5%;
La: from 0% to 0.5%;
Ce: from 0% to 0.5%;
Cr: from 0% to 0.25%;
Ti: from 0% to 0.25%;
Ni: from 0% to 0.25%;
Co: from 0% to 0.25%;
V: from 0% to 0.25%;
Nb: from 0% to 0.25%;
Cu: from 0% to 0.25%;
Mn: from 0% to 0.25%;
Sr: from 0% to 0.5%;
Sb: from 0% to 0.5%;
Pb: from 0% to 0.5%;
Sn: from 0% to 20.00%;
Bi: from 0% to 2.0%;
In: from 0% to 2.0%;
Fe: from 0% to 5.0%; and
impurities, wherein, provided that an element group A consists of Y, La, and Ce, an element group B consists of Cr, Ti, Ni, Co, V, Nb, Cu, and Mn, an element group C consists of Sr, Sb, and Pb, and an element group D consists of Sn, Bi, and In:

a total content of elements selected from the element group A ranges from 0% to 0.5%;

a total content of Ca and elements selected from the element group A ranges from 0.1% to less than 3.0%;

a total content of elements selected from the element group B ranges from 0% to 0.25%;

a total content of elements selected from the element group C ranges from 0% to 0.5%; and a total content of elements selected from the element group D ranges from 0% to 20.00%.

2. The metallic coated steel product according to claim 1, wherein the Zn—Al—Mg alloy layer contains at least one intermetallic compound phase selected from the group consisting of $Mg_2Si$ phase, $Ca_2Si$ phase, CaSi phase, Ca—Zn—Al intermetallic compound phase, and Ca—Zn—Al—Si intermetallic compound phase.

3. The metallic coated steel product according to claim 1, wherein the contents of Al, Mg, Ca, and Si respectively range from more than 22% to less than 35%, from more than 10% to less than 20%, from 0.3% to less than 3.0%, and from 0.1% to 1.0%.

4. The metallic coated steel product according to claim 1, wherein the content of the Al ranges from more than 15% to 22%.

5. The metallic coated steel product according to claim 1, wherein the content of B ranges from 0.05% to 0.5% by mass in a case in which the plating layer contains B;

the total content of elements selected from the element group A ranges from 0.05% to 0.5% by mass in a case in which the plating layer contains elements selected from the element group A;

the total content of elements selected from the element group B ranges from 0.05% to 0.25% by mass in a case in which the plating layer contains elements selected from the element group B; and the total content of elements selected from the element group C ranges from 0.05% to 0.5% by mass in a case in which the plating layer contains elements selected from the element group C.

6. The metallic coated steel product according to claim 1, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

7. The metallic coated steel product according to claim 1, wherein the total content of elements selected from the element group D ranges from 0.05% to 20% by mass in a case in which the plating layer contains elements selected from the element group D; and the Zn—Al—Mg alloy layer contains at least one intermetallic compound phase selected from the group consisting of $Mg_2Sn$ phase, $Mg_3Bi_2$ phase, and $Mg_3In$ phase.

8. The metallic coated steel product according to claim 1, wherein the plating layer contains an Al—Fe alloy layer between the steel product and the Zn—Al—Mg alloy layer.

9. The metallic coated steel product according to claim 2, wherein the contents of Al, Mg, Ca, and Si respectively range from more than 22% to less than 35%, from more than 10% to less than 20%, from 0.3% to less than 3.0%, and from 0.1% to 1.0%.

10. The metallic coated steel product according to claim 2, wherein the content of the Al ranges from more than 15% to 22%.

11. The metallic coated steel product according to claim 2, wherein the content of B ranges from 0.05% to 0.5% by mass in a case in which the plating layer contains B;

the total content of elements selected from the element group A ranges from 0.05% to 0.5% by mass in a case in which the plating layer contains elements selected from the element group A;

the total content of elements selected from the element group B ranges from 0.05% to 0.25% by mass in a case in which the plating layer contains elements selected from the element group B; and the total content of elements selected from the element group C ranges from 0.05% to 0.5% by mass in a case in which the plating layer contains elements selected from the element group C.

12. The metallic coated steel product according to claim 3, wherein the content of B ranges from 0.05% to 0.5% by mass in a case in which the plating layer contains B;

the total content of elements selected from the element group A ranges from 0.05% to 0.5% by mass in a case in which the plating layer contains elements selected from the element group A;

the total content of elements selected from the element group B ranges from 0.05% to 0.25% by mass in a case in which the plating layer contains elements selected from the element group B; and the total content of elements selected from the element group C ranges from 0.05% to 0.5% by mass in a case in which the plating layer contains elements selected from the element group C.

13. The metallic coated steel product according to claim 2, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

14. The metallic coated steel product according to claim 3, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

15. The metallic coated steel product according to claim 4, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

16. The metallic coated steel product according to claim 5, wherein the Zn—Al—Mg alloy layer contains a Ca—Al—B intermetallic compound phase selected from the group consisting of $Al_2CaB_5$ phase and compound phases derived from $Al_2CaB_5$ phase with substitution of some atoms by Zn and Mg, and wherein the Ca—Al—B intermetallic compound phase contains B at a concentration of not less than 40% by atom.

17. The metallic coated steel product according to claim 2, wherein the total content of elements selected from the element group D ranges from 0.05% to 20% by mass in a case in which the plating layer contains elements selected from the element group D; and the Zn—Al—Mg alloy layer contains at least one intermetallic compound phase selected from the group consisting of $Mg_2Sn$ phase, $Mg_3Bi_2$ phase, and $Mg_3In$ phase.

18. The metallic coated steel product according to claim 3, wherein the total content of elements selected from the element group D ranges from 0.05% to 20% by mass in a case in which the plating layer contains elements selected from the element group D; and the Zn—Al—Mg alloy layer contains at least one intermetallic compound phase selected from the group consisting of $Mg_2Sn$ phase, $Mg_3Bi_2$ phase, and $Mg_3In$ phase.

* * * * *